US012686558B2

(12) United States Patent
Pherson

(10) Patent No.: US 12,686,558 B2
(45) Date of Patent: Jul. 21, 2026

(54) HIGH-SURFACE AREA THERMAL PROTECTION MODULES FOR CARGO CONTAINERS AND CARGO CONTAINERS INCLUDING THE SAME

(71) Applicant: Advanced Composite Structures, LLC, Charleston, SC (US)

(72) Inventor: Thomas R. Pherson, Daniel Island, SC (US)

(73) Assignee: Advanced Composite Structures, LLC, Charleston, SC (US)

( * ) Notice: Subject to any disclaimer, the term of this patent is extended or adjusted under 35 U.S.C. 154(b) by 0 days.

(21) Appl. No.: 18/887,481

(22) Filed: Sep. 17, 2024

(65) Prior Publication Data

US 2025/0011073 A1 Jan. 9, 2025

Related U.S. Application Data

(63) Continuation-in-part of application No. 18/432,913, filed on Feb. 5, 2024.

(60) Provisional application No. 63/443,502, filed on Feb. 6, 2023.

(51) Int. Cl.
*B65D 88/74* (2006.01)

(52) U.S. Cl.
CPC ..... *B65D 88/74* (2013.01)

(58) Field of Classification Search
CPC ..... B65D 88/74; B65D 88/14; B65D 90/06; B65D 81/18; B65D 88/744; B65D 88/745
See application file for complete search history.

(56) References Cited

U.S. PATENT DOCUMENTS

| | | | |
|---|---|---|---|
| 2,499,736 | A | 3/1950 | Erland |
| 3,280,586 | A | 10/1966 | Toyomatsu |
| 4,171,721 | A | 10/1979 | Movick |

(Continued)

FOREIGN PATENT DOCUMENTS

| | | |
|---|---|---|
| DE | 2161288 | 6/1972 |
| DE | 102006041286 | 3/2007 |

(Continued)

OTHER PUBLICATIONS

International Preliminary Report on Patentability for PCT/IB2024/051080, dated Aug. 21, 2025, 16 pgs.

(Continued)

*Primary Examiner* — Shawn M Braden
(74) *Attorney, Agent, or Firm* — Womble Bond Dickinson (US) LLP

(57) ABSTRACT

A thermal protection module that includes a first element, a second element, a first bracket, and a second bracket. The first element includes a first shell that defines a closed first cavity. The first shell includes a base and a cap. The second element includes a second shell that defines a closed second cavity. The second shell includes a base, a cap, and two sidewalls that each extend between the base and the cap. A first sidewall of the two sidewalls that is closer to the first element meets the cap to form a divider. The divider is positioned above the cap of the first shell when the base of the first shell and the base of the second shell are disposed within the same plane. The first bracket and the second bracket maintain the gap defined between the first element and the second element along the length thereof.

18 Claims, 33 Drawing Sheets

(56) References Cited

U.S. PATENT DOCUMENTS

| | | | | |
|---|---|---|---|---|
| 4,928,501 | A | 5/1990 | Negishi | |
| 5,548,967 | A | 8/1996 | Ghiraldi | |
| 5,647,226 | A | 7/1997 | Scaringe et al. | |
| 5,934,092 | A | 8/1999 | Krompass | |
| 6,094,933 | A | 8/2000 | Forsthuber | |
| 8,790,540 | B2 * | 7/2014 | Holloway | F28F 3/02 252/70 |
| 9,435,578 | B2 | 9/2016 | Calderon et al. | |
| 9,598,221 | B2 | 3/2017 | Ros et al. | |
| 10,274,241 | B2 | 4/2019 | Ghiraldi | |
| 10,457,469 | B2 | 10/2019 | Tumber et al. | |
| 10,501,254 | B2 | 12/2019 | Wood et al. | |
| 10,508,854 | B2 | 12/2019 | Demuth et al. | |
| 10,578,370 | B2 * | 3/2020 | Rousseau | F25B 1/00 |
| 11,964,795 | B2 * | 4/2024 | Longley | F28D 20/02 |
| 12,017,845 | B2 | 6/2024 | Pherson | |
| 12,268,908 | B2 | 4/2025 | Kirmse | |
| 2004/0011509 | A1 | 1/2004 | Siu | |
| 2007/0186577 | A1 | 8/2007 | Goncharko | |
| 2007/0289976 | A1 | 12/2007 | Meyer et al. | |
| 2009/0145092 | A1 | 6/2009 | Flora | |
| 2010/0307168 | A1 | 12/2010 | Kohl et al. | |
| 2011/0067852 | A1 | 3/2011 | Farrar | |
| 2012/0072046 | A1 | 3/2012 | Tattam | |
| 2013/0026922 | A1 * | 1/2013 | Allen | F21V 7/0008 257/E33.072 |
| 2015/0068242 | A1 | 3/2015 | Patstone | |
| 2015/0143840 | A1 | 5/2015 | Ma | |
| 2015/0191291 | A1 | 7/2015 | Wood et al. | |
| 2016/0109187 | A1 | 4/2016 | Houdek et al. | |
| 2017/0013744 | A1 | 1/2017 | Shelnutt et al. | |
| 2017/0066582 | A1 | 3/2017 | Vogel et al. | |
| 2017/0096043 | A1 | 4/2017 | Lim et al. | |
| 2017/0121097 | A1 | 5/2017 | Pranadi et al. | |
| 2017/0247169 | A1 | 8/2017 | Losco | |
| 2017/0280937 | A1 | 10/2017 | Mogil et al. | |
| 2018/0057726 | A1 | 3/2018 | Chan | |
| 2020/0039687 | A1 | 2/2020 | Kuhn | |
| 2022/0081200 | A1 | 3/2022 | VanderPlas | |
| 2022/0178560 | A1 | 6/2022 | Ben Nun et al. | |
| 2022/0260324 | A1 * | 8/2022 | Akerman | B60H 1/005 |
| 2022/0290908 | A1 * | 9/2022 | Tattam | F25D 3/08 |
| 2023/0032121 | A1 | 2/2023 | Cutting | |
| 2023/0050746 | A1 * | 2/2023 | Pherson | B65D 88/74 |
| 2024/0262614 | A1 | 8/2024 | Pherson | |

FOREIGN PATENT DOCUMENTS

| | | |
|---|---|---|
| DE | 112009002332 | 6/2012 |
| EP | 1229293 | 8/2002 |
| EP | 1236960 | 9/2002 |
| FR | 887267 | 11/1943 |
| FR | 2975177 | 11/2012 |
| JP | 2018179308 | 11/2018 |
| KR | 1020220133092 | 10/2022 |
| WO | 2016033223 | 3/2016 |
| WO | 2017060695 | 4/2017 |
| WO | 2021119453 | 6/2021 |

OTHER PUBLICATIONS

International Search Report and Written Opinion for PCT/IB2025/051235, dated May 28, 2025, 54 pgs.

International Search Report for PCT/US2020/064551, dated Mar. 31, 2021, 13 pgs.

Invitation to Pay Additional Fees and, Where Applicable, Protest Fees, for PCT/IB2024/051080, dated May 7, 2024, 14 pgs.

International Search Report and Written Opinion for PCT/IB2024/051080, dated Jun. 28, 2024, 22 pgs.

* cited by examiner

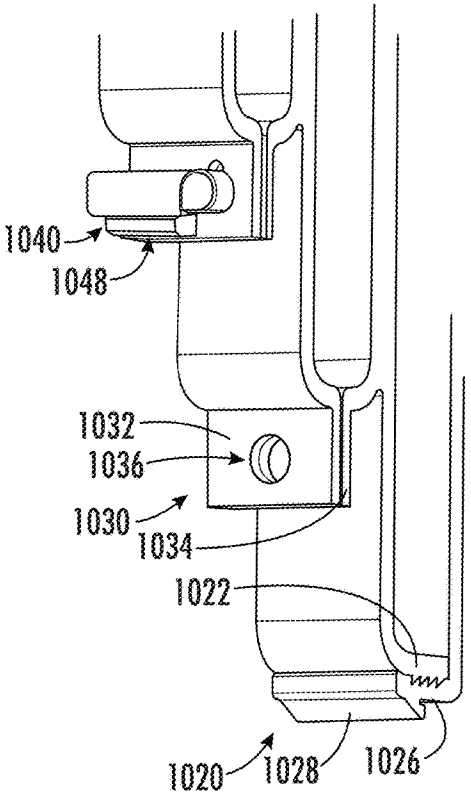
FIG. 35
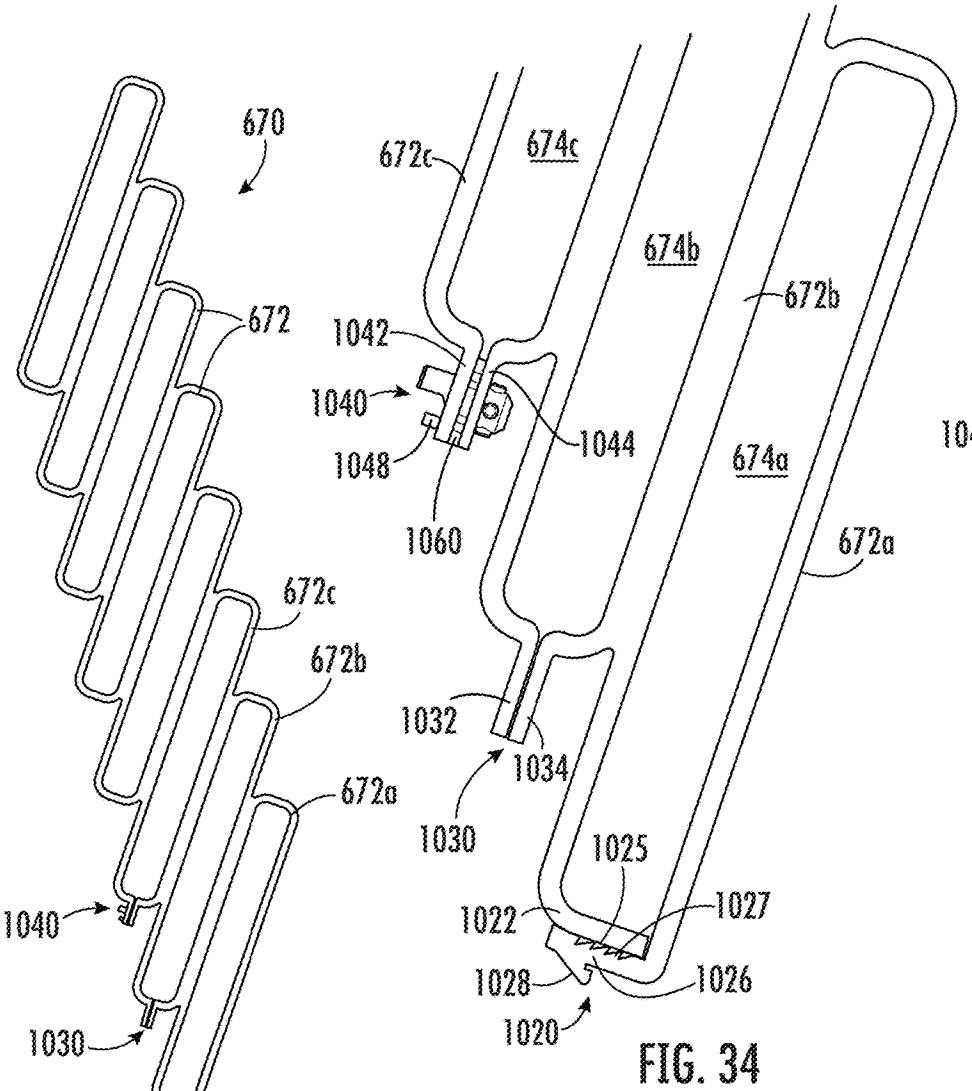
FIG. 34
FIG. 33

HIGH-SURFACE AREA THERMAL PROTECTION MODULES FOR CARGO CONTAINERS AND CARGO CONTAINERS INCLUDING THE SAME

CROSS-REFERENCE TO RELATED APPLICATIONS

This application is a continuation-in-part of U.S. patent application Ser. No. 18/432,913, filed Feb. 5, 2024, which claims benefit of, and priority to, U.S. Provisional Patent Application Ser. No. 63/443,502, filed Feb. 6, 2023. The entire contents of each of the above applications are hereby incorporated by reference.

BACKGROUND

1. Technical Field

The present disclosure relates to cargo containers and, more specifically, to high-surface area thermal protection modules for use in cargo containers to maintain a temperature therein.

2. Discussion of Related Art

Air cargo is typically transported in a cargo container generally referred to as Unit Load Device ("ULD"), which is stowed in a cargo hold of an aircraft, which can either be below and/or above the deck, e.g., below the deck in a passenger aircraft or below and above the deck in transport aircraft. The outer size and shape of ULDs vary depending upon the type of aircraft such that the outer dimensions of the ULDs are determined by the type of aircraft. Typically, and regardless of the shape or geometry of the container, one end or side of the ULD is open for loading and unloading cargo. Various door closures can be used for opening and closing the open ends of the ULDs. The unloaded weight of the ULD is significant as even a slight reduction in the unloaded weight of the ULD will result in substantial savings in the cost of fuel to transport the ULD over its life. In addition, a reduction in the unloaded weight of the ULD will allow for an increased weight capacity for cargo.

Transporting perishable air cargo may require a ULD to be insulated and/or refrigerated. Some perishable air cargo may require an interior of a ULD to be maintained below a specific temperature or within a specific temperature range. In some applications, the temperature range may be small, e.g., within ±5 degrees Celsius. A ULD may include insulation either in the walls or disposed on the inside of the ULD such that the interior of the ULD is insulated. During the transport of perishable cargo, a ULD may include active or passive cooling therein to maintain a temperature within a desired temperature range.

In some embodiments, a temperature within a ULD may spike due to a high temperature variance or other external factors such as direct sunlight, wind, precipitation, etc. While the active or passive cooling within a cargo container may be capable of bringing the temperature back within a desired range, the thermal transfer may be too slow to prevent the temperature within the cargo container from briefly being outside the desired range.

SUMMARY

This disclosure relates generally to thermal protection modules for an interior of air cargo containers that have increased thermal transfer to maintain low delta temperature environments. For example, the thermal protection modules detailed herein may be suitable for maintaining a temperature within an interior of a cargo container within a ±5 degrees Celsius temperature range. The thermal protection modules detailed herein may have increased surface area and/or hollow fins that bring a cooling medium closer to the surface to increase thermal transfer into and out of the thermal protection module. In some embodiments, the thermal protection modules may include internal fins to increase thermal transfer into and out of the cooling medium. Increased thermal transfer into and out of the thermal protection modules may prevent temperature spikes within a cargo container when subjected to an external environment with a large temperature disparity or when exposed to other external factors such as direct sunlight, wind, precipitation, etc.

In an aspect of the present disclosure, a thermal protection module includes a plurality of heat transfer elements and a medium. Each heat transfer element defines an element cavity. Each heat transfer element defines a gap with an adjacent heat transfer element. The medium is disposed within each element cavity such that the medium is disposed within each transfer element on either side of the gap. The thermal protection module has a heat flux per unit of area in a range of 2 Watts per meter squared to 10 Watts per meter squared in free convection with a 4 degree Kelvin temperature differential.

In aspects, the element cavity of each heat transfer element is separately sealed.

In some aspects, the thermal protection module includes a plurality of brackets with each bracket including a plurality of braces. Each heat transfer element is received within a respective bracket position the heat transfer element relative to the other heat transfer elements. The plurality of braces are orientated such that the plurality of heat transfer elements form a rectangular array of elements. The plurality of braces may be oriented such that the plurality of braces extend at a non-perpendicular angle relative to a vertical plane to which the bracket is configured to be secured. The non-perpendicular angle may be in a range of 30 degrees to 60 degrees. Each brace may include a locking device that is configured to selectively open the brace to allow removal or insertion of a heat transfer element from within the brace.

In certain aspects, the plurality of brackets are disposed along the length of the thermal protection module and configured to position the heat transfer elements relative to one another. Each bracket may be configured to support between 8 and 12 heat transfer elements in width. The plurality of brackets may be configured to support the thermal protection module on a ceiling or a wall of a container.

In particular aspects, the thermal protection module includes a manifold that defines a reservoir. The reservoir may be in fluid communication with the element cavity of each heat transfer element. The manifold may be positioned at the end of each heat transfer element and may be formed separate from the heat transfer elements. The manifold may be positioned along a length of each heat transfer element and is monolithically formed with the plurality of heat transfer elements.

In aspects, the thermal protection module includes a plurality of internal fins that each extend from adjacent heat transfer elements and are aligned with the gap between the adjacent heat transfer elements. Each internal fin extends into the reservoir and is configured to transfer thermal energy into or out of the medium within the reservoir.

In some aspects, each heat transfer element is formed of a shell having a constant profile configured to maximize a surface area of the heat transfer element per unit of length thereof. The constant profile may be substantially rectangular shaped, tadpole shaped, S-shaped, or convoluted shaped.

In certain aspects, the thermal protection module includes a sight glass that allows for visualization of the medium within the thermal protection module to visually determine a state of the medium. The medium may be a phase-change material. The thermal protection module may be configured to operate in a low delta temperature environment to maintain a temperature within a five degree Celsius range.

In another aspect of the present disclosure, a thermal protection module is configured to operate in a low delta temperature environment includes a first heat transfer element, a second heat transfer element, a first bracket, and a second bracket. The first heat transfer element has a first shell that has a constant profile along a length thereof. The first shell defines a first cavity that is filled with a medium. The second heat transfer element has a second shell that has a constant profile along a length thereof. The second shell defines a second cavity that is filled with a medium. The first bracket receives a first end portion of the first heat transfer element and a first end portion of the second heat transfer element. The second bracket is spaced apart from the first bracket and receives a second end portion of the first heat transfer element and a second end portion of the second heat transfer element such that a gap is defined between the first heat transfer element and the second heat transfer element along the length thereof.

In aspects, the first cavity of the first heat transfer element is sealed separate from the second cavity of the second heat transfer element.

In some aspects, the thermal protection module includes an endcap that is disposed over the first end portions of the first and second heat transfer elements. The endcap may be configured to protect the first end portions. The endcap may be colored or otherwise labeled to provide visual indicia of a transition temperature of a medium disposed within the thermal protection module.

In certain aspects, the first bracket is received within the endcap. The thermal protection module may include a hanger that is received between the first bracket and the endcap. The hanger may be configured to secure the thermal protection module relative to a ceiling or a wall of a cargo container.

In particular aspects, the thermal protection module includes a manifold and a manifold endcap. The manifold has a first end and a second end that define a reservoir therebetween. The first end portions of the first heat transfer element and the second heat transfer element are secured to the second end of the manifold such that the first cavity and the second cavity are each in fluid communication with the reservoir. The manifold endcap seals the first end of the manifold. The first bracket may form the second end of the manifold. The first bracket and the second bracket may support the first heat transfer element and the second heat transfer element relative to one another in a substantially rectangular array with one another.

In another aspect of the present disclosure, a thermal protection module that is configured to operate in a low delta temperature environment includes a body that has a constant profile define a length thereof and endcaps positioned on each end of the body to seal the reservoir and the element cavities. The constant profile includes a heat transfer portion, sidewalls, and an upper surface. The heat transfer portion has a plurality of heat transfer element that each define an element cavity and a gap with an adjacent heat transfer element. The sidewalls extend from and are integrally formed with the heat transfer portion. The upper surface interconnects the sidewalls to form a reservoir between the upper surface and the heat transfer portion. The reservoir is in fluid communication with each element cavity.

In aspects, the heat transfer portion includes a plurality of internal fins. Each internal fin may extend from adjacent heat transfer elements into the reservoir towards the upper surface. Each heat transfer element may extend in a perpendicular direction from the upper surface or may extend in a non-perpendicular direction from the upper surface.

In some aspects, the profile may include a recessed surface that is positioned between the upper surface and the heat transfer portion, the recessed surface may be parallel to and forming a channel in the upper surface. The channel may define expansion pockets of the reservoir. The thermal protection module may include a support spacer that is secured to the upper surface and a top section of at least two heat transfer elements. The support spacer may maintain a space between at least two heat transfer elements.

In another aspect of the present disclosure, a cargo container includes a first sidewall, a second side all opposite the first sidewall, a back wall that extends between the first and second sidewalls, an opening defined between the first sidewall and the second sidewall opposite the back wall, a closure that is configured to selectively close the opening, a ceiling disposed above and supported by the walls such that an interior of the cargo container is defined. The cargo container includes a first thermal protection module that is secured to the ceiling with the heat transfer elements of the first thermal protection module forming a rectangular array of elements. The cargo container also includes a second thermal protection module that is secured to the first sidewall with the heat transfer elements of the second thermal protection module extending at a non-perpendicular angle relative to the first sidewall. The first and second thermal protection modules may be any of the thermal protection modules described herein. The first and second thermal protection modules may be configured to maintain a temperature of the interior within a five degree Celsius range when the cargo container is exposed to an ambient environment.

In another aspect of the present disclosure, a method of manufacturing a thermal protection module includes extruding a heat transfer element, cutting the heat transfer element to a desired length, and filling the heat transfer element with a medium such that the medium is disposed on either side of a gap disposed between the heat transfer element and another heat transfer element. The thermal protection module has a heat flux per unit of area in a range of 2 Watts per meter squared to 10 Watts per meter squared in free convection with a 4 degree Kelvin temperature differential.

In another aspect of the present disclosure, a bracket for supporting a plurality of thermal protection modules includes a plurality of braces. Each brace is configured to receive a portion of a thermal protection module to support the thermal protection module in an array of thermal protection modules. Each brace has a locking device that has a closed state in which the thermal protection module is secured within the respective brace and an open state in which the thermal protection module can be removed or inserted into the brace.

In aspects, the locking device may include a first leg and a second leg that are selectively secured to one another in the closed state. The first leg may include a first rack of teeth and the second leg includes a second rack of teeth that opposes the first rack of teeth. The first rack of teeth is in the closed state to prevent the first leg from moving away from the second leg. The first leg and the second leg may each define a securement hole that passes therethrough. The securement hole may be configured to receive a closure to maintain the locking device in the closed state. The locking device may include a closure that has a locking lever and a shaft that extends from one end of the locking lever. The shaft may be configured to pass through the securement hole. The shaft may include one or more nubs that is configured to retain the second leg relative to the first leg when the locking lever is disposed against the first leg. The locking device may include a retaining ring that is disposed between the first leg and the second leg. The retaining ring may be engaged with the shaft to retain the shaft in the securement hole when the first leg is separated from the second leg in an open state of the locking device.

In another aspect of the present disclosure, a thermal protection module includes a plurality of heat transfer elements and a medium. Each heat transfer element defines an element cavity. Each heat transfer element defines a gap with an adjacent heat transfer element. The medium is disposed within each element cavity such that the medium is disposed within each transfer element on either side of the gap. The thermal protection module has a heat transfer coefficient in a range of 50 Watts/($m^2$·° K) to 150 Watts/($m^2$·° K).

In yet another aspect of the present disclosure, a method of manufacturing a thermal protection module includes extruding a heat transfer element, cutting the heat transfer element to a desired length, and filling the heat transfer element with a medium such that the medium is disposed on either side of a gap disposed between the heat transfer element and another heat transfer element. The thermal protection module has a heat transfer coefficient in a range of 50 Watts/($m^2$·° K) to 150 Watts/($m^2$·° K).

In still another aspect of the present disclosure, a thermal protection module includes a body and endcap. The body defines a reservoir and includes a mounting portion and a heat transfer portion. The mounting portion defines an expansion pocket in fluid communication with the reservoir. The heat transfer portion extends from the mounting portion with the reservoir defined between the heat transfer portion and the mounting portion. The heat transfer portion includes a plurality of fins with each fin defining a fin cavity in fluid communication with the reservoir. Each fin defines a fin trough with an adjacent fin that is in fluid communication with atmosphere exterior of the body. The end cap is secured to the body to fluidly seal the reservoir.

In aspects, each fin includes an internal fin projection into the reservoir to increase an internal surface area of the heat transfer portion. The mounting portion may include an upper surface and a recessed surface. The recessed surface projection into the reservoir from the upper surface. The expansion pocket defined between the recessed surface and the upper surface. The recessed surface may define a fill line for a thermal medium disposed within the reservoir.

In some aspects, the body is of unitary construction. The body may include a first sidewall and a second sidewall that is opposite the first sidewall. The first and second sidewall may extend between the mounting portion and the heat transfer portion. The sidewall may space the heat transfer portion from the mounting portion. The endcap may define a fill port. The fill port may be in fluid communication with the reservoir to seclusively fill the reservoir with a thermal medium or to drain the thermal medium therefrom.

In another aspect of the present disclosure, a thermal protection module that is configured to operate in a low delta temperature environment includes a first heat transfer element, a second heat transfer element, a first bracket, and the second bracket. The first heat transfer element includes a first shell that has a constant profile along the length thereof. The first shell defines a closed first cavity that is filled with the medium. The first shell includes a base, a cap, and two sidewalls that each extend between the base and the cap. The first heat transfer element defines the side edge of the thermal protection module. The second heat transfer element includes a second shell that has a constant profile along the length thereof. The second shell defines a closed second cavity that is filled with the medium. The second shell includes a base, a cap, and two sidewalls that each extend between the base and the cap. A first sidewall of the two sidewalls that is closer to the first heat transfer element meets the cap to form a divider. The divider is positioned above the cap of the first shell when the base of the first shell and the base of the second shell are disposed within the same plane. The second heat transfer element is adjacent to the first heat transfer element such that a gap is defined between the first heat transfer element and the second heat transfer element. The first bracket receives a first end portion of the first heat transfer element and a first end portion of the second heat transfer element. The second bracket is spaced apart from the first bracket and receives a second end portion of the first heat transfer element in the second end portion of the second heat transfer elements such that the gap is defined between the first heat transfer element and the second heat transfer element along the length thereof.

In aspects, the first cavity of the first heat transfer element is sealed separate from the second cavity of the second heat transfer element. The thermal protection module may include a third heat transfer element, a fourth heat transfer element, and a fifth heat transfer element. The third heat transfer element includes a shell that has a constant profile along the length thereof. The third shell defines a closed third cavity that is filled with the medium. The third shell has a base, a cap, and two sidewalls that each extend between the base and the cap. The third heat transfer element has a midline that is aligned with the midline of the thermal protection module. The second heat transfer element is positioned between the first heat transfer element and the third heat transfer element. The fourth heat transfer element has the same profile as the first heat transfer element and is mirrored about the midline of the thermal protection module with respect to the first heat transfer element. The fifth heat transfer element has the same profile of the second heat transfer element and is mirrored about the midline of the thermal protection module with respect to the second heat element. The fifth heat transfer element is positioned between the third heat transfer element and the fourth heat transfer element. The fourth heat transfer element may be spaced apart from the fifth heat transfer element such that a gap is defined therebetween.

In some aspects, a first sidewall of the first thermal protection module includes a first section of increased surface area to increase a surface area or bending stiffness of the sidewall compared to a straight sidewall. The first sidewall of the second thermal protection module opposes the first sidewall of the first protection module and includes the second section of increased surface area to increase the surface area or bending stiffness of the second sidewall compared to a straight sidewall. The profile of the first section may follow the profile of the second section such that the gap has a constant width between the first heat transfer element and the second heat transfer element.

In certain aspects, the thermal protection module includes eleven heat transfer elements comprising the first and second heat transfer elements. The eleven heat transfer elements may have five pairs of heat transfer elements that had the same profile as one another and that are mirrored about a midline of the thermal protection module from one another. The first bracket and the second bracket may support the first heat transfer element and the second heat transfer element relative to one another in a substantially rectangular array with an arched top surface.

In another aspect of the present disclosure, a cargo container includes a first sidewall, a second sidewall, a back wall, an opening, a closure, the ceiling, and the first thermal protection module as detailed herein secured to the ceiling. The second sidewall is opposite the first sidewall and the back wall extends between the first sidewall and the second sidewall. The opening is defined between the first sidewall and the second sidewall opposite the back wall. The closure is configured to selectively close the opening. The opening is disposed above and supported by the first sidewall, the second sidewall, and the back wall. The first sidewall, the second sidewall, the back wall, and the closure define an interior of the cargo container. The first thermal protection module includes heat transfer elements that form a substantially rectangular array of elements with an arched top surface.

In another aspect of the present disclosure, the thermal protection module includes a plurality of heat transfer elements and a medium. Each heat transfer element defines an element cavity. Each heat transfer element of the plurality of heat transfer elements defines a gap within adjacent heat transfer element. The medium is disposed within each element cavity such that the medium is sealed within each heat transfer element on either side of the gap. The thermal protection module has a dome top surface such that air is guided into the gap between adjacent heat transfer elements.

In aspects, the elements cavity of each heat transfer element is separately sealed. Each heat transfer element may be formed of a shell that has a constant profile and is configured to maximize the surface area of the heat transfer element per unit of length thereof.

In some aspects the thermal protection module include the site glass that allows for visualization of the medium within the thermal protection module to visually determine a phase state of the medium. The medium may be a phase change material. The thermal prepacked protection module may be configured to operate in a low delta temperature environment to maintain the temperature within a 5 degree Celsius range. The medium may be tuned for an application of the thermal protection module.

In another aspect of the present disclosure, a cargo container includes a first sidewall, a second sidewall that is opposite the first sidewall, a back wall that extends between the first sidewall and the second sidewall, an opening that is defined between the first sidewall and the second sidewall opposite the back wall, a closure that is configured to selectively close the opening, and the ceiling that is disposed above and supported by the first sidewall, the second sidewall, and the back wall. The first sidewall, the second sidewall, the back wall, and the closure define an interior of the cargo container. The cargo container also includes a first thermal protection module that is secured to the ceiling. The first thermal protection module may be any of the thermal protection modules described herein. Heat transfer elements of the first thermal protection module form a substantially rectangular array of elements with an arched top surface.

In aspects, the first thermal with action module is configured to maintain a temperature of the interior within a five degree Celsius range for a period of time when the cargo container is exposed to an ambient environment. The cargo container may include a second thermal protection module that is secured to the ceiling. The second thermal protection module may be any of the thermal protection modules described herein. The second thermal protection module is disposed in a parallel manner to the first thermal protection module and is spaced apart laterally from the first thermal protection module such that the space in a range of 0.5 times to 4 times the width of each thermal protection module is defined between the first thermal protection module and the second thermal protection module.

In another aspect of the present disclosure of thermal protection module includes a plurality of heat transfer elements and a medium. Each heat transfer element of the plurality of heat transfer elements defines an element cavity. Each heat transfer element of the plurality of heat transfer elements defines the gap within adjacent heat transfer element. The medium is disposed within each element cavity such that the medium is sealed within each heat transfer element on either side of the gap. The thermal protection module has a first configuration in which sidewalls of the thermal protection module are configured to have a negative slope from an interior of the container toward the wall of the container to which the thermal protection module is mounted such that the thermal protection module is a cooling module. The thermal protection module has a second configuration in which the sidewalls of the thermal protection module are configured to have a positive slope from an interior of the container towards the wall of the container to which the thermal protection module is mounted such that the thermal protection module is a warming module.

In aspects, the plurality of heat transfer elements include a director that is configured to be adjacent the wall of the container to direct air downwards in the first configuration and upwards in the second configuration to increase convection within the container.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein:

FIG. 33 is a profile view of a bracket including locking devices provided in accordance with the present disclosure;

FIG. 34 is an enlargement of a portion of the bracket of FIG. 33;

FIG. 35 is a perspective view of the portion of the bracket of FIG. 34;

DETAILED DESCRIPTION

Figure 1:
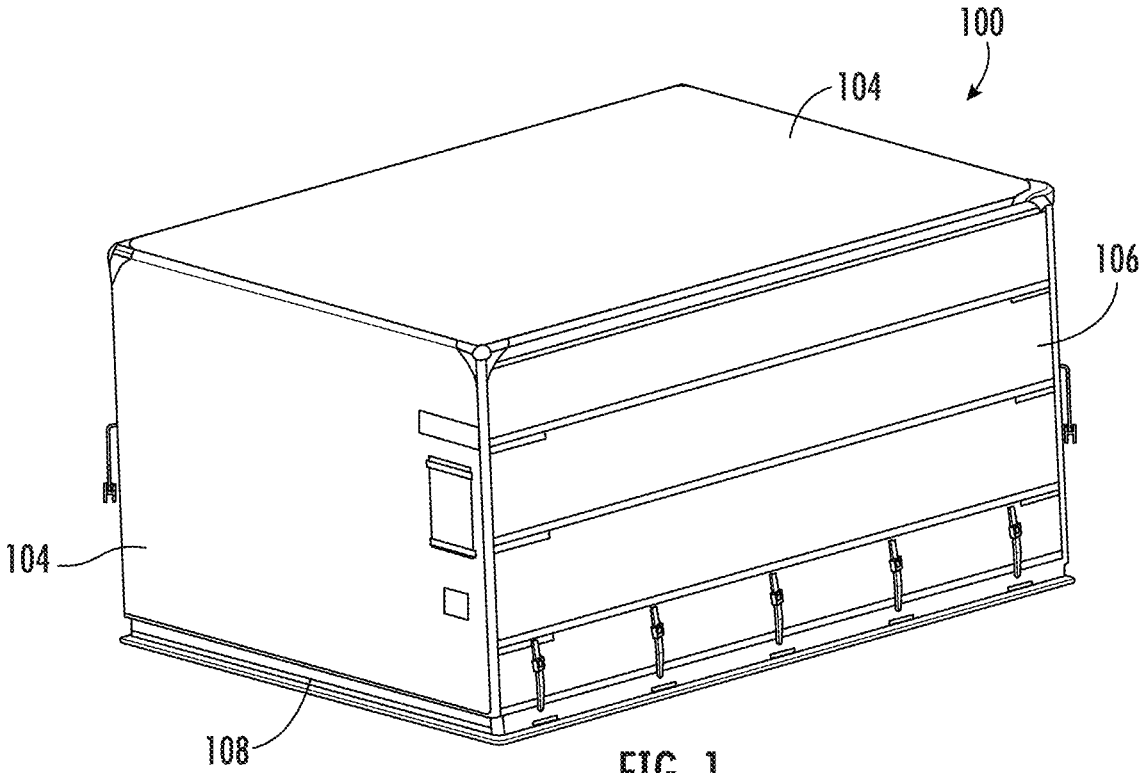
FIG. 1 is a perspective view of a cargo container according to an embodiment of the present disclosure.
Figure 2:
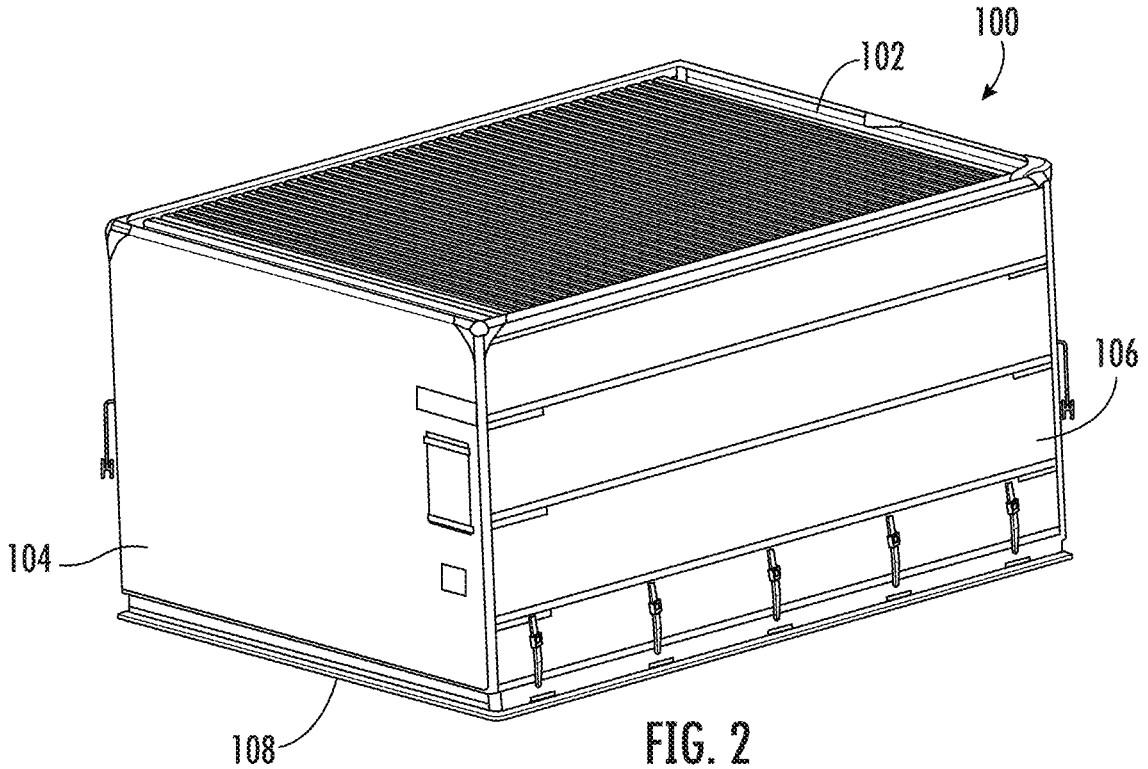
FIG. 2 is a perspective view of the cargo container of FIG. 1 with a top panel of the cargo container removed.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa.

The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships, or the like, unless otherwise stated, any one or more if not all of these may be absolute or approximate to account for acceptable variations that may occur, such as those due to manufacturing or engineering tolerances or the like.

As used in the description and the appended claims, the phrases "unit load device" (ULD) or "air cargo container," is defined as cargo containers used to load luggage, freight, mail, and the like on aircraft including wide-body aircraft and narrow-body aircraft. While the cargo containers described herein are directed to ULDs or cargo containers for use with aircraft, it is contemplated that cargo containers including the disclosed thermal protection modules may be used in other transportation vehicles such as trucks, trailers, ships, or trains such that the described use with aircraft should not be seen as limiting. In addition, while the thermal protection modules described herein are described for use with cargo containers, it is contemplated that the thermal protection modules may be used in any enclosure to regulate a temperature therewithin. Further, the thermal protection modules detailed herein may be used for transport containers of varying sizes. For example, the thermal protection modules detailed herein could be used for transportation of perishable food such as pizza, ice cream, pre-packaged meals, or other perishable food items that can be transported by hand, bicycle, or vehicle. In addition, the thermal protection modules detailed herein may be used in freezers, refrigerators, or ovens or other appliances to maintain a temperature within a desired temperature range during use. In some embodiments, the thermal protection modules may be used to insulate walls of a building or other enclosed space to maintain a temperature therein.

The temperature of cargo within a cargo container designed with thermal insulation properties in mind may extend how long cargo is able to maintain a desired internal temperature. The desired internal temperature may be above or below an ambient temperature. Specifically, above or below the ambient temperature while an aircraft idles on the ground waiting to take off, during flight, and during loading or unloading of the aircraft.

When a cargo container is exposed to an ambient environment, other factors may increase a temperature differential between an interior of the cargo container and the ambient environment. For example, the cargo container may be exposed to the sun which may increase a temperature within the interior of the cargo container.

A thermally insulated cargo container may be loaded with materials in insulative containers. When such a thermally insulated cargo container is exposed to an ambient environment, the air in the interior of the cargo container may quickly increase in temperature as the specific heat of air is low. The quick increase in temperature of air within the cargo container may then increase a temperature of cargo within the cargo container such that the cargo is damaged or perishes. The thermal protection modules disclosed herein may be used for the transport of perishable cargo such as meat, fish, vegetables, pharmaceuticals, chemicals, and other materials that must stay within a certain temperature range or under a temperature threshold.

This disclosure is directed to thermal protection modules for cargo containers with increased thermal transfer or heat flux to maintain a temperature within a cargo container within a temperature range. The increased thermal transfer may allow the temperature to be maintained within a small temperature range. The increased thermal transfer may allow for the temperature range to be maintained when there is a low delta temperature between the desired temperature and the current temperature, e.g., within 3, 4, or 5 degrees Celsius. The thermal protection modules detailed herein are heat exchangers that are for use in low delta temperature environments. However, while the thermal protection modules detailed herein may be designed for low delta temperature environments, the thermal protection modules detailed herein may also be used in high delta temperature environments to rapidly release or absorb thermal energy from the thermal protection modules. This is different from common heat exchangers with fins that are used with electronics that include solid fins that extend from a mounting plate in contact with a chip or surface to be cooled. These heat exchangers are used to transfer heat from the chip or surface to an ambient air and rely on a high delta temperature between the chip and the environment. In addition, many heat exchangers in an electronic environment are used in conjunction with fans to increase convection across the surface of the heat exchangers. While the heat exchangers disclosed herein may be used in conjunction with fans to increase convection across the surface thereof, the heat exchangers disclosed herein may be designed to function with gravity convection or free convection within the cargo container and within the heat exchanger caused by a temperature difference within a cooling medium in the heat exchanger and air within the cargo container. The thermal protection modules disclosed herein may be used with a cargo container including low level of insulation, e.g., R5 to R10, or may be used with a cargo container including a high level of insulation, e.g., R30 to R50. The thermal protection modules detailed herein may maintain a desired temperature in cargo container including a low level of insulation with a lower weight and/or cost than using a cargo container with a high level of insulation.

The thermal protection modules detailed below are described for use with a cooling medium for maintaining a temperature below an ambient temperature. However, it is within the scope of this disclosure that the thermal protection modules may be used with a heating or warming medium for maintaining a temperature above an ambient temperature. For example, a warming medium may have a transition temperature of 205 degrees Fahrenheit and be heated to a temperature of 210 degrees Fahrenheit in liquid form. The warming medium may then release latent heat of fusion until the heating medium is frozen at 205 degrees to maintain an interior of a container at a temperature above 200 degrees Fahrenheit.

Referring now to FIGS. 1-4, an example air cargo container or ULD is provided in accordance with the present disclosure and is referred to generally as container 100. As shown, the container 100 is a ULD for use below a deck of an aircraft. The container 100 may be designed to load luggage, freight, or mail in an aircraft. In this regard, the cargo container 100 may have other shapes for a position within a given aircraft or for a type of a given aircraft. The container 100 may include a frame 102 presenting a generally rectangular shape with an offset designed to more closely follow the outline of the aircraft. The container 100 may further include a cargo opening defined by a portion of the frame 102. The frame 102 may be formed from any substantially rigid material, such as aluminum, steel, composites, temperature resistant plastics, other metals, or other non-metals.

The frame 102 may support a plurality of panels 104 forming the walls and the roof of the container 100. The container 100 may include a floor or a base 108 that allows the container 100 to be lifted by lifting equipment such as a forklift. In some embodiments, the panels 104 may be constructed together such that a separate frame, e.g., frame 102, may be eliminated. The panels 104 may be lightweight, thermal insulating, and/or have high strength characteristics. The cargo opening may be substantially sealed, and selectively closed, by a door 106. The door 106 may be a rigid door or may be a flexible door or curtain. When the door 106 is a rigid door, the door 106 may have similar construction to any of the panels. Alternatively, the door 106 may be insulated in another manner allowing the door 106 to be flexible. For additional detail on flexible insulated doors or curtains for use with a ULD. In addition, the frame 102, the panels 104, and/or the door 106 may be fire resistant.

Figure 3:
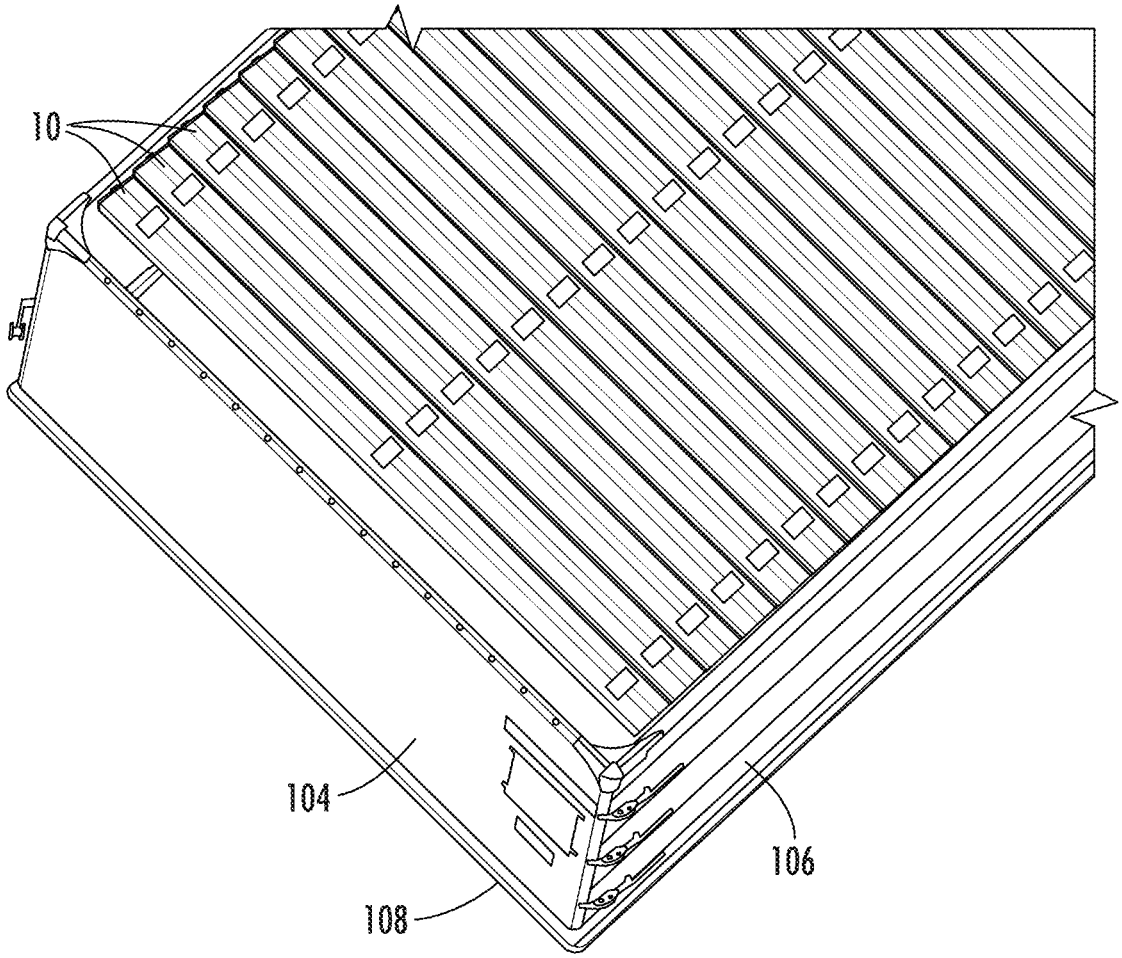
FIG. 3 is a top, perspective view of the cargo container of FIG. 2 illustrating a plurality of thermal protection modules secured to the roof of the cargo container.
Figure 4:
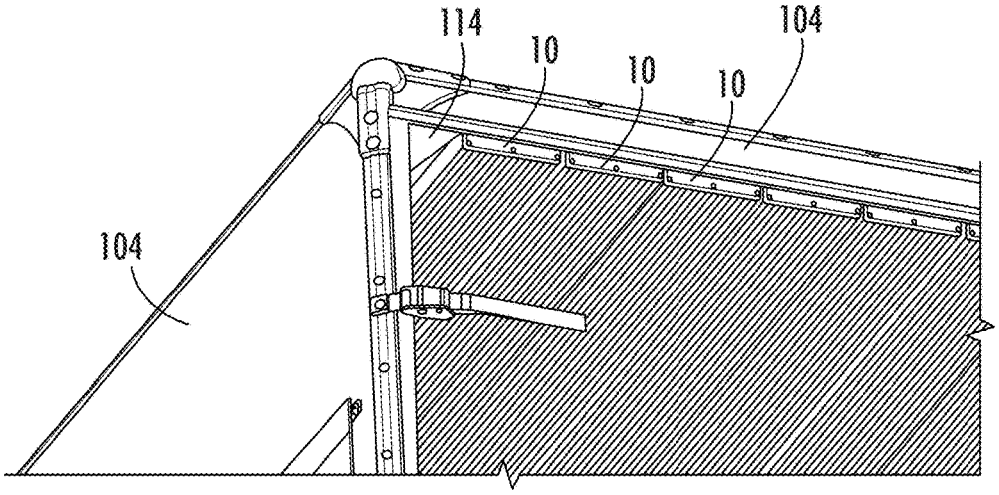
FIG. 4 is a partial, lower, perspective view of the cargo container of FIG. 1 with the closure removed.
Figure 5:
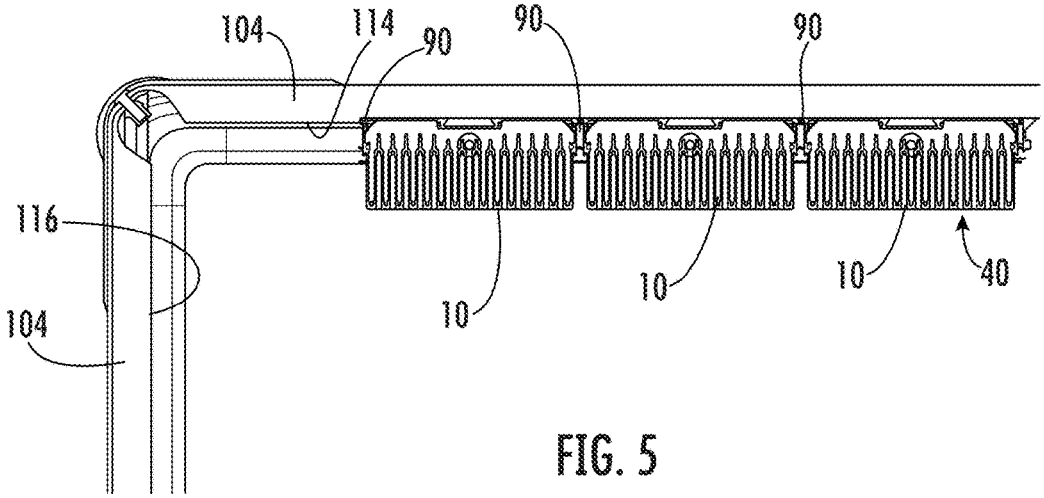
FIG. 5 is a front view of the cargo container of FIG. 4 with endcaps of the thermal protection modules removed.

Referring now to FIGS. 3 and 4, the thermal protection modules 10 are secured to an interior of a cargo container 100. As shown, the thermal protection modules 10 may be secured to a ceiling 114 and/or walls 116 within a cavity 110. The thermal protection modules 10 may be secured to the ceiling 114 and/or walls 116 with the hangers 90. The hangers 90 are secured to the side panels 30 of one or two thermal protection modules and to rails of the cargo container 100. The thermal protection modules 10 may be removed from the cargo container 100. Each thermal protection module 10 may include multiple hangers 90 secured to each side panel 30 of the thermal protection module 10. For example, the thermal protection module 10 may include a hanger 90 every 10 or 20 centimeters of length. In certain embodiments, the hangers 90 may be secured directly to the ceiling 114 of the cargo container 100.

With reference to FIGS. 5-10, a thermal protection module for a cargo container is disclosed in accordance with embodiments of the present disclosure and is referred to generally as thermal protection module 10. The thermal protection module 10 includes a body 20 and endcaps 50 that define a reservoir or cavity 60 within the body 20. The body 20 includes a mounting portion 21, side panels 30, and a fin or heat transfer portion 40. The body 20 may be formed as an extrusion of a single material having a good or high thermal conductivity, e.g., aluminum having a thermal conductivity in a range of 220 to 240 Watts/($m^{2\cdot\circ}$ K). A good thermal conductivity may be a material having a thermal conductivity greater than 10 Watts/($m^{2\cdot\circ}$ K) and a high thermal conductivity may be a material having a thermal conductivity greater than 200 Watts/($m^{2\cdot\circ}$ K). The material of the body 20 may be chosen for its weight, strength, thermal conductivity, or cost. In some embodiments, the body 20 is formed as an extrusion of multiple materials that form a monolithic or unitary body. For example, the mounting portion 21 and/or the side panels 30 may be formed of a different material than the heat transfer portion 40. In certain embodiments, the mounting portion 21 and/or the side panels 30 may be formed of an insulative material or a material with a low thermal conductivity, e.g., thermal conductivity less than 1 Watts/($m^{2\cdot\circ}$ K). The body 20 may have walls with a constant or varying thickness in a range of 0.5 millimeter to 2 millimeters, e.g., 1 millimeter to 1.5 millimeters. For example, the mounting portion 21 and/or the side panels 30 may be joined to the heat transfer portion 40 by welding, bonding, or adhering. In some embodiments, the heat transfer portion 40 may be formed of a low thermal conductivity material. In some embodiments, where a material such as aluminum is used to form the heat transfer portion 40 the walls of the body 20 may have thickness in a range of 0.5 millimeter to 2 millimeters in thickness and where a material such as a plastic, e.g., a high-density polyethylene (HDPE), the walls of the body 20 may have a thickness in a range of 2 to 4 millimeters. As discussed below, the heat flux of the plastic body may be similar to the heat flux of an aluminum body in free convection; however, if forced convection the aluminum body may outperform the plastic body.

The mounting portion 21 includes an upper surface 22 that is broken by a recessed surface 24 that sits slightly below the upper surface 22. The recessed surface 24 defines a channel 26 with the upper surface 22. The channel 26 may define expansion pockets 62 in a top section of the cavity 60 as described in detail below.

The side panels 30 extend downward from opposite ends of the upper surface 22. The top and the bottom of the side panels 30 may define mounting notches 32 that receive a hanger 90 that secures the thermal protection module 10 to a wall or ceiling of a cargo container.

The fin portion 40 extends downward from the side panels 30 and defines a plurality of heat transfer elements or fins 42 that extend below the side panels 30. Each fin 42 defines a fin cavity 64 that is in fluid communication with the rest of the cavity 60 and defines a fin trough 46 between adjacent fins 42. The fin cavities 64 allow the cooling medium within the cavity 60 to flow into the fins 42 to increase heat transfer from the cooling medium to an environment around the thermal protection module 10. The fins 42 may have a total thickness or width in a range of 3 millimeters to 5 millimeters with the fin cavity 64 having a thickness in a range of 1 millimeter to 2 millimeters, e.g., 1.2 millimeters. The fin troughs 46 may have a thickness in a range of 1 millimeter to 2 millimeters, e.g., 1.2 millimeters. The walls of the fin portion 40 may be optimized to provide the maximum surface area per unit of weight with the thickness of the walls in a range of 0.3 millimeter to 3 millimeters.

The fins 42 of the fin portion 40 may increase a surface area of the body 20. An increase in surface area of the body 20 increase a heat transfer capability of the body 20. As shown, the fin portion 40 includes 20 fins 42 that are substantially the same as one another. In embodiments, the fin portion 40 may include more or less than 20 fins 42. In some embodiments, one or more of the fins 42 may be different from the other fins 42. In certain embodiments, the fins 42 may increase a total surface area of the body 20 from a rectangular body in a range of 15 times to 25 times. For example, in one particular embodiment, a rectangular body having the same overall dimensions as a body 20 may have an area of 21 square centimeters per linear centimeter compared to a body 20 that may have an area of 350 square centimeters per linear centimeter.

Figure 6:
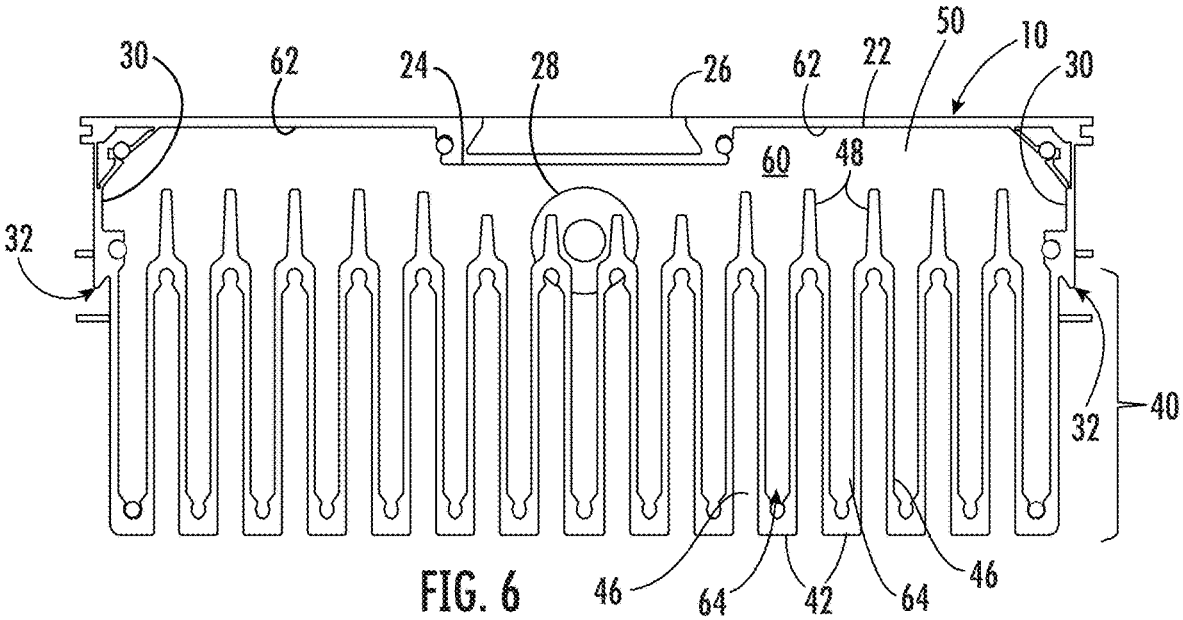
FIG. 6 is an enlarged view of one of the thermal protection modules of FIG. 5.
Figure 7:
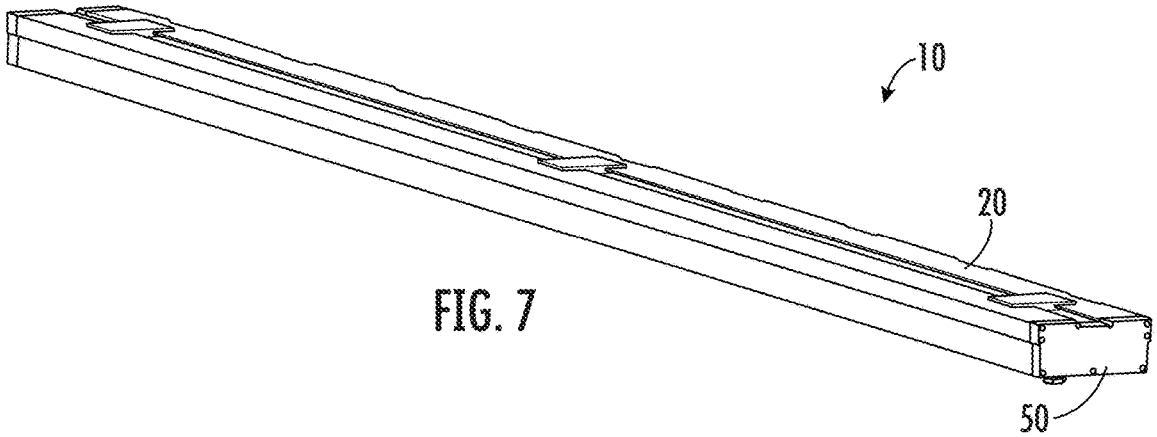
FIG. 7 is a perspective view of a thermal protection module provided in accordance with the present disclosure.
Figure 8:
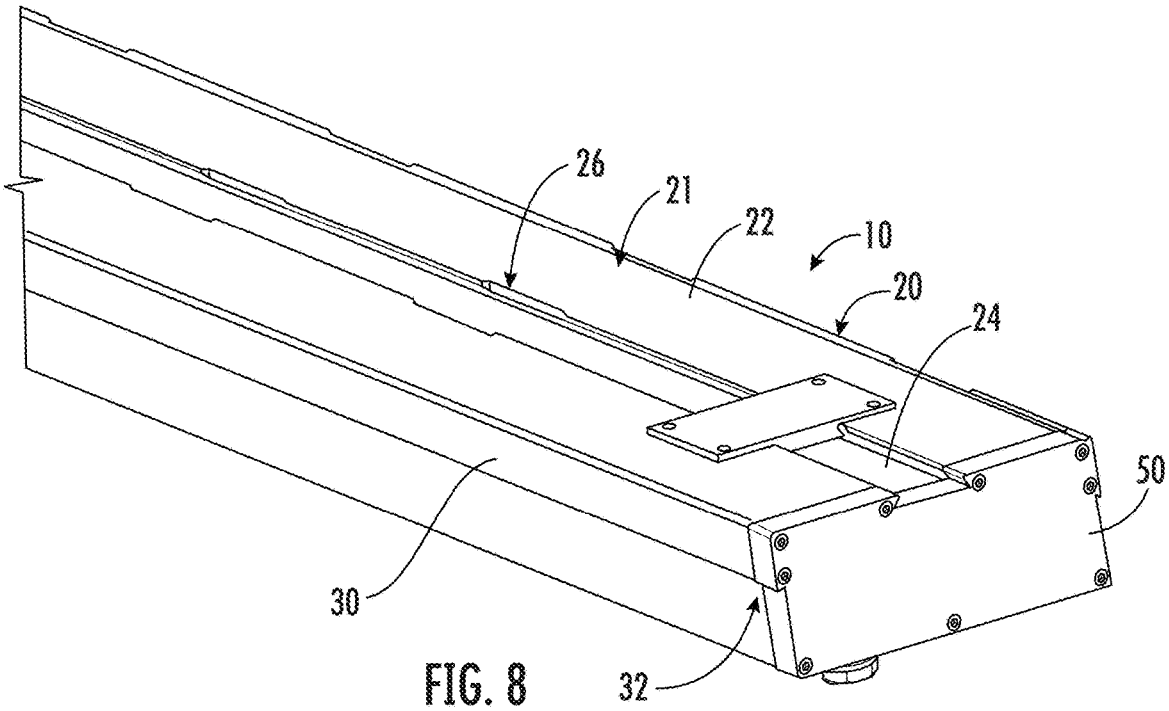
FIG. 8 is an enlarged view of an end portion of the thermal protection module of FIG. 7.

With particular reference to FIG. 6, the fin portion 40 may include internal fins 48 that extend from the top of a fin trough 46 towards the upper surface 22. The internal fins 48 may enhance heat transfer from cooling medium in the cavity into the fins 42. For example, heat transfer within the cooling medium may be slow such that cooling medium in the fin cavities 64 may have a temperature different from cooling medium within the cavity 60 adjacent the upper surface 22. The internal fins 48 may conduct heat into and out of the cooling medium disposed within the cavity 60. The internal fins 48 may reduce an amount of time to transfer heat into or out of the thermal protection module 10.

Referring now to FIGS. 7-10, the endcaps 50 are disposed at the ends of the thermal protection module 10 to seal the cavity 60. The endcaps 50 may be sized to be received within the cavity 60. For example, the endcaps 50 may have fin seals that are received in the fin cavities 64 to seal the fin cavities 64 and a main seal that is received between the side panels 30 of the body 20. In some embodiments, the endcaps 50 may be partially received within the cavity 60 and seal an end of the cavity 60. In such embodiments, the portions of the endcaps 50 received within the cavity 60 may position the endcap 50 relative to the body 20. In certain embodiments, the endcaps 50 may abut the end of the body 20 and seal the cavity 60. The endcaps 50 may be formed of rubber, metal, or combinations thereof. For example, the endcaps 50 may be formed of aluminum or other metal and include a rubber gasket or seal that is compressed to seal the cavity 60. In some embodiments, the endcaps 50 are bonded, adhered, and/or mechanically secured to the body 20 to seal the respective end of the thermal protection module 10.

The thermal protection module 10 includes a fill port 28. As shown in FIG. 6, the fill port 28 may be disposed in an endcap 50. The fill port 28 is in fluid communication with the cavity 60 such that the fill port 28 allows for the filling of the cavity 60 with a thermal medium. The fill port 28 may allow for selective opening and closing or sealing of the cavity 60. The fill port 28 may be used to add or remove a cooling medium or air from the cavity 60 of the thermal protection module 10. As discussed below, the thermal medium is a cooling medium. However, in some embodiments, the thermal medium may be a heating material configured to increase a temperature within the cargo container or to maintain a temperature above a temperature threshold. In certain embodiments, the channel 26 may include the fill port that is in fluid communication with cavity 60. The fill port may sit within the channel 26 below the upper surface 22. The fill port may be aligned in an endcap 50 such that the endcap 50 seals a hole in the upper surface 22 and includes a passage to allow the fill port to be used to fill the cavity 60.

Figure 9:
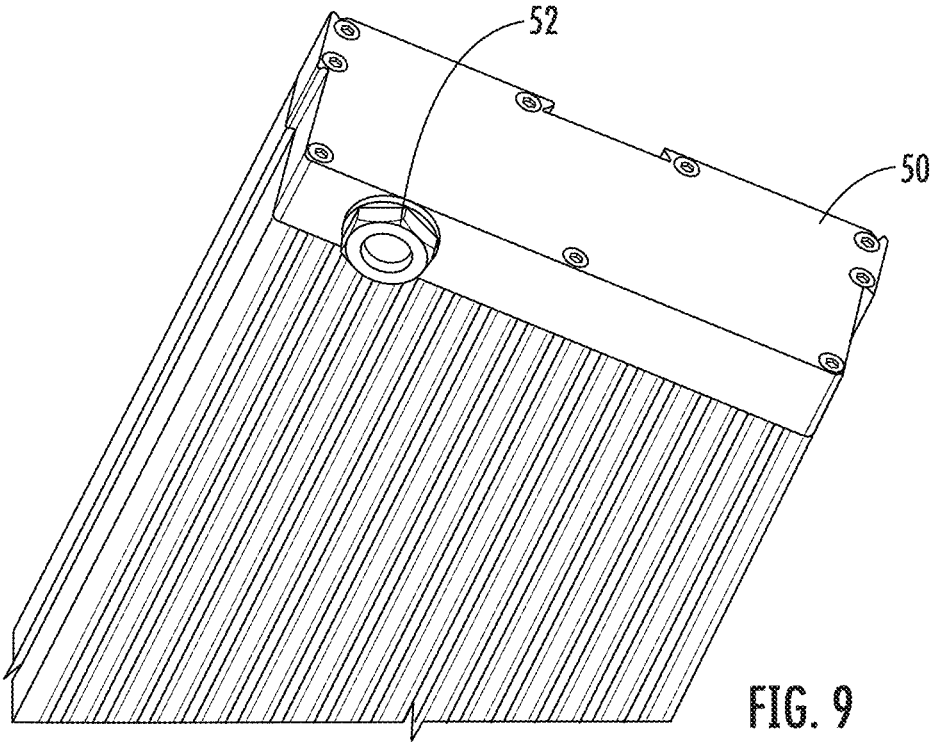
FIG. 9 is a bottom perspective view of the end portion of FIG. 8.
Figure 10:
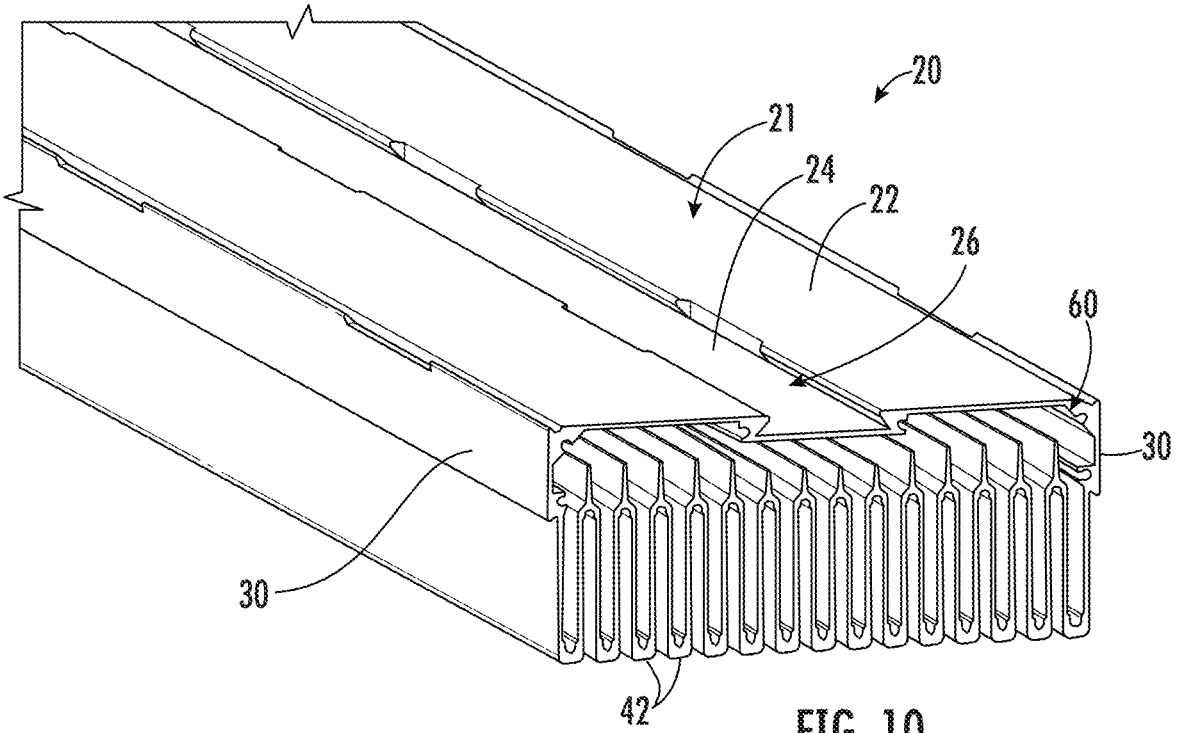
FIG. 10 is a perspective view of a body of the thermal protection module of FIG. 8.

With particular reference to FIG. 9, one or both of the endcaps 50 may include a sight glass 52. The sight glass 52 provides visual access into the cavity 60 of the thermal protection module 10. By looking through the sight glass 52, a user may be able to determine a charge state of a cooling medium disposed within the cavity 60. In some embodiments, when a cooling medium is in a liquid state, the cooling medium may be transparent and when the cooling medium is in a solid state the cooling medium may be opaque. Thus, by looking through the sight glass, if a user can see through the cooling medium, the cooling medium is not charged and if a user cannot see through the cooling medium, the cooling medium is charged.

The cooling medium disposed within the cavity 60 may be a phase-change material (PCM) having a phase change temperature tuned to a desired temperature of products being transported in the cargo container 100. As noted above, while the term cooling medium is used herein, the PCM may be a heating medium that is liquified to charge and freezes to release heat. The PCM can include water and a wide variety of organic or inorganic material (solid, liquid, or gaseous materials) that can absorb or release energy at selected temperatures. In some embodiments, the PCM may be paraffin based. In certain embodiments, the PCM may be salt based. The PCMs detailed herein are examples of possible PCM but should not be seen as limiting as a PCM may be chosen based on a temperature at which the PCM changes phase and the heat capacity of the PCM. The PCM can melt, boil, or otherwise change phases in a range of −100° C. to 100° C. In some embodiments, the PCM may change phases at a temperature below −100° C. or at a temperature above 100° C. The thermal protection modules 10 can be "charged" by heating or cooling to freeze, solidify, liquefy, melt, gasify, or otherwise change the phase of the PCM, and thereafter, the thermal protection modules 10 can provide cooling or heating within the interior of the cargo container 100 to maintain the cargo container 100 within a desired temperature range, below a desired temperature, or above a desired temperature.

As noted above, the cavity 60 may include expansion pockets 62 adjacent the upper surface 22 of the thermal protection module 10. The expansion pockets 62 may provide space for expansion and contraction of the PCM within the cavity 60 as the PCM is charged and discharged.

The thermal protection modules 10 have an increased surface area compared to thermal protection modules used in cargo containers. In addition, the thermal protection modules 10 may be formed of a thermally conductive material, e.g., aluminum, to increase thermal transfer into and out of the thermal protection modules 10 when forced convection is present, e.g., for charging or when a fan or other means of forced convection is present. The thermal protection modules 10 may be semi-permanently fastened to the interior of the top or walls of a cargo container to stabilize the temperature within a relatively close range to the melting point of a thermal medium within the thermal protection module 10, e.g., a PCM. The high surface area of the thermal protection modules 10 may allow for rapid freezing or charging when placed in a reduced temperature cold storage area. In this case, a cargo container including the thermal protection modules 10 can be moved into the storage area for several hours to charge (or change phase in the case of PCM) before loading and the thermal protection modules 10 such that the thermal protection modules 10 will charge before loading. Simply put, the container including the thermal protection modules 10 can be left open in a cold room such that the thermal protection modules 10 within the container will charge while the container waits to be loaded.

Figure 11:
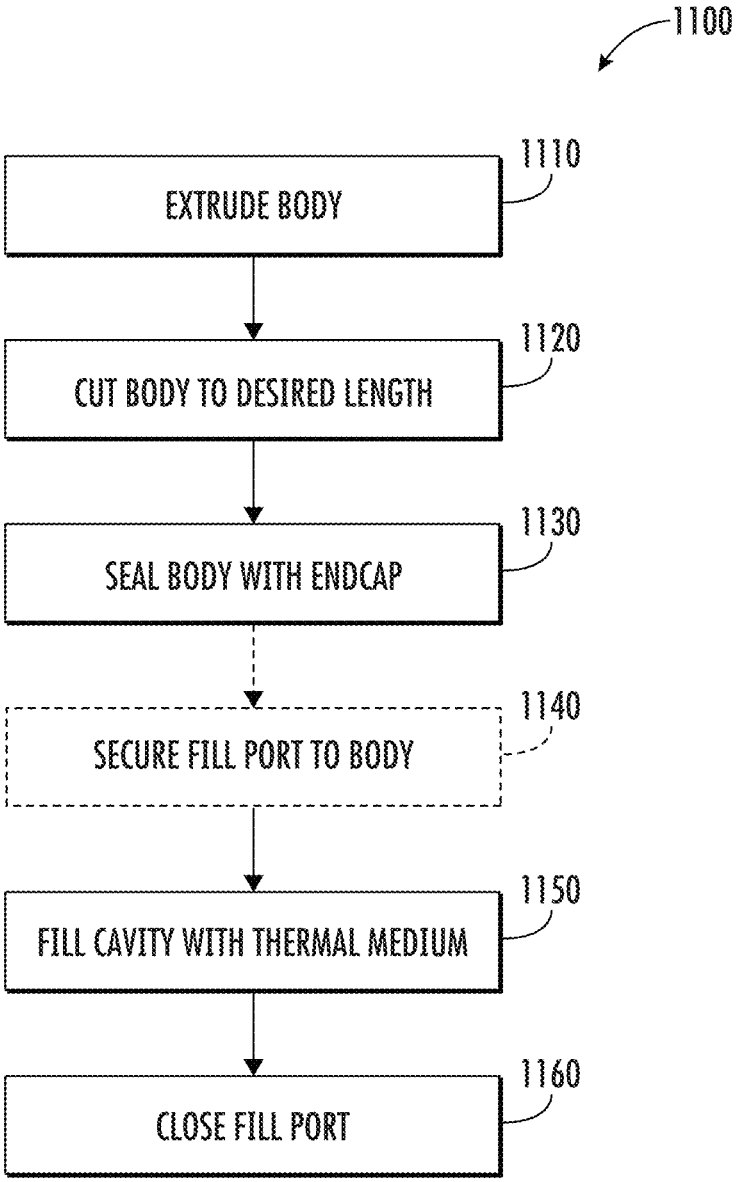
FIG. 11 is a flow chart of a method for manufacturing a thermal protection module provided in accordance with the present disclosure.

With reference to FIG. 11, a method of manufacturing a PCM thermal protection module 1100 is disclosed in accordance with the present disclosure with reference to the thermal protection module 10 and cargo container 100 of FIGS. 1-10. The body 20 of the thermal protection module 10 is formed by extruding the body 20 by forcing a material through a die (Step 1110). The body 20 may be formed of a single material or may be formed of multiple materials that form a unitary or monolithic body. As detailed above, the mounting portion 21 and/or the side panels 30 may be formed of a low thermal conductivity material and the side panels 30 and/or the heat transfer portion 40 may be formed of a high thermal conductivity material. When the body 20 is formed of multiple materials, each material may be forced through a respective die and joined with the other material(s) in another die to form a unitary or monolith body. In some embodiments, when the body 20 is formed of multiple materials, the individual materials are extruded and then joined by bonding, welding, or other suitable means.

With the body 20 formed, the extrusion of the body 20 is cut to a desired length (Step 1120). The ends of the body 20 are then sealed with a respective endcap 50 (Step 1130). Sealing the ends of the body 20 may include inserting at least a portion of the respective endcap 50 in the cavity 110 of the body 20. The endcaps 50 may be adhered, bonded, welded, or mechanically secured to the ends of the body 20 to seal the ends of the body 20. In some embodiments, the endcaps 50 may be mechanically secured to the ends of the body 20 by one or more fasteners passing through the body 20 and into the respective endcap 50. The endcap 50 may be formed of rubber or silicone and have dimensions slightly larger than the cavity 110 such that the material seals the cavity 110. In embodiments, the endcaps 50 are bonded or adhered within the cavity 110 to seal the cavity 110. To minimize weight and improve thermal performance, the walls of the body 20 may be as thin as practical. In some embodiments, limitations of an aluminum extrusion process may require the walls of the body 20 to be 1 mm thick. In certain embodiments, the walls of the body 20 may be less than 1 mm thick.

In some embodiments, the fill port 28 is secured to the mounting portion 21 in fluid communication with the cavity 110 (Step 1140). Securing the fill port 28 may include creating an opening through recessed surface 24. The opening may be positioned inboard of the endcap 50 such that the fill port 28 is in direct fluid communication with the cavity 110. In some embodiments, the opening may be positioned over the endcap 50 and in fluid communication with the cavity 110 through a passage defined through the endcap 50. The fill port 28 may be secured to the mounting portion 21 such that the fill port 28 is disposed within the channel 26 of the mounting portion 21 at or below the upper surface 22.

With the fill port 28 secured to the mounting portion 21 and the cavity 110 sealed by the endcaps 50, the cavity 110 is filled with a cooling medium (Step 1150). The cooling medium may be a PCM that is tuned to have a phase transition temperature at a desired temperature. The cavity 110 may be filled to the recessed surface 24. When the cavity 110 is filled to the recessed surface 24, the expansion pockets 112 may allow for expansion of the cooling medium as a phase of the cooling medium changes. When the cavity 110 is filled, the fill port 28 is closed to seal the cavity 110 (Step 1160). The fill port 28 may be self-closing or sealing or may include a cap that seals and closes the fill port 28.

Figure 12:
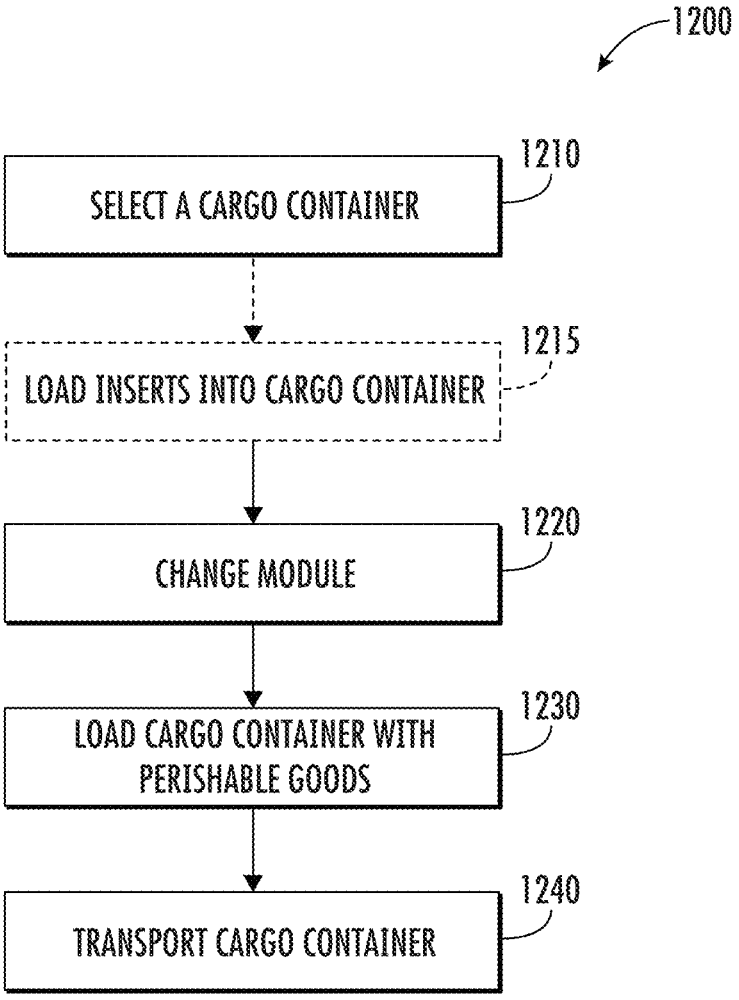
FIG. 12 is a flow chart of a method of charging a thermal protection module provided in accordance with the present disclosure.

Referring now to FIG. 12, a method of loading a cargo container with perishable material 1200 is disclosed in accordance with the present disclosure and with reference to the thermal protection module 10 and cargo container 100 of FIGS. 1-10. The method may be used to transport perishable goods and may have a low equipment cost, a lower operating cost, a low weight, a high case of use, and/or an acceptable temperature range for the perishable cargo.

The cargo container 100 may be selected as an insulated or non-insulated cargo container (Step 1210). The cargo container 100 may include thermal protection modules 10 installed therein or the cargo container 100 may be loaded with thermal protection modules 10 (Step 1215).

The method 1200 includes charging the thermal protection modules 10 (Step 1220). The thermal protection modules 10 may be charged when installed in the cargo container 100 or may be charged outside of the cargo container 100 and then loaded into the cargo container 100. As detailed above, the thermal protection modules 10 are configured to quickly transfer heat to an ambient environment surrounding the thermal protection modules 10 which also allows the thermal protection modules 10 to be charged at a faster rate than traditional PCM modules. For example, traditional PCM modules formed of a low-conductivity plastic material that may require several hours to days. An example of a traditional PCM module is disclosed in U.S. Patent Publication No. 2023/0050746. In contrast, the thermal protection modules 10 may be charged in several hours whether formed of a material having a low thermal conductivity or a material having a high thermal conductivity due to the increase in surface area over traditional PCM modules. In some embodiments, a cargo container 100 loaded with thermal protection modules 10 is placed in a cold room or chamber for several hours before being loaded with the perishable cargo in the cold room. The thermal protection modules 10 may be charged in a range of 4 hours to 16 hours, which can coincide with normal storage and loading time periods. In certain embodiments where there is forced convection in a refrigerator or bath, the thermal protection modules 10 formed of a highly conductive material may charge in two hours or less. This short charge time may allow for charging without special/additional handling of the container or removal of the thermal protection modules which may result in significant savings of logistics time and handling.

When the thermal protection modules 10 are installed in the cargo container 100 and are charged, the cargo container 100 may be loaded with a perishable goods (Step 1230). The cargo container 100 may be loaded in the same cold room as the thermal protection modules 10 are charged. Once the cargo container 100 is loaded, the cargo container 100 may be transported (Step 1240). The method 1200 may allow for the charging of thermal protection modules 10 of the cargo container 100 without additional labor of removing and reinstalling cooling thermal protection modules.

The cargo containers detailed herein may have a low equipment cost. For example, a standard R10 cargo container may be modified with installation brackets to secure the thermal protection modules for approximately $200 USD. The cost of extraction and fabrication of each thermal protection module may be $600 USD and require 8 kilograms of PCM at a cost of $64.00 USD. As such, the total additional cost for a cargo container would be $13,480 USD for twenty thermal protection modules. It is understood that this cost may change as material and labor costs change.

The cargo containers have a low and/or improved operating cost as the thermal protection modules may be charged within the cargo container while the cargo container is waiting to be loaded in cold storage. In addition, the thermal protection modules have a low weight that is equivalent to other solutions. For example, each thermal protection module may be 17.6 kilograms loaded with a total weight of 352 kilograms for 20 thermal protection modules. Further, as the thermal protection modules do not need to be removed from the containers, if there is an increase in weight, the increase in weight may be offset by a decrease in labor to load and unload the thermal protection modules. As the thermal protection modules have a similar total weight to other solutions, there may be no or a low increase in fuel cost for transport. As detailed above, the case of use of the cargo containers is greater than other solutions with the thermal protection modules remaining in the cargo container and the charging of the cargo containers occurring in the same cold storage facility where loading occurs.

Figure 13:
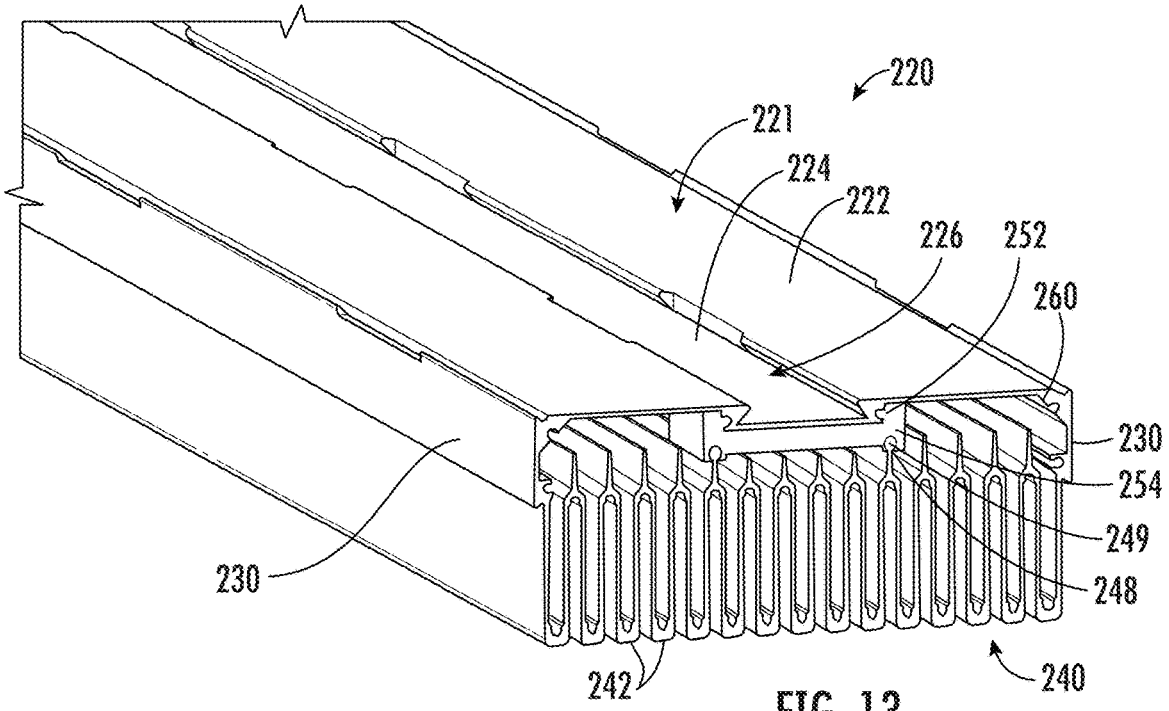
FIG. 13 is a perspective view of a portion of another body of a thermal protection module provided in accordance with the present disclosure including support spacers.
Figure 14:
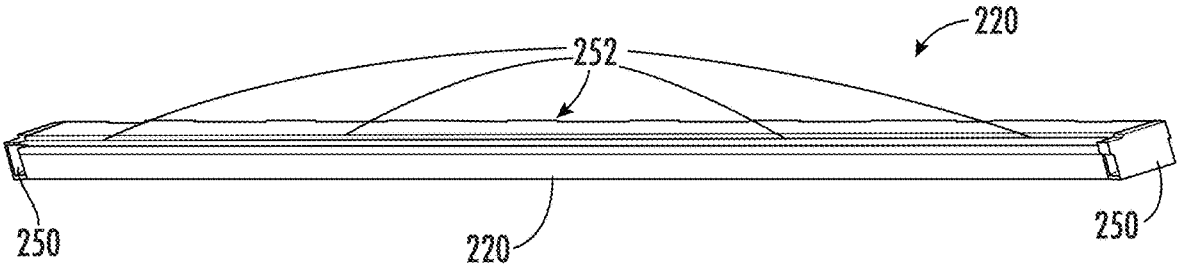
FIG. 14 is a perspective view of the body of FIG. 13.

With reference now to FIGS. 13 and 14, another body 220 is provided in accordance with the present disclosure. The body 220 may be used with the thermal protection module 10 as a substitute for the body 20 with like features including a similar label with an additional "2" leading the label of the body 20 with only the differences detailed herein for brevity. The body 220 includes internal fins 248 having a securement portion 249. The body 220 may have a support spacer 252 mounted within the cavity 260. The support spacer 252 includes support mounts 254 that secure to the securement portions 249 to secure the support spacer 252 within the cavity 260. The securement portions 249 may be round or barrel shaped features at the end portion of the internal fins 248 and the support mounts 254 may be shaped to receive the securement portions 249. In some embodiments, the securement portions 249 may receive the support mounts 254. The support spacer 252 may include mounting tabs 256 that are received in complementary slots defined in the recessed surface 224 of the body 220 to secure the support spacer 252 to the mounting portion 221 of the body 220.

The support spacer 252 may support the fins 242 to maintain a space between the fins 242 and increase the integrity of the fin portion 240. For example, the high folded length of the extruded fins coupled with thin extrusion walls may flex or deflect when filled with a cooling medium. The support spacers 252 may reduce or prevent the flex or deflection of the fin portion 240. The support spacers 252 may support the fin portion 240 along the entire length of the body 220 to resist g-loading caused by flight or ground transportation. The support spacers 252 may allow internal fluid to circulate through the entire body allowing for the use of a single fill port 28. In some embodiments, a single support spacer 252 is used along the entire length of the body 220 and multiple fill ports 28 may be used to fill the cavity 260 which would be formed by multiple sealed cavities.

With particular reference to FIG. 14, the body 220 may include multiple support spacers 252 disposed along the length of the body 220. For example, a support spacer 252 may be disposed every six to twenty-four inches along the length of the body 220.

Figure 15:
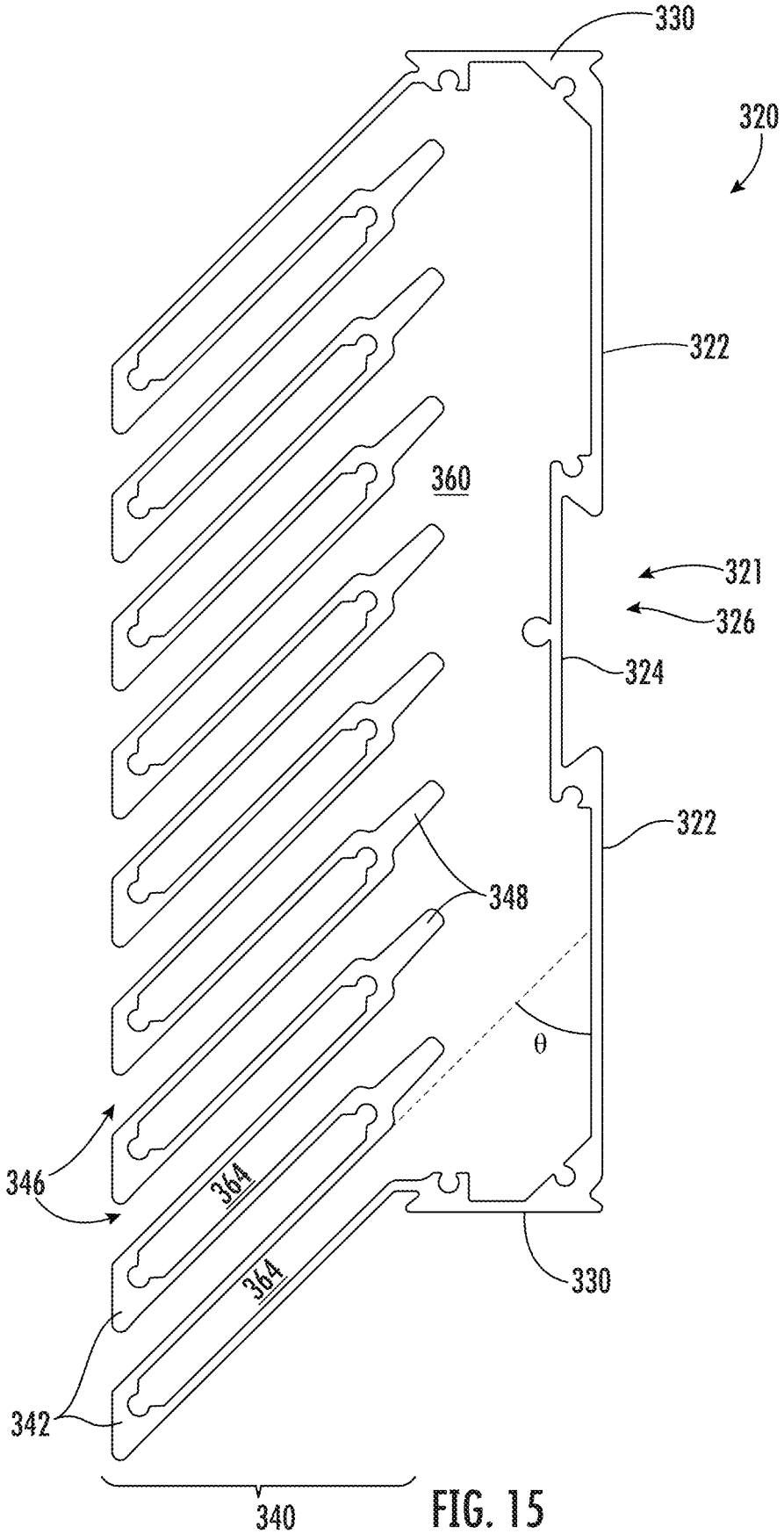
FIG. 15 is a profile view of another thermal protection module provided in accordance with the present disclosure.

With reference now to FIG. 15, another body 320 is provided in accordance with the present disclosure. The body 320 may be used with the thermal protection module 10 as a substitute for the body 20 with like features including a similar label with an additional "3" leading the label of the body 20 with only the differences detailed herein for brevity. The body 320 may be configured for mounting to walls of a cargo container. For example, the fins 342 may be extend at a non-perpendicular angle, i.e., 90 degrees, from the top surface 322. Extending the fins 342 at an angle less than 90 degrees may increase convection, e.g., gravitational convection, across the surfaces of the fins 342. Specifically, the fins 342 extend at an angle θ from the top surface 322. As shown, the angle θ is 45 degrees; however, the angle θ may be in a range of 15 degrees to 75 degrees, e.g., 15, 30, 45, 60, or 75 degrees. In some embodiments, the angle θ may be greater than 90 degrees and be in a range of 105 degrees to 165 degrees, e.g., 105, 120, 135, 150, or 165 degrees. For example, the angle θ may be greater than 90 degrees when the thermal protection module is configured to maintain a temperature within the cargo container above an ambient temperature. It will be appreciated, that endcaps for the body 320 would have a shape similar to the profile of the body 320 such that the endcaps would form a seal with the extruded body 320.

Figure 16:
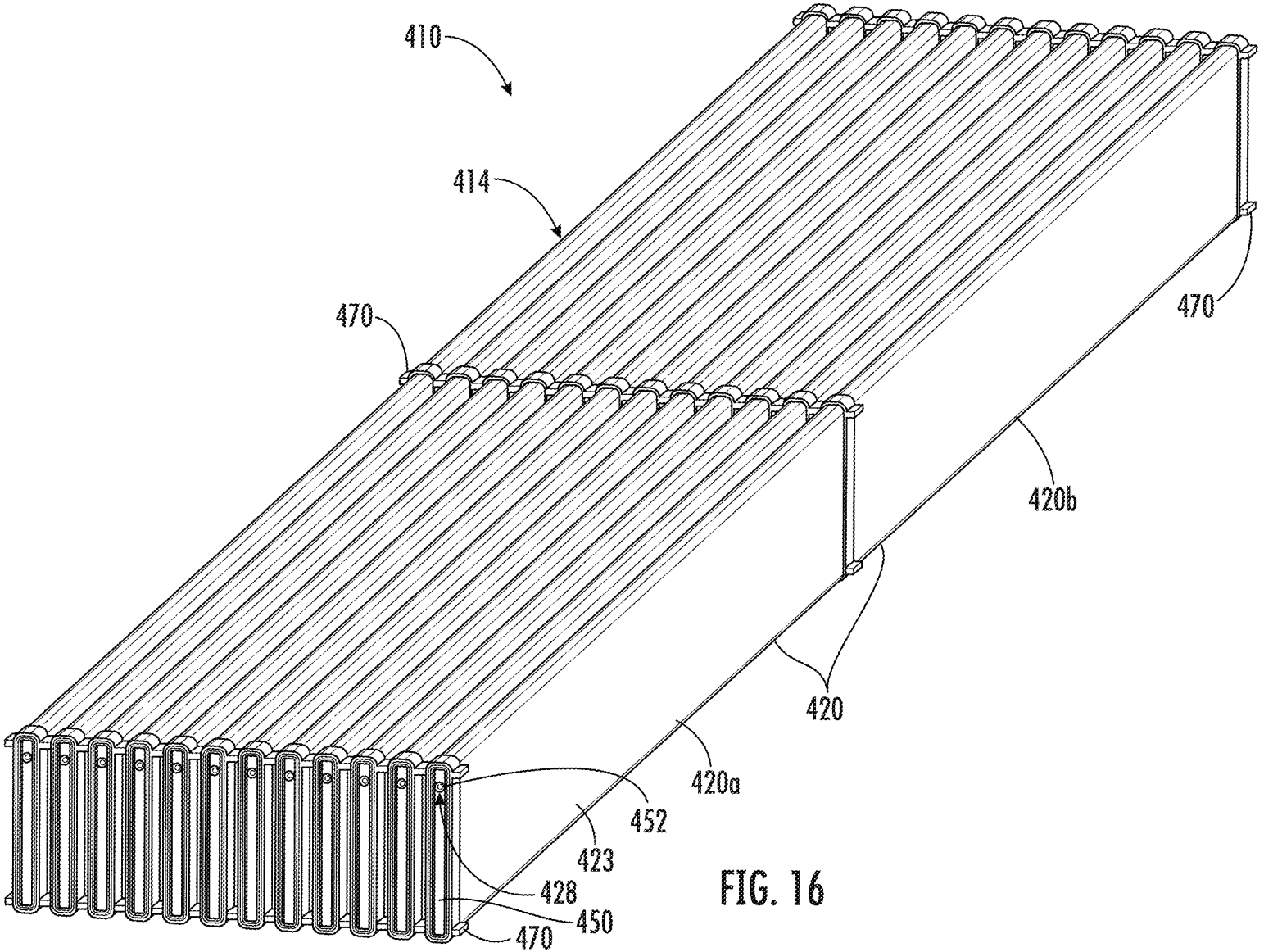
FIG. 16 is a perspective view of another thermal protection module provided in accordance with the present disclosure.
Figure 18:
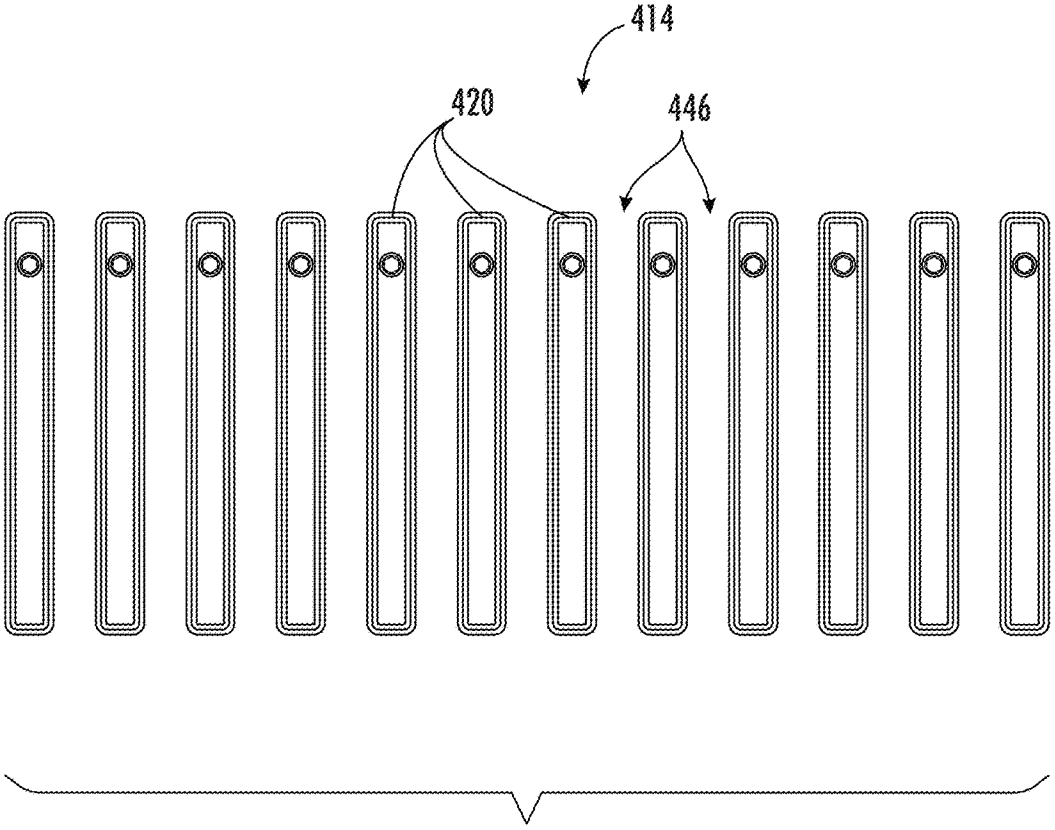
FIG. 18 is a profile view of an array of bodies of the thermal protection module of FIG. 16.
Figure 17:
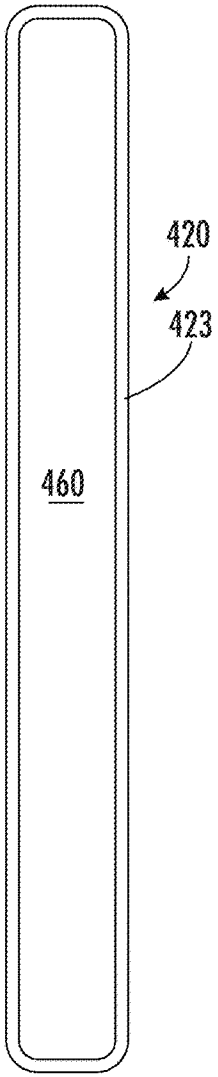
FIG. 17 is a profile view of a body of the thermal protection module of FIG. 16.

Referring now to FIGS. 16-18, another thermal protection module 410 is provided in accordance with the present disclosure. The thermal protection module 410 is an assembly of a plurality of individual elements or bodies 420 that are held together with one or more brackets 470 to form an array of the bodies 414. Each of the bodies 420 may be filled with a cooling medium such that the thermal protection module 410 has a high surface area and can maintain a temperature in a low delta T environment. As shown, the thermal protection module 410 includes a plurality of heat transfer elements or bodies 420 that are spaced apart from one another such that air may pass between the bodies 420. The plurality of bodies 420 may function as a heat transfer portion of the thermal protection module 410 in a similar manner to the heat transfer or fin portion 40 of the thermal protection module 10. In use, the thermal protection module 410 may be mounted to a ceiling or a wall of a cargo container in a manner similar to the thermal protection modules 10, 210, 310 detailed above. In some embodiments, the thermal protection module 410 may be spaced apart from the ceiling or the wall of the container such that air between the ceiling or the wall of the container may have a convection current through and around the thermal protection module 410. The convection current may improve thermal transfer into or out of the thermal protection module 410. The spacing of the thermal protection module 410 from the ceiling or the wall of the container may be in a range of 0.5 inches to 2 inches, e.g., 1 inch.

With particular refence to FIG. 16, the array of bodies 414 is a 1×12 array of bodies 420 with each body 420 extending the entire length of the thermal protection module 410. The brackets 470 disposed between the bodies 420 maintain a position of the bodies 420 relative to one another in the array of bodies 414 and maintain the gaps 446 between the bodies 420. In certain embodiments, the array of bodies 414 may be a 2×12 array with two bodies 420 disposed on end with one another and twelve bodies 420 that are spaced apart from one another while being held together with the brackets 470. When the bodies 420 are on end with one another such as body 420*a* and body 420*b*, a cavity 460 of each of the bodies 420*a*, 420*b* is in communication with one another with the middle bracket 470 forming a joint between the bodies 420*a*, 420*b* on end with one another. While not explicitly shown, the joint at the middle bracket 470 may include a gasket between the ends of each the bodies 420*a*, 420*b* and the middle bracket 470 to form a seal therebetween. In particular embodiments, the brackets 470 may also engage hangers to support the thermal protection module 410 relative to a ceiling or a wall of a cargo container. While shown with an array of 12 bodies 420, brackets 470 may support an array having a width in a range of 2 to 24 bodies, e.g., 2, 3, 4, 5, 6, 7, 8, 9, 10, 11, 12, 13, 14, 15, 16, 17, 18, 19, 20, 21, 22, 23, or 24 bodies in width. In some embodiments, a set of brackets 470 may support an array having a width greater than 24 bodies.

As shown, the bodies 420 that are spaced apart from one another to define troughs or gaps 446 between the bodies 420 such that the bodies 420 are each similar to the fins detailed above, e.g., fins 42. The gaps 446 may be sized to optimize a ratio of air flow over a surface area and for density of the bodies 420. For example, a gap 446 that is too small may inhibit or reduce air flow and thus reduce heat transfer from the bodies 420 and a gap 446 that is too large may waste space between adjacent bodies 420. The optimization of this ratio may optimize thermal transfer into or out of the bodies 420. The brackets 470 may be configured such that the gaps 446 between the bodies 420 are substantially equal to the thickness of each body 420. In some embodiments, the gaps 446 between the bodies 420 may be greater or less than a thickness of the bodies 420. The gaps 446 may be optimized to allow air to pass through the gap 446 while being adjacent to the walls defining the bodies 420 such that the heat transfers into or out of the air to the cooling medium within the cavity 460 of the bodies 420.

With particular reference to FIGS. 16 and 17, each body 420 includes a shell 423 that defines a cavity 460 therein. The shell 423 may have a fixed profile that is extruded for the length of the body 420. As shown, the shell 423 has a substantially rectangular profile. The walls defining the shell 423 may have a thickness in a range of 0.3 millimeters to 1.5 millimeters, e.g., 0.5 millimeters to 1.0 millimeters. Specifically, the shell 423 has rounded corners and smooth sides.

Each body 420 also includes an endcap 450 that seals the end of the body 420 such that the cavity 460 is sealed. The endcap 450 may be press fit, shrunk to fit, or welded into the end of the body 420 to seal the end of the body 420. The endcap 450 may include a fill port 428 that allows for filling of the cavity 460 with a cooling medium. The fill port 428 may be closed by a sight glass 452 that closes the fill port 428 to seal the cavity 460. The sight glass 452 may allow for viewing the cooling medium within the cavity 460. The sight glass 452 may allow for determination of a charge state of the cooling medium. For example, the cooling medium may be substantially transparent when in liquid form and be substantially opaque when in solid form such that viewing through the sight glass 452 may allow for determination of a state of the cooling medium within the cavity 460. In some embodiments, the cooling medium may have a distinct color when in a solid or charged state, e.g., orange.

The use of a plurality of elements or bodies 420 to form the thermal protection module 410 instead of a single body, e.g., body 20, may allow for thinner walls in the extrusion. In addition, the less material in the walls of bodies 420 may increase an amount of cooling medium per unit of length of the body 420. The use of individual bodies 420 may increase the resiliency of a thermal protection module 410. For example, if a single body 420 is damaged such that the cooling medium leaks from the body 420, the other bodies 420 remain sealed and functioning. In contrast, were the body 20 to be damaged, the entire thermal protection module 10 would need to be replaced and would not function until repaired or replaced.

Figure 19:
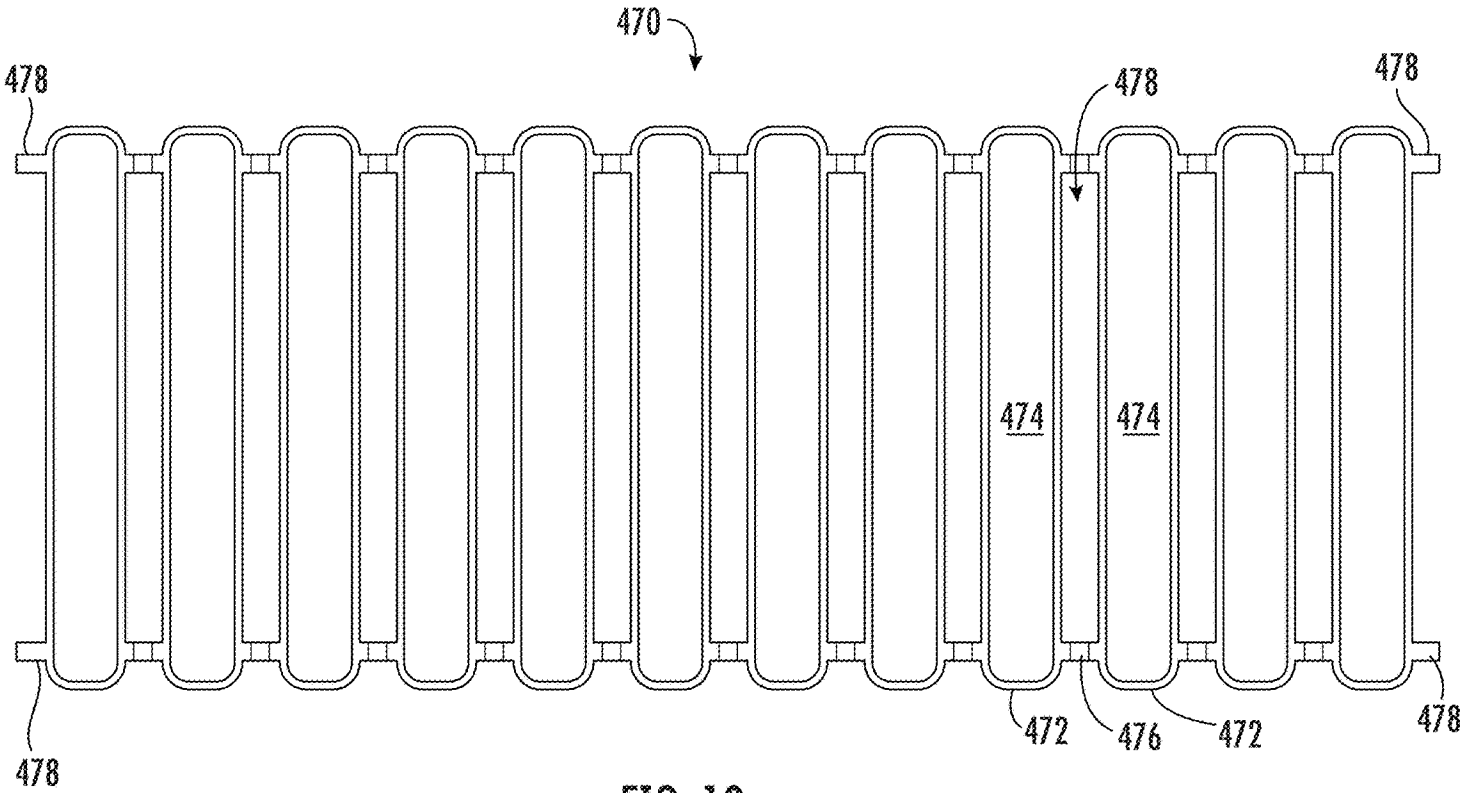
FIG. 19 is a profile view of a bracket of the thermal protection module of FIG. 16.

Referring now to FIG. 19, the brackets 470 include braces 472 and connectors 476 that interconnect the connectors 476. Each brace 472 defines an opening 474 that is sized and dimensioned to receive a portion of a body 420 to secure the body 420 in the array of bodies 414. The opening 474 may be slightly smaller than the shell 423 of the body 420 such that the opening 474 has an interference fit with the outer surface of the body 420 to maintain a position of the body 420 relative to the brace 472. In some embodiments, the opening 474 may be sized to allow the shell 423 of the body 420 to be slidably received in the opening 474. The connectors 476 extend from the brace 472 to position the braces 472 relative to one another and define the gap 446 between adjacent bodies 420 in the array of bodies 414. The ends of the bracket 470 may include interconnects 478 that space the bracket 470 from another bracket 470 or wall of a container. In some embodiments, the interconnects 478 may be configured to link with another bracket 470 such that multiple brackets 470 can be combined to increase a size of an array of bodies 414. The interconnects 478 may be used in a manner similar to the mounting notches 32 detailed above to secure the brackets 470 to a ceiling or a wall of a container. For example, the interconnects 478 may be engaged by a hanger, e.g., hanger 90, to secure the bracket 470, and thus the thermal protection module 410, to the ceiling or the wall of a container.

Figure 20:
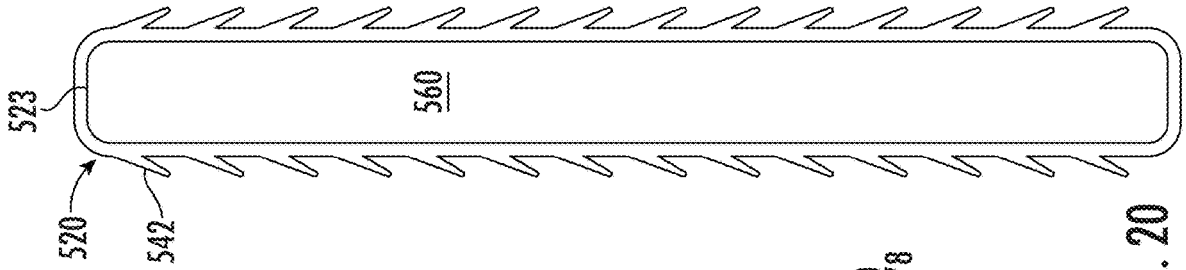
FIG. 20 is a profile view of another body for use with a thermal protection module provided in accordance with the present disclosure.

With reference to FIG. 20, another body 520 is provided in accordance with the present disclosure. The body 520 may be similar to the body 420 detailed above. The body 520 includes a shell 523 having a plurality of fins 542 extending from the sidewalls of the shell 523. The fins 542 may increase a surface area of the shell 523. The increase in surface area may improve thermal transfer into and out of the body 520. The body 520 may be used with the brackets 470 or other brackets. For example, a portion at the end of each body 520 may be provided without the fins 542 such that the shell 523 would fit within the opening 474 of the bracket 470. Alternatively, another bracket could include braces which conform to the fins 542 such that the bracket would receive the shell 523 and the fins 542 within the opening thereof.

Figure 22:
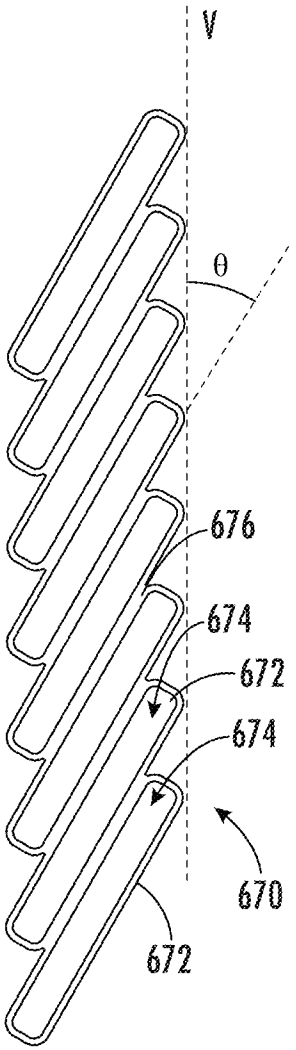
FIG. 22 is a profile view of a bracket of the thermal protection module of FIG. 21.
Figure 21:
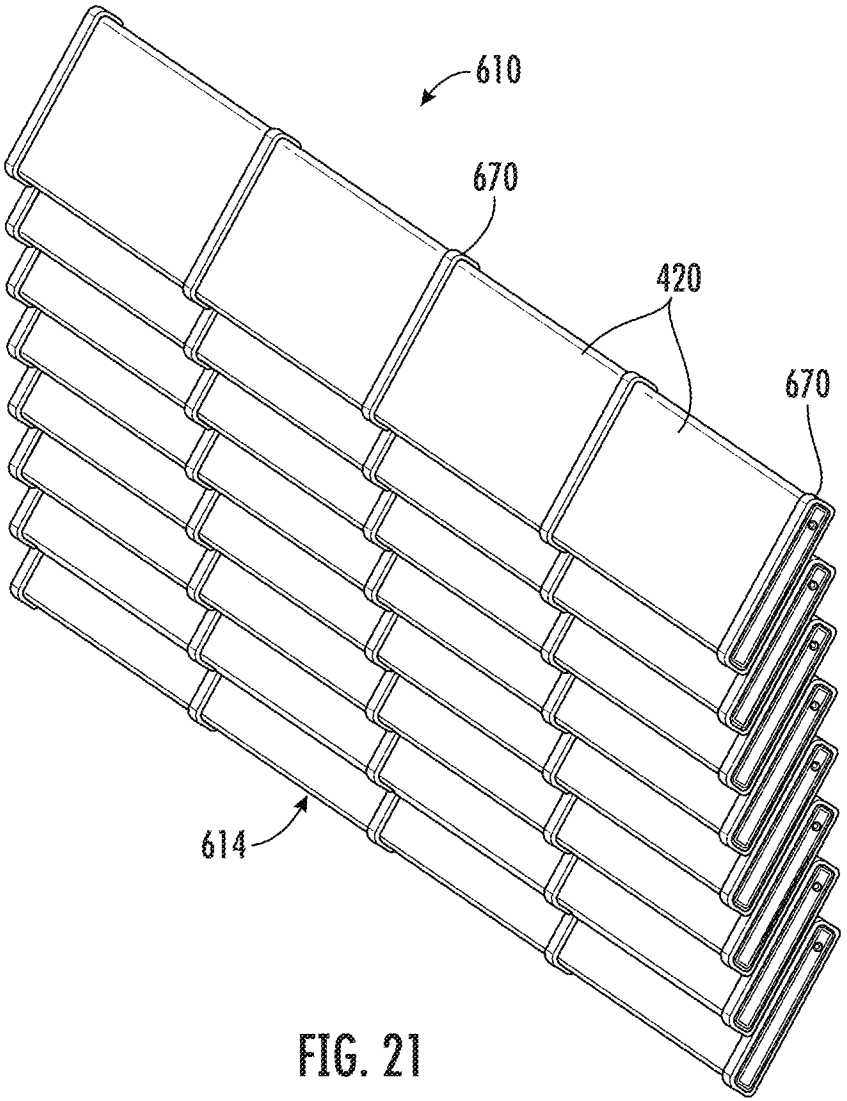
FIG. 21 is a perspective view of another thermal protection module provided in accordance with the present disclosure.

Referring now to FIGS. 21 and 22, another thermal protection module 610 is provided in accordance with the present disclosure. The thermal protection module 610 is an assembly of a plurality of individual bodies 420 that are held together with one or more brackets 670 to form an array of the bodies 614. The brackets 670 have a different geometry than the brackets 470 such that the bodies 420 form a different shape when positioned in the brackets 670. The thermal protection module 610 may be used in a container in conjunction with thermal protection modules 410. For example, the thermal protection modules 410 may be used on a ceiling of the cargo container and the thermal protection modules 610 may be used on the walls of the cargo container. As detailed below, an offset angle of the bodies 420 of the thermal protection module 610 may improve heat transfer into or out of the thermal protection module 610 compared to the thermal protection modules 410 in some applications. The improved heat transfer may be a result of improved convection across surfaces of the bodies 420. For example, when used on a wall of a cargo container, air may flow downward across the bodies 420 as the air is cooled from contacting the bodies such that the offset angle improves across the bodies 420.

The brackets 670 include braces 672 that define openings 674 therewithin. Each brace 672 is secured to an adjacent brace 672 by a connector 676 that secures adjacent braces 672 to one another and defines a gap between adjacent bodies 420. The gap may be less than a thickness of one of the bodies 420. In some embodiments, the gap may be equal to or greater than a thickness of one of the bodies 420. The braces 672 may be offset from a vertical plane V by an angle θ from the vertical plane V. As shown, the angle θ is 30 degrees; however, the angle θ may be in a range of 15 degrees to 75 degrees, e.g., 30 degrees to 60 degrees, 15, 30, 45, 60, or 75 degrees. In some embodiments, the angle θ may be greater than 90 degrees and be in a range of 105 degrees to 165 degrees, e.g., 120 degrees to 150 degrees, 105, 120, 135, 150, or 165 degrees. For example, the angle θ may be greater than 90 degrees when the thermal protection module is configured to maintain a temperature within the cargo container above an ambient temperature. While not explicitly shown, the brackets 670 may include interconnects that allow for mounting of the brackets 670 to an exterior of a container, e.g., walls of the container.

Figures 23, 24:
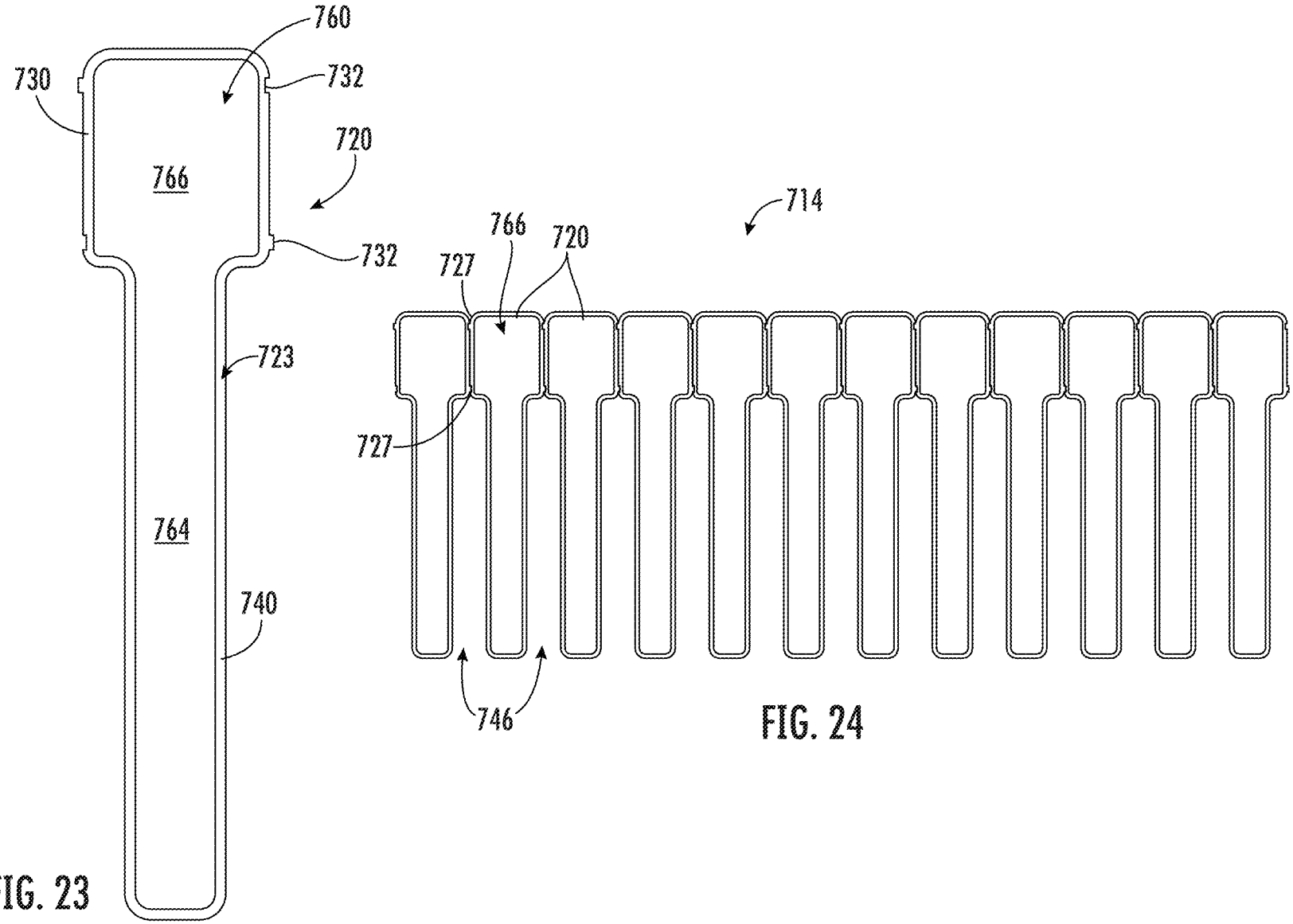
FIG. 23 is a profile view of another body for use with a thermal protection module provided in accordance with the present disclosure.
FIG. 24 is a profile view of an array of bodies including the body of FIG. 23.

Referring now to FIGS. 23 and 24, another body 720 and array of bodies 714 are disclosed in accordance with the present disclosure. The body 720 is similar to the body 420 detailed above with like elements represented with a similar label with the leading "4" replaced with a leading "7". For reasons of brevity, only the differences of the body 720 will be detailed herein.

The body 720 includes a shell 723 that defines a cavity 760 therein. As shown, the shell 723 has a "tadpole shaped" profile along the length thereof. Specifically, the shell 723 has side panels 730 and a fin portion 740 that extends from the side panels 730 such that the fin portion 740 has a height, the distance that it extends from the side panels 730, greater than a height of the side panels 730. The side panels 730 may be joined by a top surface or segment that closes the cavity 760. The distance between the side panels 730 defines a thickness of the shell 723. The side panels 730 may include mounting features 732 that are configured to cooperate with mounting features 732 of adjacent bodies 720 to secure the bodies 720 relative to one another as shown in FIG. 24. The mounting features 732 may include a male mounting feature and a female mounting feature. As shown, on one side panel 730, a male mounting feature is disposed above a female mounting feature and on the other side panel it is reversed with the female mounting feature disposed above the male mounting feature such that when one body 720 is positioned adjacent another body 720 the mounting features 723 can engage one another to secure the bodies 720 together in an array of bodies 714.

The fin portion 740 has a thickness that is less than a thickness of the shell 723. In some embodiments, a thickness of the fin portion 740 may be half of a thickness of the shell 723. The difference between the thickness of the fin portion 740 and a thickness of the shell 723 may define gaps 746 between adjacent fin portions 740 in the array of bodies 714.

The cavity 760 includes a fin or lower section 764 and a reservoir or upper section 766. The lower section 764 is defined within the fin portion 740 and the upper section 766 is defined by the side panels 730. The volume of the lower section 764 may be greater than a volume of the upper section 766 as represented by the area in FIG. 23. In use, a cooling medium within the cavity 760 may flow from the upper section 766 to the lower section 764 such that there is a convective flow of the cooling medium within the cavity 760.

The array of bodies 714 may form a thermal protection module similar to the thermal protection modules detailed above. In certain embodiments, the array of bodies 714 are joined together with one or more brackets similar to the brackets detailed above to define a thermal protection module. It will be appreciated that each of the bodies 720 include an endcap that is sized and dimensioned to seal an end of the profile shown in FIG. 23. The endcaps for the bodies 720 may be similar to the endcaps 450 detailed above albeit with a different shape to conform with the profile of the bodies 720.

Figures 25, 26:
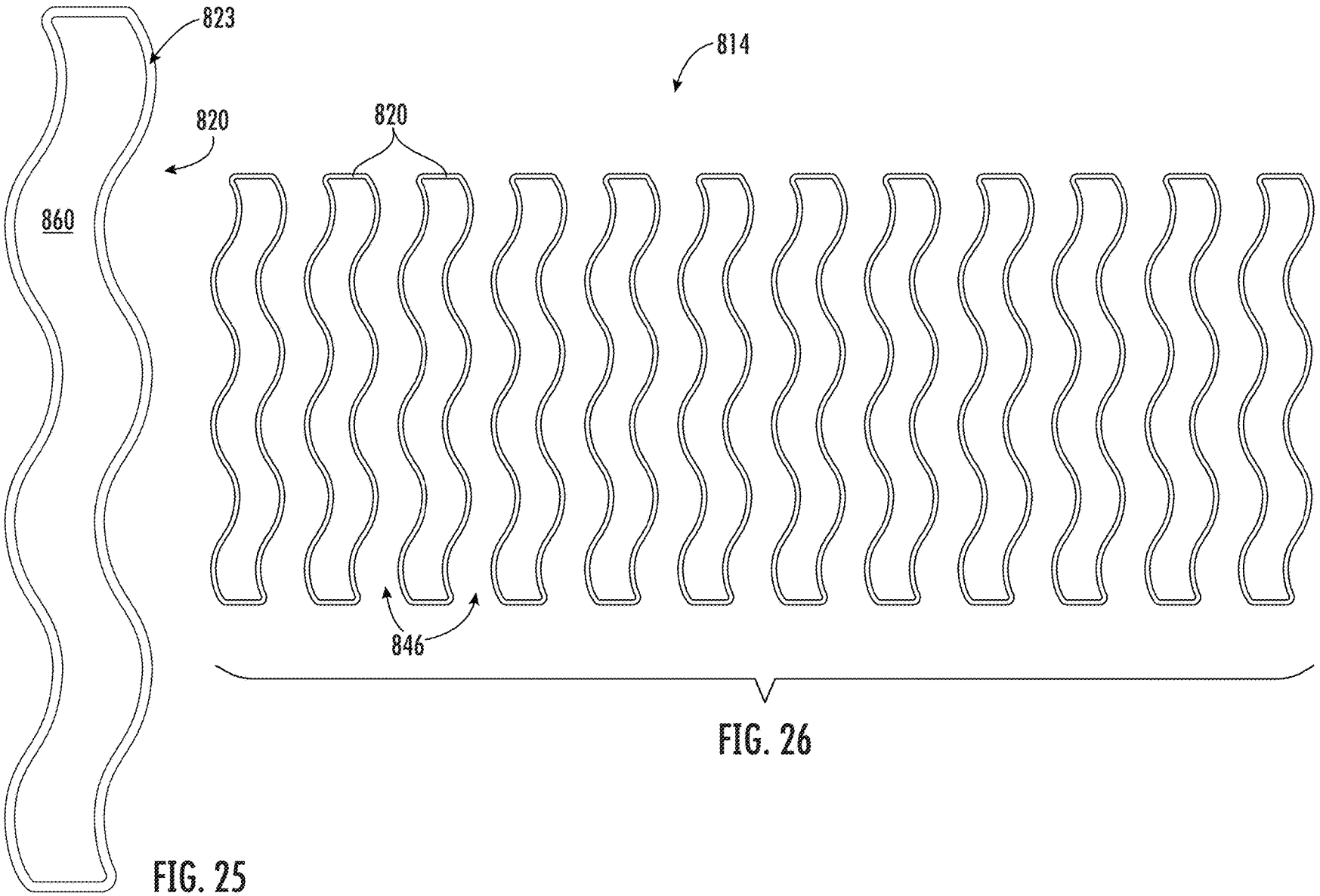
FIG. 25 is a profile view of another body for use with a thermal protection module provided in accordance with the present disclosure.
FIG. 26 is a profile view of an array of bodies including the body of FIG. 24.

With reference to FIGS. 25 and 26, another body 820 and array of bodies 814 are disclosed in accordance with the present disclosure. The body 820 is similar to the body 420 detailed above with like elements represented with a similar label with the leading "4" replaced with a leading "8". For reasons of brevity, only the differences of the body 820 will be detailed herein.

The body 820 includes a shell 823 that defines a cavity 860 therein. The shell 823 has substantially arcuate sidewalls that form a wave shape or a continuous S-shape. The continuous S-shape of the sidewalls of the shell 823 may increase a surface area of the sidewalls per unit of length compared to the rectangular shape of the shell 423 of the body 420 (FIG. 18) when the overall height of the shells 423, 823 are the same. In addition, the increased surface area may occur when the overall width of the array of bodies 814 is the same as the overall width of the array of bodies 414 with the same number of bodies 420, 820 in the arrays 414, 814. The increased surface area per unit of length may increase the heat transfer into or out of the cooling medium disposed within the cavity 860 when compared to the cavity 460. The increase in heat transfer may allow for improved temperature control within a cargo container with the same number of bodies 820. In some embodiments, the increase in heat transfer may allow for a reduced number of bodies 820 to be used in a given container compared to the bodies 420. The reduction in the number of bodies 820 may reduce an overall weight of a cooling system for a container using the bodies 820 compared to using the bodies 420.

Figure 28:
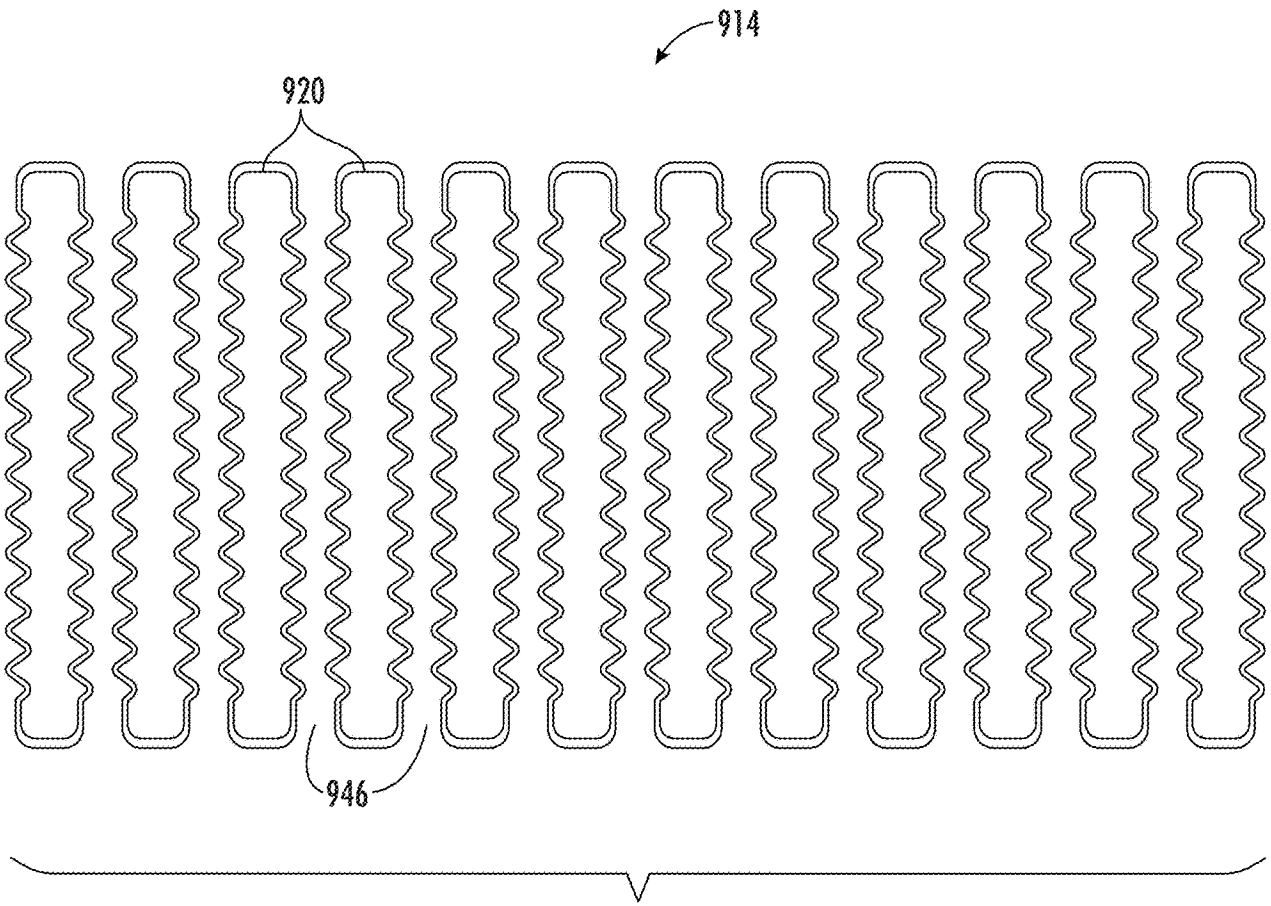
FIG. 28 is a profile view of an array of bodies including the body of FIG. 27.
Figure 27:
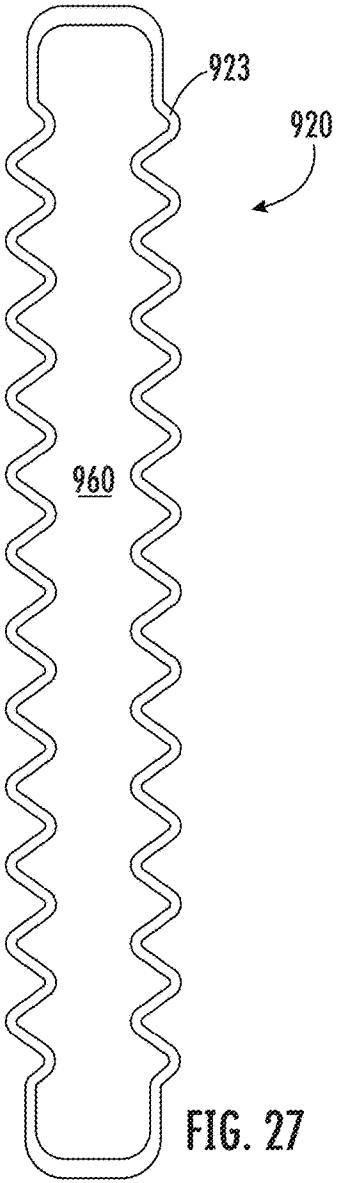
FIG. 27 is a profile view of another body for use with a thermal protection module provided in accordance with the present disclosure.

With reference to FIGS. 27 and 28, another body 920 and array of bodies 914 are disclosed in accordance with the present disclosure. The body 920 is similar to the body 420 detailed above with like elements represented with a similar label with the leading "4" replaced with a leading "9". For reasons of brevity, only the differences of the body 920 will be detailed herein.

The body 920 includes a shell 923 that defines a cavity 960 therein. The shell 923 has substantially corrugated sidewalls that form a convoluted or zig-zag shape. The zig-zag shape of the sidewalls of the shell 923 may increase a surface area of the sidewalls per unit of length compared to the rectangular shape of the shell 423 of the body 420 (FIG. 18) when the overall height of the shells 423, 923 are the same. The zig-zag shape of the sidewalls of the shell 923 may have an increased surface area of the sidewalls pers unit of length compared to the continuous S-shape of the shell 823 when the overall height of the shells 823, 923 are the same. In addition, the increased surface area may occur when the overall width of the array of bodies 914 is the same as the overall width of the array of bodies 414 or array of bodies 814 with the same number of bodies 420, 820, 920 in the arrays 414, 814, 914. The increased surface area per unit of length may increase the heat transfer into or out of the cooling medium disposed within the cavity 960 when compared to the cavity 460 or the cavity 860. The increase in heat transfer may allow for improved temperature control within a cargo container with the same number of bodies 920. In some embodiments, the increase in heat transfer may allow for a reduced number of bodies 920 to be used in a given container compared to the bodies 420 or the bodies 820. The reduction in the number of bodies 920 may reduce an overall weight of a cooling/heating system for a container using the bodies 920 compared to using the bodies 420 or the bodies 820. Further, the volume of the cavity 960 per unit of length may be greater than the volume of the cavity 460 or the cavity 860 per unit of length. Specifically, the volume of the cavity 960 per unit of length may be in a range of 10 percent to 25 percent, e.g., 17 percent, greater than the volume of the cavity 460 or the cavity 860 per unit of length. In addition, the surface area per unit of length of the body 920 may be in a range of 25 percent to 40 percent, e.g., 34 percent, greater than the surface area of the body 420 or the body 820 per unit of length. The increase in volume and surface area of the cavity 960 and the body 920 may allow for an additional capacity of cooling medium within the cavity 960 and thus, allow for additional cooling capacity of the body 920. In addition, the increase in volume and surface area of the cavity 960 and the body 920 may result in a higher efficiency than other bodies. The zig-zag shape may improve a lateral bending stiffness of the bodies 920 compared to other bodies, e.g., bodies 420, 820. The bodies 920 may be formed of an extrusion process. In some embodiments, the bodies 920 may be formed from bending and welding at one or more of the joints or corners. The walls defining the shell 923 may have a thickness in a range of 0.3 millimeters to 1.5 millimeters, e.g., 0.5 millimeters to 1.0 millimeters.

Figure 29:
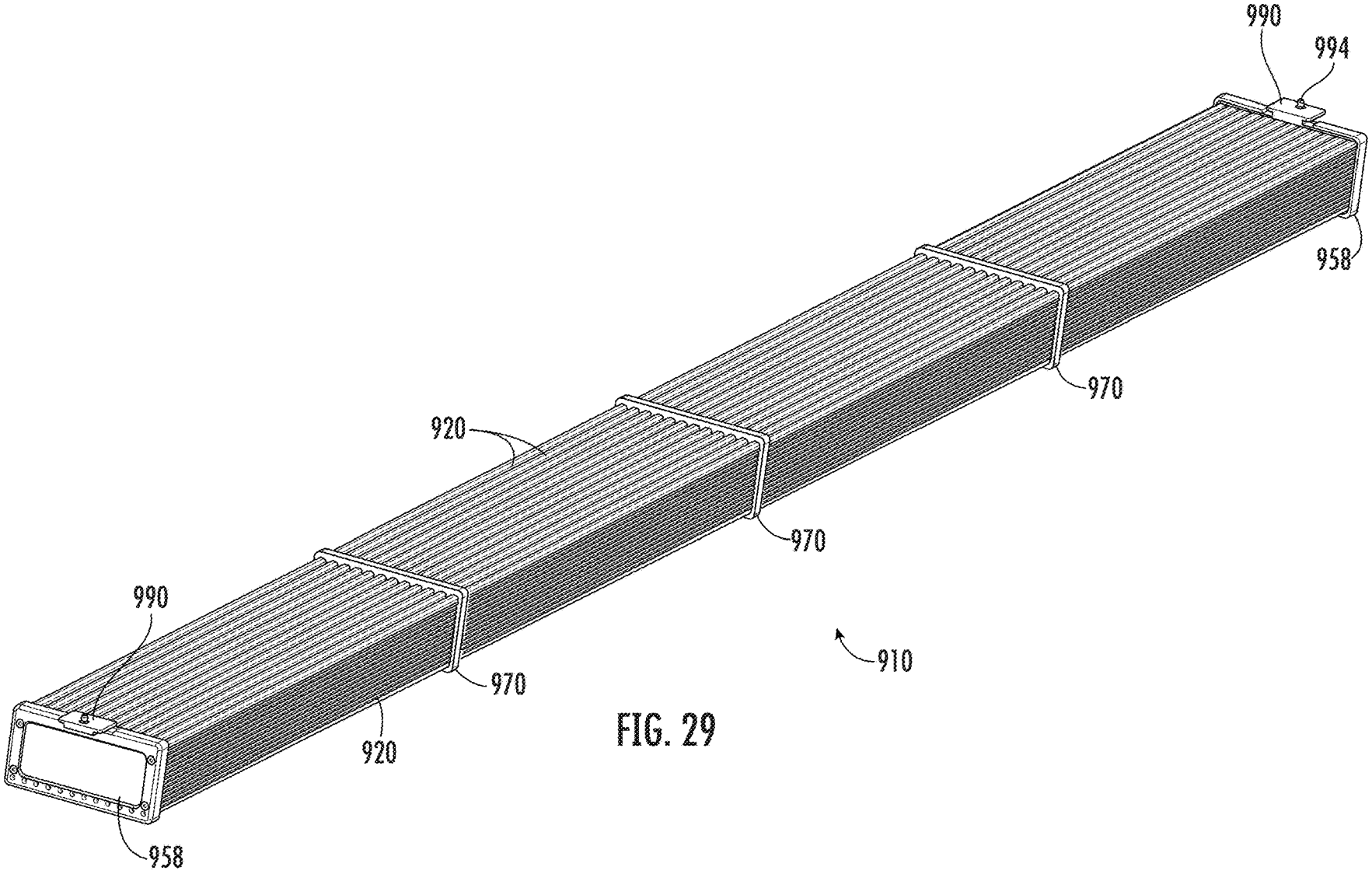
FIG. 29 is a perspective view of another thermal protection module provided in accordance with the present disclosure including the body of FIG. 27.
Figure 30:
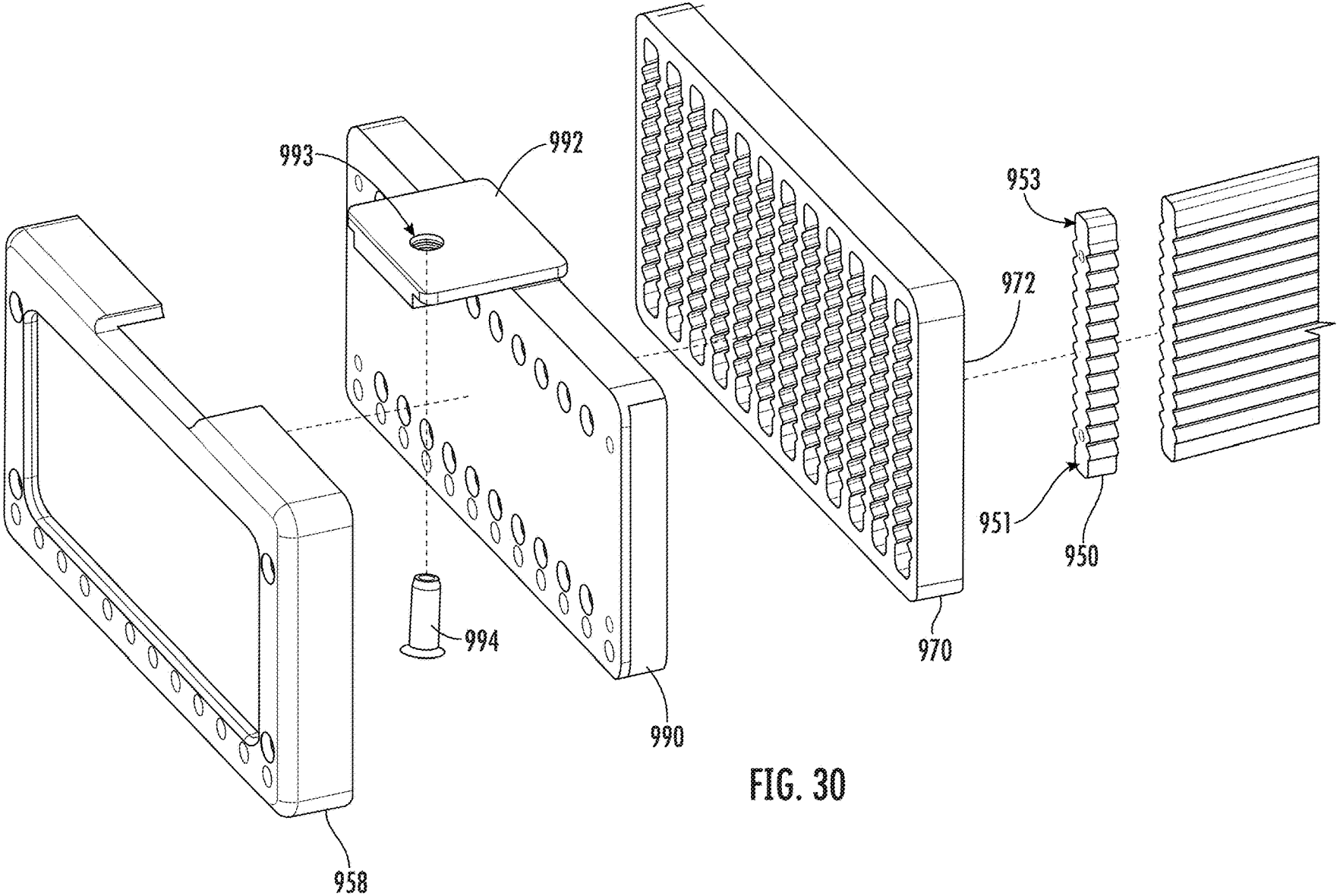
FIG. 30 is a perspective view, with parts separated, of an end portion of the thermal protection module of FIG. 29.

With additional reference to FIGS. 29 and 30, a thermal protection module 910 is provided in accordance with the present disclosure. The thermal protection module 910 includes a plurality of bodies 920 disposed in the array of bodies 914. The thermal protection module 910 also includes one or more brackets 970 that are disposed along the length of the thermal protection module 910 to support the bodies 920 and maintain a position of the bodies 920 relative to one another in the array of bodies 914. In some embodiments, the bodies 920 extend the entire length of the thermal protection module 910. Alternatively, in embodiments, a single body 920 extends only a portion of a length of the thermal protection module 910 with a joint formed at one or more of the brackets 970 between bodies 920.

With particular reference to FIG. 30, each body 920 includes an endcap 950 that seals the end of the respective body 920. The endcap 950 defines a first or sight hole 951 and a second or fill hole 953. One or both of the sight hole 951 and the fill hole 953 may be threaded. The sight hole 951 receives a sight glass 952 that allows for viewing of a cooling medium within the cavity 960 of the respective body 920. As detailed above, viewing the cooling medium may allow for a determination of the charge state of the cooling medium within the cavity 960. The fill hole 953 may be used to add cooling medium to the cavity 960. The fill hole 953 may receive a screw that seals the fill hole 953. The thermal protection module 910 includes a bracket 970 to retain cooling medium within the cavity 960.

The end portion of the thermal protection module 910 includes a bracket 970, a module endcap 958, and a hanger 990. The bracket 970 is disposed about end portions of the bodies 920 with the bodies 920 received within braces 972. The module endcap 958 is disposed over the end portions of the bodies 920 and the bracket 970. The module endcap 958 may be secured to the bracket 970 by fasteners that pass through the module endcap 958 and threadably secure to the bracket 970. The module endcap 958 may protect the ends of the bodies 920 and may allow for the plurality of bodies 920 to form a single thermal protection module 910 and be handled as a single unit. In some embodiments, the module endcap 958 may be formed of an energy absorbing material, e.g., rubber, that protects the ends of the bodies 920 from impacts. The lower section of the module endcap 958 may have through passages that allow for viewing of the sight glasses 952 of the bodies 920. In certain embodiments, the manifold endcap 958 may be labeled and/or colored in a manner to indicate the transition temperature of a cooling or warming medium disposed within the thermal protection module 910. For example, the manifold endcap 958 may be blue or labeled with a −2 degree Celsius label when a cooling medium within the thermal protection module 910 is a −2 degree Celsius PCM or the manifold endcap 958 may be red or labeled with a 100 degree Celsius label when a warming medium within the thermal protection module 910 is a 100 degree Celsius PCM. Such labeling or coloring may be applied to any of the endcaps disclosed herein.

The hanger 990 is disposed between the module endcap 958 and the bracket 970. The ends of the bodies 920 may abut or be spaced apart from the hanger 990. The hanger 990 includes a mounting flange 992 in a top section thereof. The mounting flange 992 defines a mounting hole 993 that is positioned beyond the module endcap 958. The mounting hole 993 receives an indexing plunger 994 therethrough. The indexing plunger 994 passes through the mounting hole 993 and is configured to secure to a ceiling or a wall of a cargo container to mount the thermal protection module 910 to the cargo container. The indexing plunger 994 may be configured to space a top of the bodies 920 from the ceiling or the wall of the cargo container to allow for air to flow between the thermal protection module 10, e.g., the bodies 920, and the ceiling or the wall of the cargo container. In some embodiments, the indexing plunger 994 may be manipulated to adjust the distance between the thermal protection module 10 and the ceiling or the wall of the cargo container.

As shown in FIGS. 24, 26, and 28-30, the arrays of bodies 714, 814, 914 are arranged with the respective bodies in a substantially rectangular configuration similar to the array of bodies 414 illustrated in FIG. 18. However, it will be appreciated that any of the bodies 720, 820, 920 may be supported in an angled orientation similar to the bodies 420 in the array of bodies 614 illustrated in FIG. 21 with the use of brackets that support the bodies 720, 820, 920 in an angled orientation. As discussed above with respect to FIGS. 20 and 21, the angled orientation may improve convective flow across the bodies of a thermal protection module when the thermal protection module is secured to a wall of a cargo container.

Figure 31:
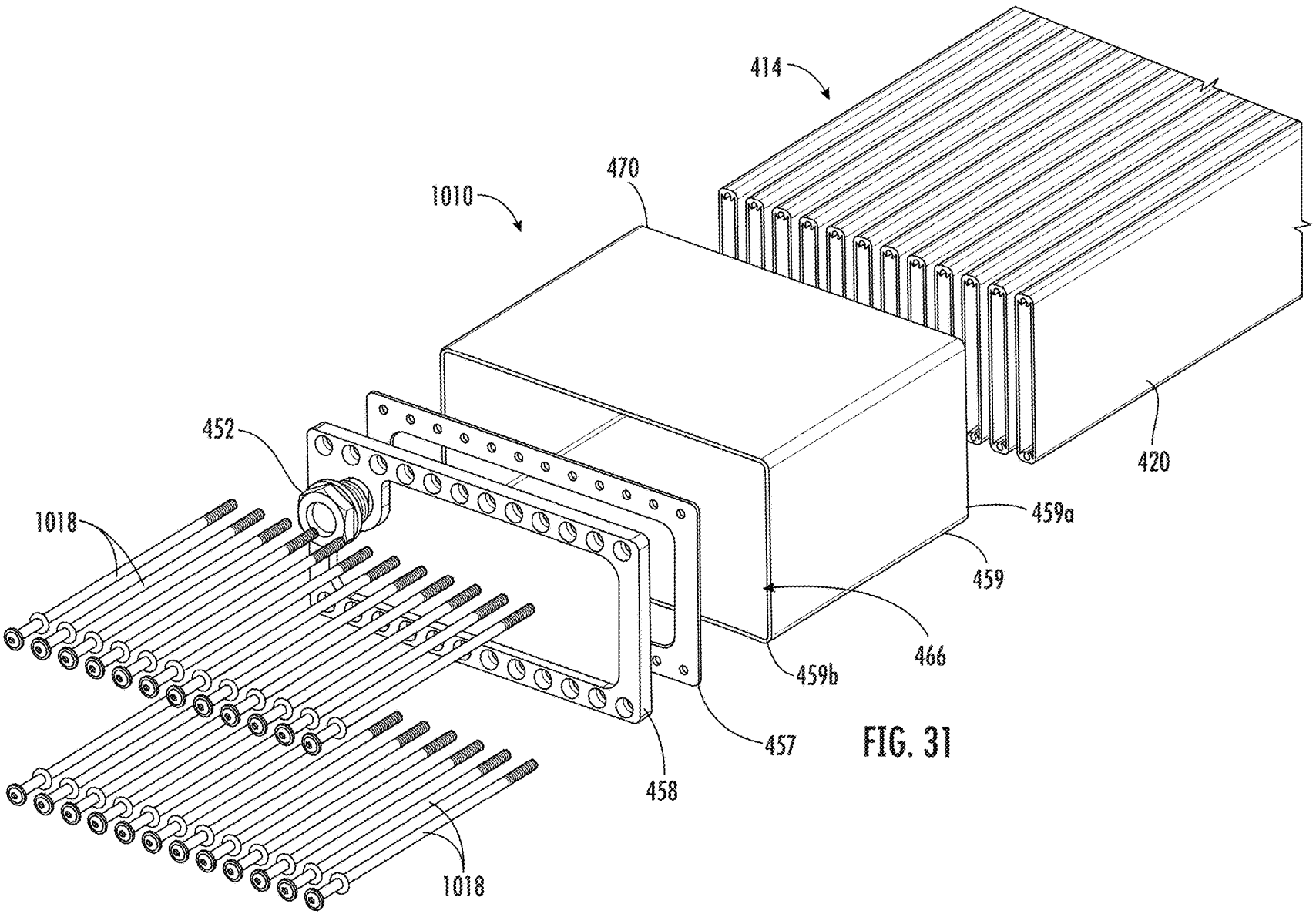
FIG. 31 is a perspective view, with parts separated, of an end portion of another thermal protection module provided in accordance with the present disclosure.
Figure 32:
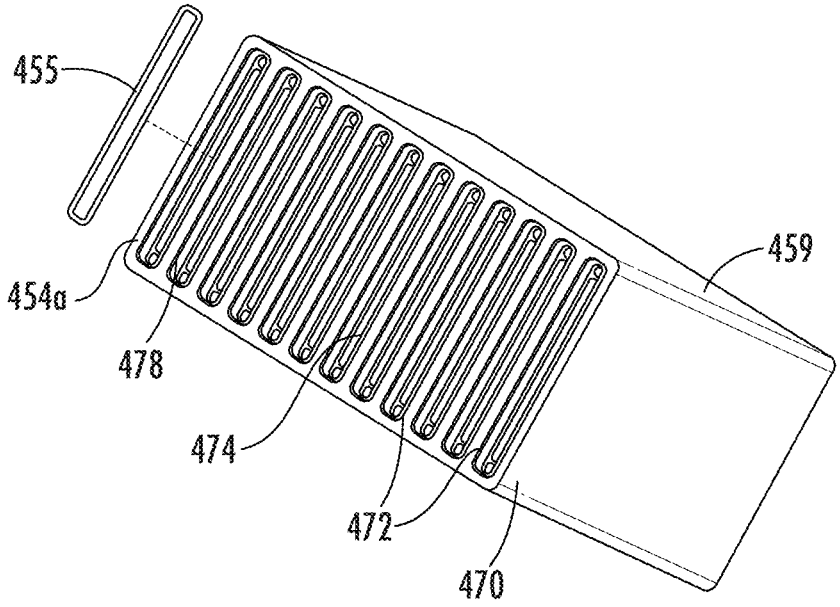
FIG. 32 is a rear perspective view of a manifold of the thermal protection module of FIG. 31.
Figure 36:
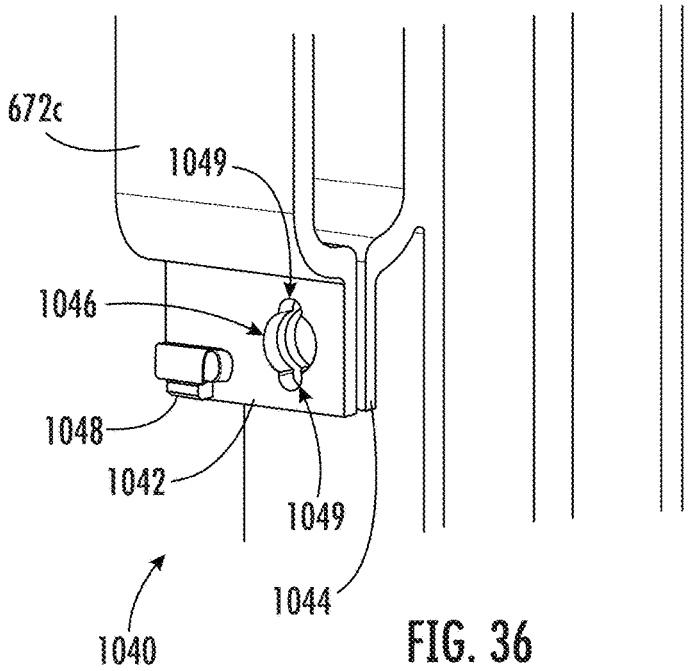
FIG. 36 is an enlarged perspective view of a portion of the bracket of FIG. 35 with a closure of the locking device removed.
Figure 37:
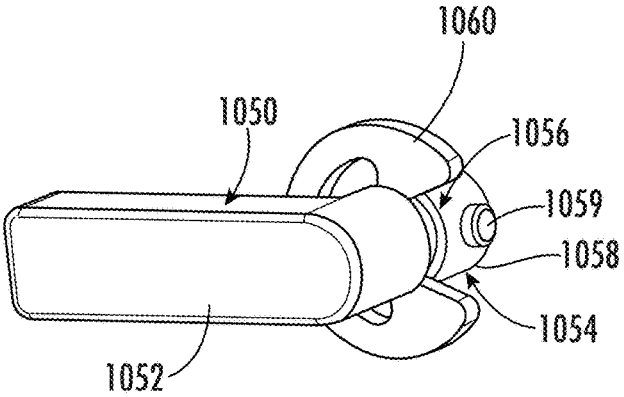
FIG. 37 is a perspective view of a closure and a retaining ring of a locking device of FIG. 35 in a locked configuration.
Figure 38:
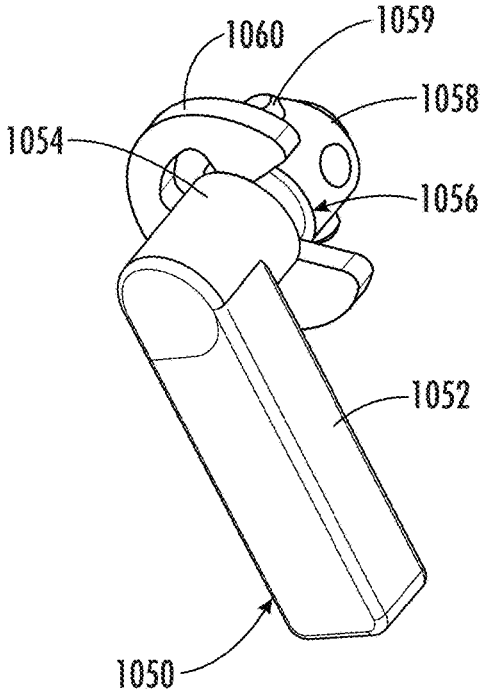
FIG. 38 is a perspective view of the closure and the retaining ring of the locking device of FIG. 35 in an unlocked configuration.
Figure 39:
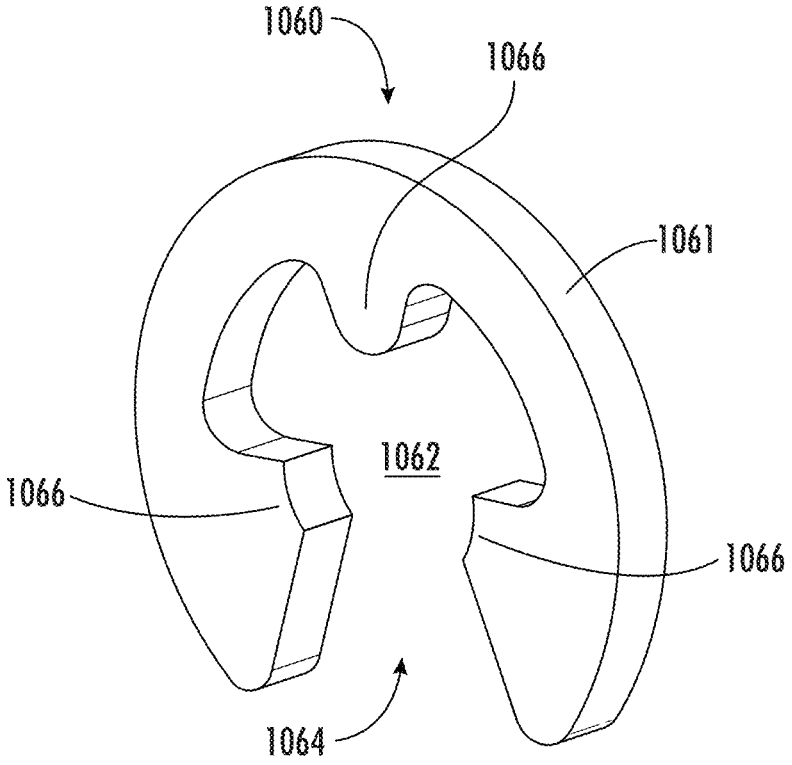
FIG. 39 is a perspective view of a retaining ring of the locking device of FIG. 35.

Referring now to FIGS. 31 and 32, another thermal protection module 1010 is provided in accordance with the present disclosure. While thermal protection module 1010 is shown for use with the bodies 420, it is within the scope of this disclosure that the bodies 720, 820, or 920 could be used with the thermal protection module 1010. In addition, while shown with the array of bodies 414 in a substantially rectangular orientation, the thermal protection module 1010 may be configured in an angled orientation with any of modules 420, 720, 820, 920.

The thermal protection module 1010 includes a plurality of bodies 420 arranged in an array of bodies 414, a manifold 459, a manifold endcap 458, and a sight glass 452. The manifold 459 has a first or array end **459*a* and a second or cap end 459*b* that is opposite the array end 459*a*. The manifold 459 defines a reservoir 466 therewithin. The array end 459*a* of the manifold 459 may include a bracket 470. The bracket 470 may be integrally or monolithically formed with the manifold 459. In some embodiments, the bracket 470 is formed separate from the manifold 459 and is coupled to the manifold 459 by fasteners. In certain embodiments, a gasket is disposed between the bracket 470 and the manifold 459. The bracket 470 defines a plurality of braces 472 that each define a respective opening 474. The braces 472 are sized and dimensioned to receive an end of a respective body 420. The bracket 472 may define a recess 478 such that the end of the respective body 420 may abut walls defining the recess 478 or a respective body gasket 455 may be captured between the end of the respective body 420 and the walls defining the recess 478 scalingly receives an end of each body 420. The cap end 459*b* of the manifold 459 is scalingly closed with the manifold end cap 458. The thermal protection module 1010 may include a cap gasket 457 disposed between the manifold end cap 458 and the manifold 459. The sight glass 452 allows for visualization of a cooling medium within the reservoir 466. As detailed above, visualizing a cooling medium may allow for checking a state of the cooling medium. The end assembly of the thermal protection module 1010 may be secured together with a plurality of fasteners 1018 that extend through the manifold end cap 458, the manifold 459, and into the bodies 420. It will be appreciated that the plurality of fasteners 1018 may pass through any gaskets or other components disposed between the manifold end cap 458 and the bodies 420. In some embodiments, the plurality of fasteners 1018 may have a high coefficient of conductivity such that each of the fasteners 1018 may transfer heat into or out of a cooling medium within the reservoir 466**.

When the ends of the bodies 420 are received in the bracket 470, the cavities 460 of the bodies 420 are in fluid communication with the reservoir 466 of the manifold 459 such that cooling medium may flow between the bodies 420 and the manifold 459. In addition, thermal energy may be transferred through cooling medium within the reservoir 466 and the cavities 460. The manifold 459 may increase a volume of cooling medium available for the thermal protection module 1010 compared to the thermal protection module 410 while substantially maintaining the surface area of the thermal protection module 410. In embodiments, both ends of the thermal protection module 1010 include a manifold assembly as shown in FIG. 31. In certain embodiments, only one end of the thermal protection module 1010 includes the manifold assembly. In some embodiments, the thermal protection module 1010 includes hangers, e.g., hangers 990, secured to the module endplate 458.

With reference to FIGS. 33-35, locking devices for brackets are disclosed in accordance with the present disclosure. The locking devices are configured to secure a portion of a body, e.g., body 420, 720, 820, 920, within a respective brace of a bracket. The locking devices are shown for use with different braces 672 of the bracket 670. It will be appreciated that in use, each brace of a particular bracket would include the same locking device to secure the portion of the body within the brace. As noted above, the brace may have a slight interference fit with the portion of the body received within the brace. The locking devices may allow for the removal and replacement of individual bodies from an array of bodies. For example, if one of the bodies of an array of bodies is damaged, the locking devices may allow for removal and replacement of the single body without uninstalling the rest of the thermal protection module.

A first locking device 1020 is shown with respect to brace 672*a*. The first locking device 1020 includes a first leg 1022 and a second leg 1026. The first leg 1022 may define a section of the opening 674*a* with the second leg 1026 is spaced apart from the opening 674*a* with the first leg 1022 positioned between the second leg 1026 and the opening 674*a*. The first leg 1022 includes a first rack 1025 of teeth and the second leg 1026 includes a second rack 1027 of teeth that are opposed to one another. The first locking device 1020 has a first or locked configuration in which the first rack 1025 is engaged with the second rack 1027 such that the opening 674*a* of the brace 672*a* is configured to engage a body. The first locking device 1020 has a second or unlocked configuration in which the first rack 1025 is disengaged from the second rack 1027 such that the brace 672*a* can be opened to allow a body to be removed from the opening 674*a* and another body to be inserted into the opening 674*a*.

The second leg 1026 may include a finger 1028 that extends away from the opening 674*a*. The finger 1028 is engageable to urge the teeth of the second rack 1027 out of engagement with the teeth of the first rack 1025 to transition the first locking device 1020 from the locked configuration to the unlocked configuration. In addition, the finger 1028 may be engaged to engage the teeth of the first rack 1025 with the teeth of the second rack 1027 to transition the first locking device 1020 from the unlocked configuration to the locked configuration. When the teeth of the first rack 1025 and the second rack 1027 are fully engaged with one another as shown in FIG. 34, there may be audible indica of engagement, e.g., an audible click.

Continuing to refer to FIGS. 33-35, a second locking device 1030 is shown with respect to brace 672*b*. The second locking device 1030 includes a first leg or tab 1032 and a second leg or tab 1034 that are formed at one end of the brace 672*b*. The first tab 1032 and the second tab 1034 define a securement hole 1036 therethrough. The securement hole 1036 is sized and dimensioned to receive a closure in the form of a fastener, a tie, a cord, a clip, or other means to prevent the first tab 1032 and the second tab 1034 from moving away from one another. When the closure is received in the securement hole 1036 over the first tab 1032 and the second tab 1034, the second locking mechanism 1030 is in a locked configuration in which the brace 672*b* is secured about a portion of a body. When the closure is removed from the securement hole 1036, the second locking mechanism 1030 is in an unlocked configuration in which the brace 672*b* can be opened to allow a body to be removed from the opening 674*b* and another body to be inserted into the opening 674*b*.

Referring now to FIGS. 33-39, the third locking device 1040 is shown with respect to the brace 672*c*. The third locking device 1040 includes a first leg or tab 1042, a second leg or tab 1044, a closure 1050, and a retaining ring 1060. The first tab 1042 and the second tab 1044 are formed at one end of the brace 672*c* and define a securement hole 1046 that passes through therethrough. The securement hole 1046 may include two nub passages 1049 that are on opposite sides of the securement hole 1046. The closure 1050 includes a lever 1052 and a shaft 1054 that extends from an end portion of the lever 1052. The shaft 1054 extends in a direction perpendicular to the lever 1052 with the lever 1052 rotatable about a central longitudinal axis of the shaft 1054. The shaft 1054 includes a locking portion 1058 that is spaced apart from the lever 1052 with a groove 1056 defined between the lever 1052 and the locking portion 1058. The locking portion 1058 includes nubs 1059 that extend from opposite sides of the locking portion 1058.

With particular reference to FIGS. 34 and 35, the third locking device 1040 has a locked configuration in which the closure 1050 is positioned in the securement hole 1046 passing through the first tab 1042 and the second tab 1044 with the lever 1050 on an exposed side of the first tab 1042 and the nubs 1059 engaging an exposed side of the second tab 1044 that is opposite the exposed side of the first tab 1042. In the locked configuration, the lever 1052 is rotated about the shaft 1054 such that the nubs 1059 are out of alignment with the nub passages 1049 of the securement hole 1046 such that the closure 1050 is retained within the securement hole 1046 and the first tab 1042 and the second tab 1044 close the opening 674*c* such that a body is retained within the brace 672*c*. The first tab 1042 may include a protrusion 1048 that engages the lever 1052 to prevent the closure 1050 from rotating from the locked configuration. The third locking device 1040 has an unlocked configuration in which the first tab 1042 and the second tab 1044 are capable of separating from one another such that a body can be removed from within the opening 674*c* and another body can be inserted into the opening 674*c*. To transition the third locking device 1040 from the locked configuration to the unlocked configuration, the lever 1052 is rotated approximately 90 degrees such that the nubs 1059 are aligned with the nub passages 1049 of the securement hole 1046 such that the first tab 1042 can be separated from the second tab 1044. When the first tab 1042 includes the protrusion 1048, the lever 1052 may be moved over the protrusion 1048.

The retaining ring 1060 is disposed between the first tab 1042 and the second tab 1044 and is configured to retain the closure 1050 within at least the first tab 1042 in the unlocked configuration of the third locking device 1040. The retaining ring 1060 is disposed about the shaft 1054 of the closure 1050 within the groove 1056 such that the closure 1050 is rotatable about the central longitudinal axis of the shaft 1054 but is secured to the first tab 1042. The retaining ring 1060 may function as a clip with a central opening 1062 and a passage 1064. The central opening 1062 may include one or more fingers 1066 that extend into the central opening 1062 to engage the shaft 1054. The passage 1064 may be configured to allow the retaining ring 1060 to be pushed over the shaft 1054 until the fingers 1066 engage the shaft 1054 to retain the closure 1050 to the first tab 1042.

Figure 40:
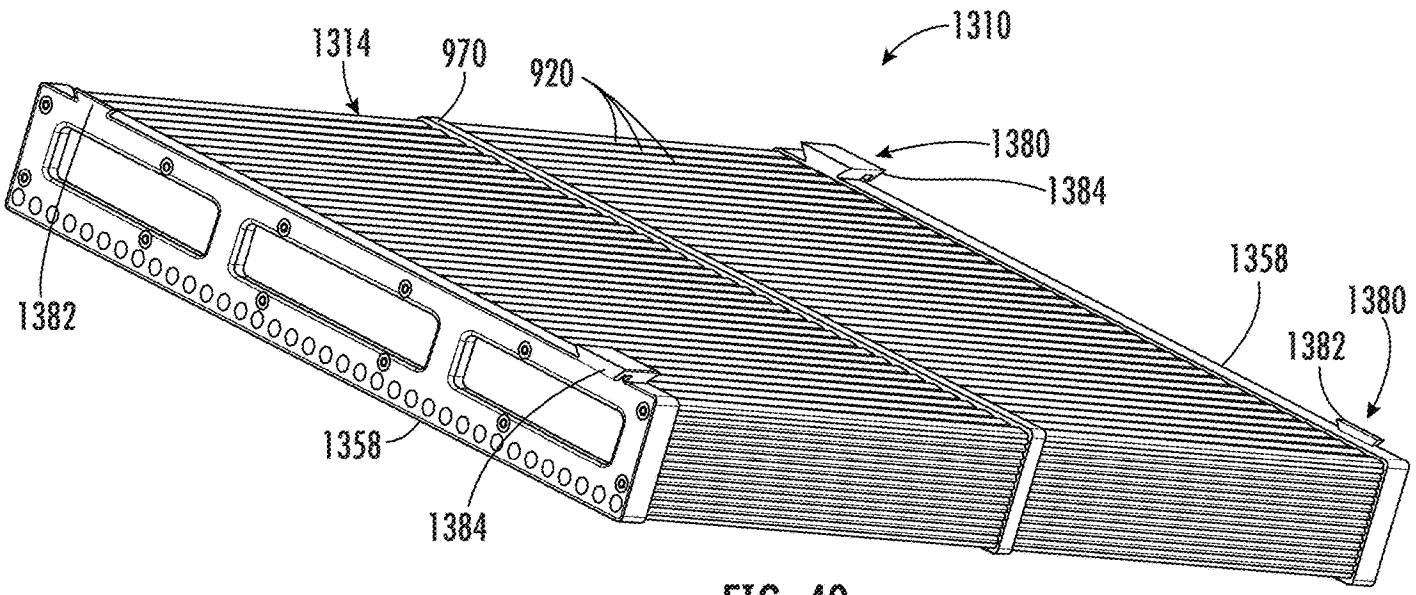
FIG. 40 is a perspective view of another thermal protection module provided in accordance with the present disclosure.

Referring now to FIG. 40 another thermal protection module 1310 is provided in accordance with the present disclosure. The thermal protection module 1310 includes a plurality of elements or bodies 920 that are positioned with one another in an array of bodies 1314 by one or more brackets 970. The thermal protection module 1310 is similar to the thermal protection module 910. As such, similar labels may be used with the leading "9" of the label of the thermal protection module 910 replaced with a leading "13" for the thermal protection module 1310 and only the differences will be detailed herein for reasons of brevity.

The thermal protection module 1310 includes a module end cap 1358 that is secured about the ends of the bodies 920 and may receive a bracket 970 therein. The module end cap 1358 may be formed of a polymer material or a metal. The module end cap 1358 may provide impact protection for the bodies 920. In some embodiments, portions the module end cap 1358 may be coated with a shock absorbing material. In certain embodiments, portions or all of the module end cap 1358 may be colored to provide a visual indica of a transition temperature of a medium disposed within the bodies 920 of the thermal protection module 1310.

Figure 41:
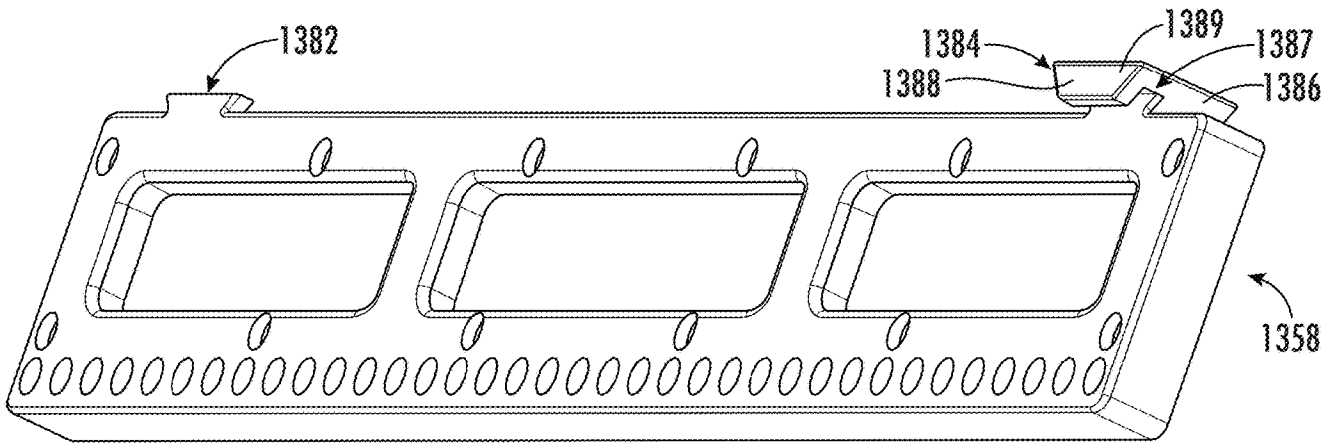
FIG. 41 is a perspective view of an end cap of the thermal protection module of FIG. 40.

With additional reference to FIG. 41, the module end cap 1358 includes interconnect system 1380. The interconnect system 1380 includes a first tab 1382 and a second tab 1384 that extend from a top end of the module end cap 1358. The first tab 1382 and the second tab 1384 have a trapezoidal profile with the shortest base of each having the same length and positioned on the top end of the module end cap 1358. The angles between the short base and the legs of the first tab 1382 and the second tab 1384 are equal to one another. However, the length of the legs and the long base of each of the first tab 1382 and the second tab 1384 are different.

The first tab 1382 extends a first distance from the top end of the module end cap 1358 and is congruent or inset from an end surface 1358*a* of the module end cap 1358. The first tab 1382 has a thickness that is less than a thickness of the module end cap 1358 as shown in more clearly in FIG. 44. For example, the first tab 1382 may have a thickness in a range of 25 percent of a thickness of the module end cap 1358. The second tab 1384 extends a second distance from the top end of the module end cap 1358 and extends beyond the end surface 1358*a* of the module end cap 1358. The second distance is greater than the first distance such that the second tab 1384 extends over a first tab of an adjacent module end cap 1358 as shown more clearly in FIG. 44. The second tab 1384 includes a mount section 1386 and a finger section 1388. The mount section 1386 may have a thickness equal to a thickness of the module end cap 1358. In some embodiments, the mount section 1386 may have a thickness less than the entire thickness of the module end cap 1358. The finger section 1388 extends from the mount section 1386 beyond the end surface 1358*a* of the module end cap 1358 and includes a downward extending tip 1389 that defines a receiver 1387 with the mount section 1386. The receiver 1387 is sized and dimensioned to receive a first tab 1382 of an adjacent module end cap 1358 as detailed below.

Figure 42:
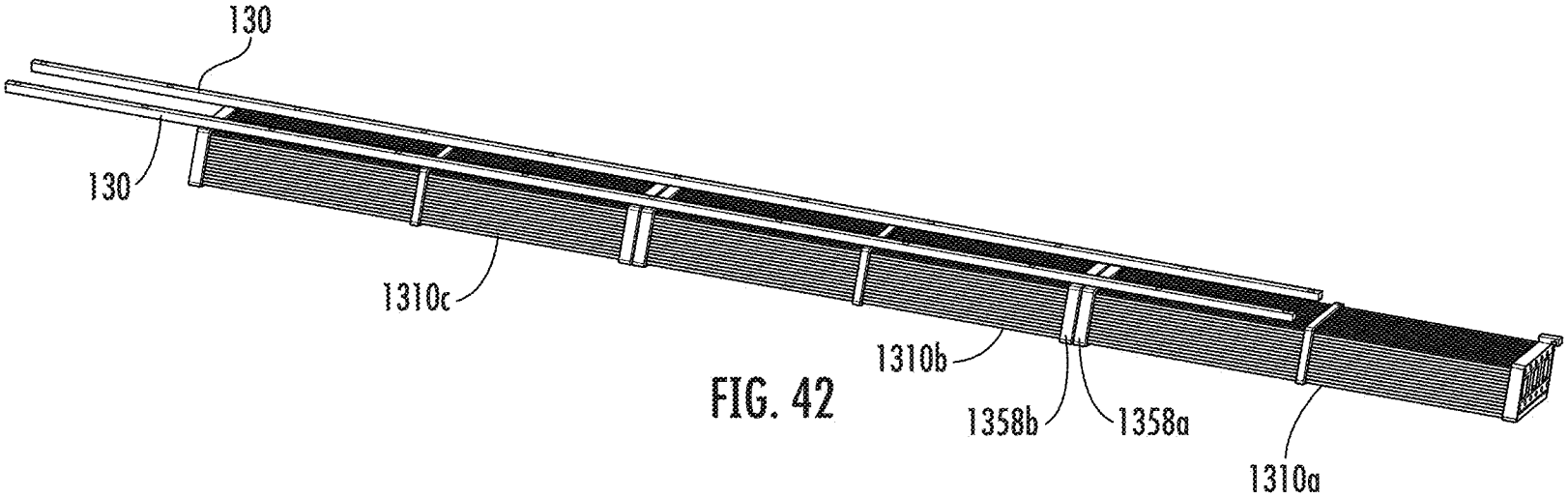
FIG. 42 is a perspective view of an assembly of thermal protection modules of FIG. 40 slidably secured to a rail system of a cargo container in accordance with the present disclosure.
Figure 43:
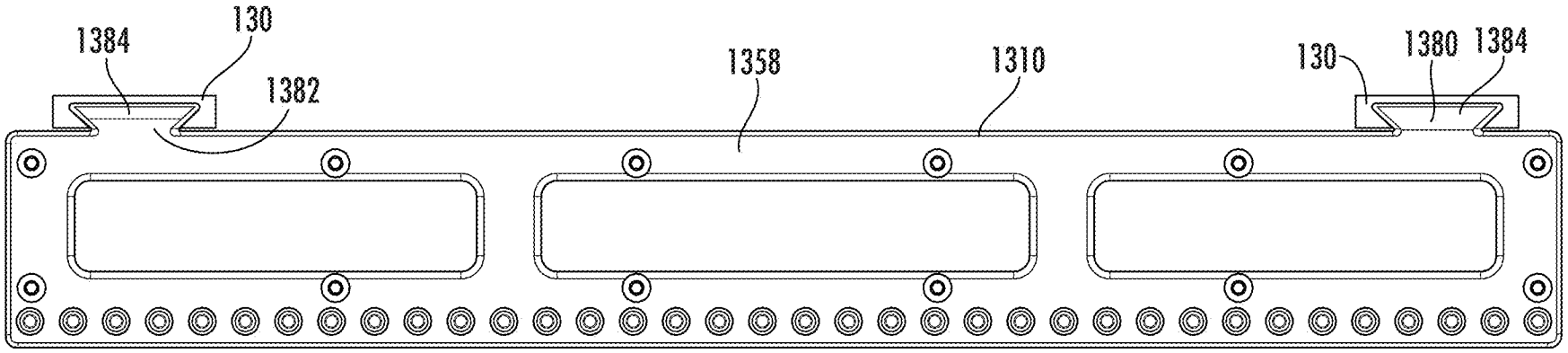
FIG. 43 is a front view of the assembly of FIG. 42.

Referring now to FIGS. 42 and 43, multiple thermal protection modules 1310 are shown slidably received on rails 130 of a cargo container, e.g., cargo container 100. The rails 130 can be secured to the ceiling or a wall of the cargo container 100 and are spaced to slidably receive the first and second tabs 1382, 1384 of the interconnect system 1380. The rails 130 allow the thermal protection modules 1310 to be inserted and removed from a cargo container when the cargo container is loaded with cargo or when the cargo container is empty. In some embodiments, the rails 130 may allow for the insertion and removal of the thermal protection modules 1310 when the cargo container is loaded and the doors or closure of the cargo container is closed.

Figure 44:
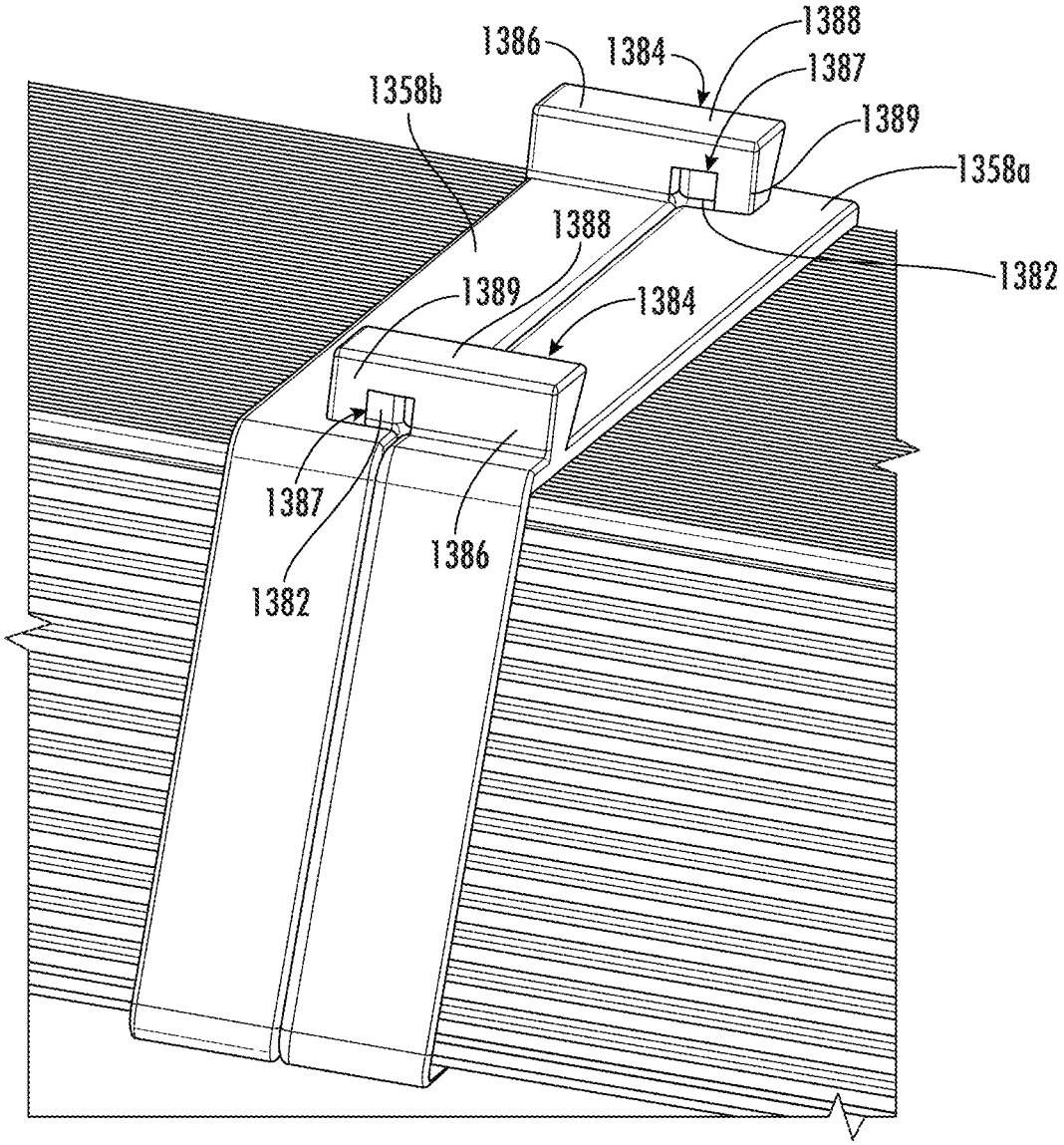
FIG. 44 is a perspective view of the interface between the thermal protection modules of FIG. 42 with the rail system removed.

With additional reference to FIG. 44, the interconnect system 1380 allows for the connecting and removing of multiple thermal protection modules 1310 in concert with one another. For example, as shown in FIG. 42, the rails 130 receive multiple thermal protection modules 1310 on end with one another. The interconnect system 1380 allows a first thermal protection module 1310*a* to be engaged by a second thermal protection module 1310*b* such that the first thermal protection module 1310*a* slides in concert with the second thermal protection module 1310*b* along the rails 130. It is contemplated that the interconnect system 1380 may allow for any number of thermal protection modules 1310 to slide on a set of rails 130 depending on the depth of the cargo container and the length of the thermal protection modules. For example, if used in a 53-foot trailer with 2 foot thermal protection modules, a set of rails 130 may have 26 thermal protection modules on a set of rails with each thermal protection module interconnected with an adjacent thermal protection module.

When loaded, the finger section 1388 of each second tab 1384 extends over a first tab 1382 of an adjacent module end cap 1358 such that the first tab 1382 is received in the receiver 1387 of the respective second tab 1384. The first and second tabs 1382, 1384 are slidably received in a respective rail 130 such that the first and second tabs 1382, 1384 are prevented from separating until removed from the rail 130. In this manner, the interconnect system 1380 joins multiple thermal protection modules 1310 to slide in concert with one another. In certain environments where the thermal protection module 1310 has a length equal to the cargo container, a module end cap may be provided with 2 second tabs 1384 having only the mounting section 1386 of each to be slidably received on the rails 130. In some embodiments, the brackets 970 include mounting sections 1386 of the second tabs 1384 to slidably engage the rails 130.

The first and second tabs 1382, 1384 may be formed of a material to aid in sliding of the first and second tabs 1382, 1384 in the rails 130. In some embodiments, the legs of the first and second tabs 1382, 1384 may be coated with a material to aid in sliding of the first and second tabs 1382, 1384 in the rails 130. One or more of the module end caps 1358 may include a handle or a recess that can be engaged by a hand of user to pull and/or push the thermal protection modules 1310 into or out of the container.

While shown with the thermal protection module 1310, the interconnect system 1380 may be used with any of the thermal protection modules detailed herein including thermal protection modules 10 having bodies 20, 220, or 320; thermal protection modules 410 or 610 having bodies 420, 520, 720, or 820; or thermal protection module 910.

The bodies detailed above may be formed of materials with high thermal conductivity to allow thermal energy transfer into and out of a cooling medium within the bodies. However, as detailed below, when the bodies are formed of materials having a low thermal conductivity may allow for similar thermal energy transfer into and out of the cooling medium in free convection environments such that for certain applications, a low thermal conductivity material may be preferred based on environmental conditions. However, when a low thermal conductivity material is used, the volume of the cavity having the same surface area may be reduced based on an increased thickness of the walls. The bodies detailed above may be formed of an extrusion process such that the profile can be continuously extruded and cut to a desired length. The extrusion process may allow for a thin walled and seamless construction along the length of each body.

Below is a description and calculations of the temperature maintenance of an example of a cargo container in accordance with the present disclosure. While any temperature is possible with the tuning of the PCM, a PCM of the thermal protection module may be formulated to melt between 20 degrees Celsius and 23 degrees Celsius such that the PCM may be frozen in a cold storage facility having a temperature of 18 degrees Celsius. The body of the thermal protection module may be formed of aluminum or a plastic, e.g., HDPE, which has a heat transfer coefficient in a range of 6 to 10 Watts/($m^2 \cdot °$ K) for gravity or free convection. As used herein the term "free convection" means convection as a result in gravity based on a difference in density caused by a temperature differential across an area. In contrast, "forced convection" is convection based on some sort of induced fluid flow such as a fan. The heat transfer coefficient for aluminum may be significantly higher for forced convection in comparison to the heat transfer coefficient for plastic in forced convection even through the heat transfer coefficient is similar for free convection. However, in some environments, e.g., corrosive environments, plastic or a plastic coating may be more suitable to prevent damage to the thermal protection module. The thermal protection modules of the cargo container may be 2.25 meters long and have a total surface area of 3.3 square meters. The cargo container may include 20 thermal protection modules secured to the roof or walls of the cargo container. Given a three-degree Kelvin temperature difference, the cooling available may be 1386 Watts calculated as 20 thermal protection modules*7 Watts/($m^2 \cdot °$ K)*3.3 $m^2$*3° K. The 1386 Watts may be sufficient to maintain a temperature within the cargo container even with a lightly insulated cargo container, e.g., R5-R10 insulated cargo container.

In an example below, a cargo container may include nineteen thermal protection modules 910 installed across the top of the cargo container with each thermal protection module having a surface area of 3.8 meters squared for a total of 72 meters squared of thermal transfer area.

Below are example calculations of the thermal capabilities of the thermal protection modules. The calculations below are based on A Study published by Khalif and Al Mousawi. Khalif and Al Mousawi, "Comparison of Heat Transfer Coefficients in Free and Forced Convection using Circular Annular Finned Tubes," Int. J. of Appl'n or Innovation in Eng. & Mgmt. (IJAIEM), vol. 5 issue 4, April 2016. The heat transfer coefficient (h) for free air convection from aluminum fins at a low delta temperature is 7 Watts/($m^2 \cdot °$ K). The heat flux Q can be calculate using the following heat transfer equation is $Q=hA\Delta T$ where Q is heat flux in Watts and h is the heat transfer coefficient, A is the surface area, and $\Delta T$ is the temperature difference between air in container and the temperature of the cooling medium, e.g., PCM in the thermal protection module. It will be appreciated that in most applications, the temperature difference is small because the cargo container is designed to be at or near a transition temperature of the cooling medium. As such, we will use a temperature difference or delta of 3 degrees Kelvin or 5.4 degrees Fahrenheit. Using the values above, the heat flux per thermal protection module is 80 Watts or 1500 Watts for a full load of 19 thermal protection modules in the container.

As detailed below, the heat flux of 1500 Watts may be sufficient to maintain a temperature of the cargo container when exposed to a high thermal load including a high solar load. Using the following information where the temperature is 310 degrees Kelvin (37 degrees Celsius or 98 degrees Fahrenheit) and where the roof is exposed to a higher temperature from the sun with a roof temperature ($T_{solar}$) of 340 degrees Kelvin (67 degrees Celsius or 152 degrees Fahrenheit). Using the roof temperature of 340 degrees Kelvin; an outside temperature of 310 degrees Kelvin as the temperature for the walls, base, and closure; a roof area of 7.7 meters squared; and a total surface area of the walls, base, and closure of 25 meters squared the heat flux into the cargo container can be calculated as for a cargo container with R10 insulated walls:

$$R10 \text{ walls } (RSI\ 1.8 \text{ Watts}/(\text{m}^2 \cdot ° \text{ K}))$$

$$Q_{roof} = 205 \text{ watts}$$

$$Q_{other} = 241 \text{ watts}$$

$$Q_{total} = 497 \text{ watts}$$

and for a cargo container with R5 insulated walls:

$$R5 \text{ walls } (RSI\ 0.9 \text{ Watts}/(\text{m}^2 \cdot ° \text{ K}))$$

$$Q_{roof} = 411 \text{ watts}$$

$$Q_{other} = 482.6 \text{ watts}$$

$$Q_{total} = 993.6 \text{ watts}$$

Thus, for the R10 unit, 496.8 Watts is needed from the thermal protection modules to maintain a temperature within the cargo container in such an environment. Based on the ability of one thermal protection module to provide 80.1 Watts and a total of 496.8 Watts is required for a R10 cargo container, 7 thermal protection modules would be required to maintain a temperature within the cargo container and with a safety factor of 1.5 would require 10 thermal protection modules. Similar calculations can be made for a R5 cargo container which would require 19 thermal protection modules to maintain the temperature within the cargo container.

Another factor that needs to be considered is the amount of time the thermal protection modules could maintain a temperature before the PCM within the thermal protection modules is depleted of its charge. Using the example container above, the interior volume of the thermal protection modules of the container is 9956 cubed centimeters. For an example 23 degree Celsius PCM, the specific gravity may be 0.85 grams per cubed centimeters and the Latent Heat of Fusion (melting energy) may be 230 Joules per gram. Thus, the mass of the PCM per thermal protection module may be 8441 g which would require 1941511 J of energy to melt or 1941511 watt·seconds. For an R10 insulated cargo container with such solar and thermal loading, the thermal protection modules will last 1941511 Watt·seconds÷496.8 Watts=3908 seconds or 65 minutes per thermal protection module for a R10 cargo container and 32 minutes for a R5 cargo container. Thus, 19 modules may provide 19 hours of temperature moderation in an R10 ULD. Depending on the thermal profile of the cargo trip, fewer thermal protection modules may be used. Alternatively, additional thermal protection modules could be affixed to the vertical walls of the ULD. In some embodiments, thermal protection modules could be secured to the floor of the container. However, it is noted that adequate protection of the thermal protection modules secured to or forming the floor may be necessary. A thermal protection module forming or secured to the floor may be effective for warming or heating an interior of the container.

From the calculations above, the thermal transfer rates of the thermal protection modules are sufficient to maintain a temperature with the cargo container for 1 hour or 30 minutes for the given environmental conditions for each thermal protection module. As noted above, the temperature difference is 3 degrees Celsius. If the goal was to keep the interior temperature relatively constant over a period of 8 hours in the hot desert sun, 10 thermal protection modules would be required for a R10 cargo container and 19 thermal protection modules would be required for a R5 cargo container.

Using the method 1200 above and the example thermal protection module used above, the time to charge the thermal protection modules can be calculated as follows. Using the same calculations, if the cargo container, and thus the thermal protection modules, are stored at a room temperature of 30 degrees Celsius and placed in an 18-degree Celsius cold storage area the charging time can be calculated using the following variables:

$$\Delta T = 30^\circ\ \text{C.} - 18^\circ\ \text{C.} = 12^\circ\ \text{C.} = 12^\circ\ \text{K.}$$

Surface area of a single thermal protection module=3.346 $m^2$

Heat Transfer Coefficient=9.5 w/($m^2$·° K)—this is a result of the increased ΔT Mass of Phase Change Material of the thermal protection module=8511 grams Heat Capacity of Liquid PCM=2.2 J/gram·° K Mass of Aluminum Body=13043 grams Heat Capacity of Aluminum=0.89 J/gram·° K.

Thus, the energy required to reduce the temperature from 30 degrees Celsius to 23 degrees Celsius is 8462 g·2.2 J/g·7·° K+13917 g Aluminum·0.89 J/g·7·° K=217018 Joules. Further, the energy required to change the state or charge the PCM is 8462 g·210 J/g=1777020 Joules. As a result, the total energy required to charge each thermal protection module from 30 degrees Celsius to 18 degrees Celsius is 217018 J+1777020 J=1994038 J=1994038 watt·second. Using the heat flux capability of the thermal protection modules of Q=hAΔT=9.5 w/($m^2$·° K)·3.346 $m^2$·(23° C.−18° C.)=32 Watts and the total time required to cool and charge a thermal protection module in an 18-degree Celsius cold room is 1994038 watt·second+32 watts=62314 seconds=17 hours. The sight glass 52 in the end of the thermal protection module may provide a visual cue for the state of freezing as a charged PCM is opaque and a liquid or uncharged PCM may be transparent.

As noted above, the calculations above were made with respect to the thermal protection module 910 formed of aluminum. Similar calculations can be made with respect to the thermal protection module 10 formed of aluminum which has a surface area of 3.346 $m^2$ or a thermal protection module 910 formed of plastic having a surface area of 3.8 $m^2$. In addition, similar calculations can be made for a traditional PCM bottle that is formed of a low-density polyethylene that has a total surface area of 0.5256 $m^2$. An example PCM bottle is disclosed in U.S. Patent Publication No. 2023/0050746. Using these calculations, the total mass of a PCM in each container is 8442 grams for the aluminum module 910, 4221 grams for the plastic module 910, 8511 grams for the aluminum module 10, and 6946 grams for the traditional PCM bottle. As such, while the plastic module 910 may have a heat flux similar to the aluminum module 910, it will last about half as long as there is about half the medium within the module. This can be shown as the percent mass of the container that is attributed to the medium as a percentage of medium by mass which is 59 percent of the weight of the aluminum module 910, 38 percent of the weight of the plastic module 910, 40 percent of the weight for the aluminum module 10, and 89 percent of the weight of the traditional PCM bottle. An important factor may also be the capability of the thermal protection module to quickly transfer heat into or out of a container with the heat flux of the thermal protection module 910 being 107 Watts regardless of the material, the heat flux of the thermal protection module 10 being 94 Watts, and the heat flux of the PCM bottle being 1 Watt. As such, either the thermal protection module 910 or the thermal protection module 10 have a significantly higher heat flux than the traditional PCM bottle. It will be appreciated that a heat transfer of 20 Watts or greater may allow for use in a low delta temperature environment. For example, a thermal protection module as detailed herein may have a heat transfer flux or rate in a range of 20 Watts to 150 Watts, e.g., 50 Watts to 100 Watts, 75 Watts to 125 Watts, 90 Watts to 110 Watts.

Additional factors for the different modules are shown in the table below. In the example below, the same medium is used for each of the modules. As shown in the table below, the first set of calculations were made for a traditional PCM bottle, the second module in the table is the aluminum module 10, the third module in the table is the aluminum module 910, and the fourth module in the table is the plastic module 910. It will be appreciated that walls of the shells 923 of the module 910 formed of plastic material are significantly thicker such that the surface area of the plastic module 910 and the aluminum module 910 are the same but the mass of the medium within the plastic module 910 is half of the medium within the aluminum module 910. The calculations were made with each of the modules having a length of 1 meter and the medium having a latent heat of 230 Joules per gram.

| | Module Design | | | |
|---|---|---|---|---|
| | PCM Bottle | Module 10 | Module 910 | Module 910 |
| Material of Shells/Body | Plastic (LDPE) | Aluminum | Aluminum | Plastic (HDPE) |
| Mass of Medium (g) | 6946 | 8511 | 8442 | 4221 |
| Total Surface Area (cm2) | 5256 | 33457 | 38125 | 38125 |

-continued

| | Module Design | | | |
|---|---|---|---|---|
| | PCM Bottle | Module 10 | Module 910 | Module 910 |
| Total Mass of Module without Medium (g) | 847 | 13043 | 5857 | 6846 |
| Surface Area/Medium per unit Mass (cm2/g) | 0.76 | 3.93 | 4.52 | 9.03 |
| Total Mass (g) | 7792 | 21554 | 14299 | 11067 |
| Percent Medium by Mass | 89% | 39% | 59% | 38% |
| Total Latent heat (kJ) | 1597.47 | 1957.53 | 1941.60 | 970.85 |
| Total Latent Heat (kWh) | 0.44 | 0.54 | 0.54 | 0.27 |
| Total Latent Heat per Mass (kJ/Kg) | 205.01 | 90.82 | 135.79 | 87.72 |
| Surface Area per Mass (M2/Kg) | 0.67 | 1.55 | 0.00 | 3.44 |
| Thermal Conductivity (W/(m2*K)) | 0.33 | 210 | 210 | 0.33 |

The efficiencies of the thermal protection modules above can be compared by the heat flux per unit of weight as measured in Watts per Kilogram. The heat flux per unit of weight is dependent on the temperature differential as measured in degrees Celsius or Kelvin. Specifically, as the temperature differential increases, the heat flux per unit of weight will increase. In addition, the heat flux per unit of weight can vary based on other conditions such as free convection or forced convection, e.g., a fan or other forced movement. For the purposes of the table below, the thermal protection modules are subject only to free convection in an enclosed container. The total mass of the thermal protection module including the bodies and the medium disposed within the medium is used. As shown, the thermal modules 10 and 910 improve heat flux per unit of mass in a range of 137 percent to 426 percent as compared to a traditional PCM bottle. Specifically, when focusing on a 4 degree temperature differential, the heat flux per Kilogram of the different modules is 1.83 Watts/Kg for a traditional PCM bottle in comparison to 9.65 Watts/Kg for a thermal protection module 910 formed of a plastic material, 3.26 Watts/Kg for a thermal module 10 formed of aluminum, and 7.47 Watts/Kg for a thermal module 910 formed of aluminum. Based on the materials forming the shells and the bodies and the sizing, the thermal protection modules disclosed herein have a heat flux per weight at a 4 degree temperature differential in a range of 3 Watts/Kg to 12 Watts/Kg, e.g., 4 Watts/Kg to 10 Watts/Kg. It is noted that the outer dimensions of the modules 910 are the same with the volume of the plastic module being significantly lower as the thickness of the shell is increased to provide the rigidity needed to have similar strength as an aluminum shell. As such, the longevity of the plastic module, or total thermal energy, is significantly less than the aluminum module.

| Temperature | Heat Flux Per Unit of Mass | | | |
|---|---|---|---|---|
| Differential Kelvin or Celsius | PCM Bottle | Aluminum Module 10 | Aluminum Module 910 | Plastic (HDPE) Module 910 |
| 1 | 0.46 | 1.09 | 1.87 | 2.41 |
| 2 | 0.92 | 2.17 | 3.73 | 4.82 |
| 3 | 1.38 | 3.26 | 5.60 | 7.23 |
| 4 | 1.83 | 4.35 | 7.47 | 9.65 |
| 5 | 2.29 | 5.43 | 9.33 | 12.06 |
| 6 | 2.75 | 6.52 | 11.20 | 14.47 |
| 7 | 3.21 | 7.61 | 13.06 | 16.88 |
| 8 | 3.67 | 8.69 | 14.93 | 19.29 |
| 9 | 4.13 | 9.78 | 16.80 | 21.70 |
| 10 | 4.59 | 10.87 | 18.66 | 24.11 |

As shown above, the plastic module 910 has performance similar if not better than the aluminum module 910. This can be true and unexpected in a free convection environment as a result in of a boundary layer not being broken down in the free convection environment. However, when used in a forced convection environment, the boundary layer breaks down and the aluminum module 910 outperforms the plastic module 910. Thus, as convection increases, the boundary layer may be reduced to show an increase in performance of the aluminum module 910. For example, in freezing if the cold room or freezer has forced convection that goes over the module, the boundary layer may be broken down such that the aluminum module 910 recharges significantly quicker than the plastic module 910. Similar results can be seen in an ice bath or a hot bath to melt a medium within the aluminum or plastic module 910.

Figure 45:
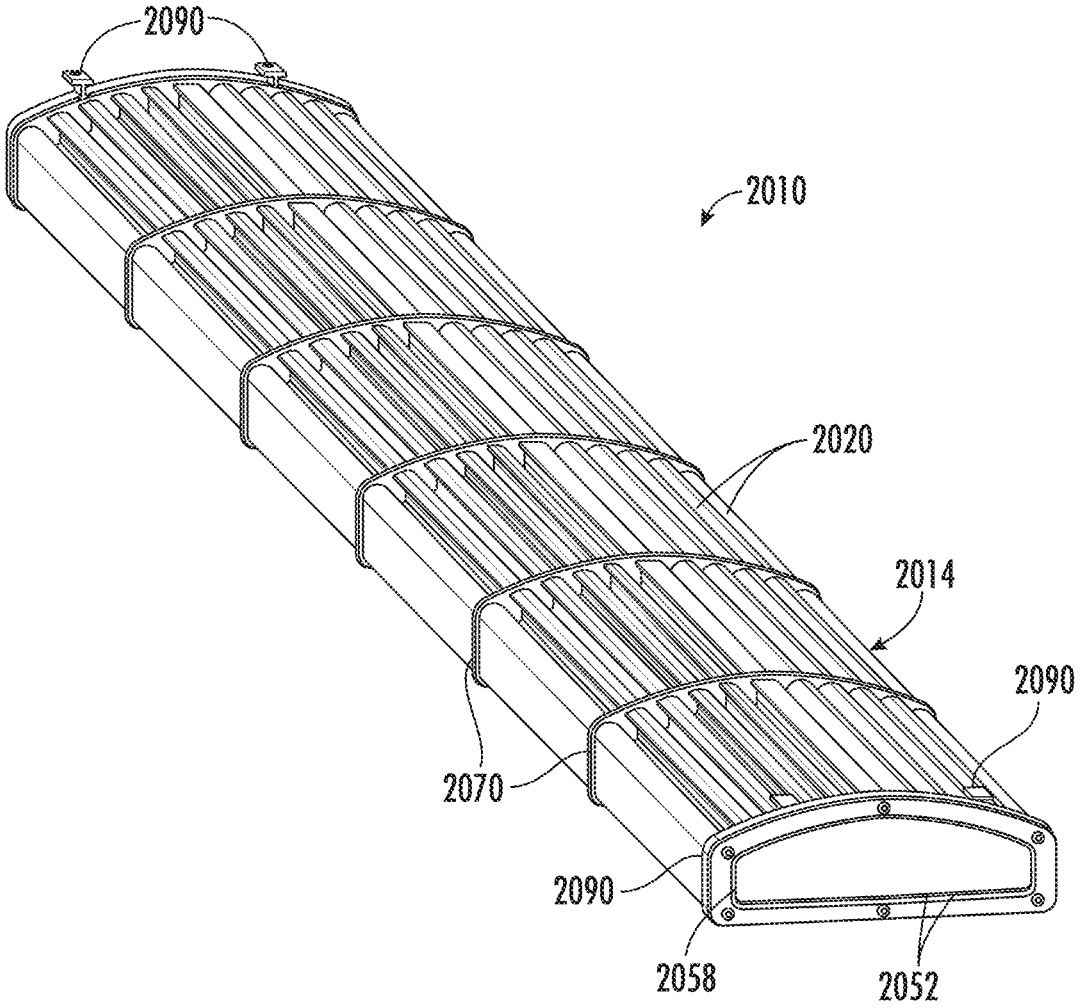
FIG. 45 is a perspective view of another thermal protection module provided in accordance with the present disclosure.
Figure 46:
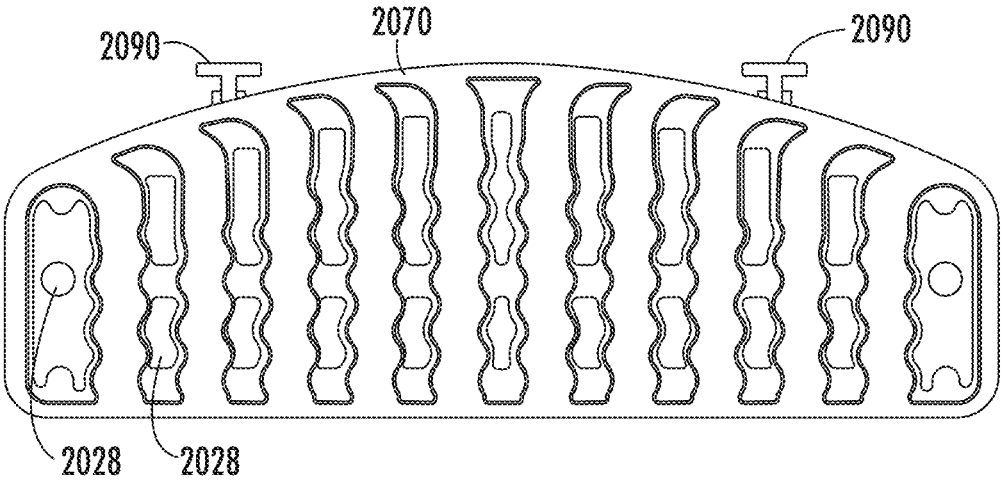
FIG. 46 is an end view of the thermal protection module of FIG. 45.
Figure 47:
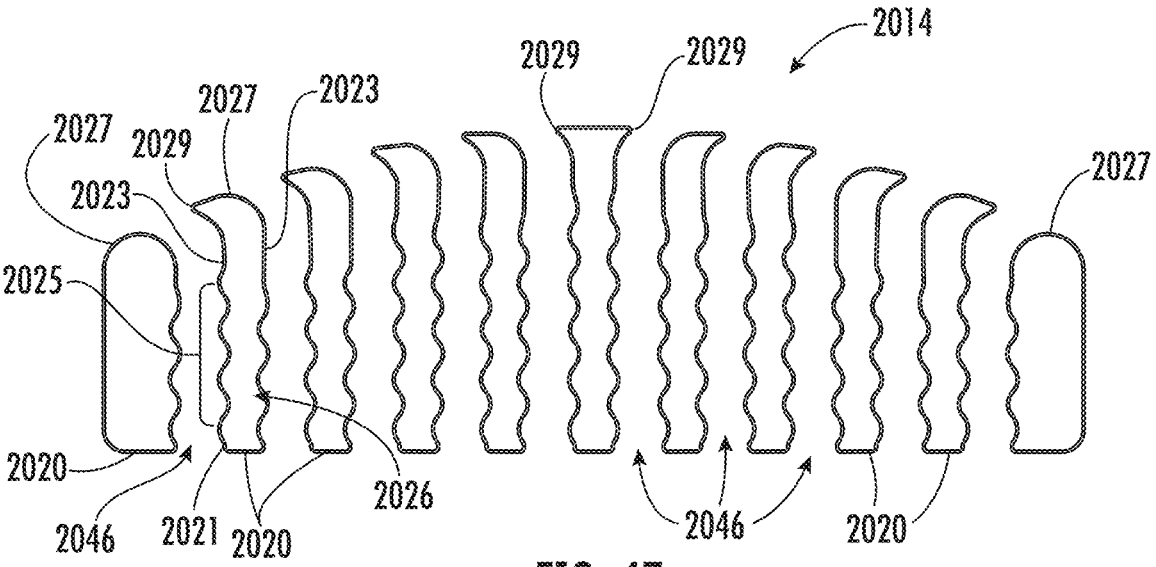
FIG. 47 is a profile view of an array of bodies forming the thermal protection module of FIG. 45.

With reference to FIGS. 45-47, another thermal protection module 2010 is provided in accordance with embodiments of the present disclosure. The thermal protection module 2010 includes a plurality of bodies 2020 that are disposed in an array of bodies 2014. The thermal protection module 2010 may include one or more brackets or spacers 2070 that are disposed along the length of the thermal protection module 2010 to support the bodies 2020 and to maintain a position of the bodies 2020 relative to one another in the array of bodies 2014. In some embodiments, each body 2020 extends the entire length of the thermal protection module 2020. In some embodiments, one or more of the bodies 2020 may extend only a portion of a length of the thermal protection module 2020 with a joint formed at one or more of the brackets 2070 between bodies 2020. Each body 2020 may be individually sealed such that a PCM is sealed within the respective body 2020.

The end portion of the thermal protection module 2010 may include a module endcap 2058 as shown in FIG. 46. The module endcap 2058 is disposed over the end portions of the bodies 2020. The module endcap 2058 may be secured to a bracket 2070 that is disposed over the end portions of the bodies 2020. The module endcap 2058 may protect the ends of the bodies 2020 and may allow for the plurality of bodies 2020 to form the thermal protection module 2010 and along with the brackets 2070, when included, be handled as a single unit. In some embodiments, the module endcap 2058 may be formed of an energy absorbing material, e.g., rubber, that protects the ends of the bodies 2020 from impacts. The lower section of the module endcap 2058 may have through passages that allow for viewing of the sight glasses 2052 of the bodies 2020. In certain embodiments, the manifold endcap 2058 may be labeled and/or colored in a manner to indicate the transition temperature of a cooling or warming medium disposed within the thermal protection module 2010. For example, the manifold endcap 2058 may be blue or labeled with a −2 degree Celsius label when a cooling medium within the thermal protection module 2010 is a −2 degree Celsius PCM or the manifold endcap 2058 may be red or labeled with a 100 degree Celsius label when a warming medium within the thermal protection module 2010 is a 100 degree Celsius PCM. Such labeling or coloring may be applied to any of the endcaps disclosed herein.

The module endcap 2058 may include hangers 2090 that are used to secure the module endcaps 2058 to a ceiling or a wall of a container. The hanger 2090 may be secured to a hanger mount 2059 formed on the module endcap 2058 or may be integrally formed with the module endcap 2058. The ends of the bodies 2020 may be supported by the hanger 2090 and the module endcap 2058. The hangers 2090 may be sized to position the thermal protection module 2020 from a ceiling or wall of a container. The hangers 2090 may be configured to space a top of the bodies 2020 from the ceiling or the wall of the cargo container to allow for air to flow between the thermal protection module 2010, e.g., the bodies 2020, and the ceiling or the wall of the cargo container. In some embodiments, the hangers 2090 may be selected or manipulated to adjust the distance between the thermal protection module 2010 and the ceiling or the wall of the cargo container.

With particular reference to FIG. 47, the plurality of bodies 2020 form an array of bodies 2014. The array of bodies 2014 form a substantially rectangular array with an arch or arcuate top surface. The arched top surface has a highest point adjacent the midpoint of the array of bodies 2014 and the lowest points at the sides or edges of the array of bodies 2014. The arched top surface may be referred to as a domed top surface. Specifically, the plurality of bodies 2020 includes bodies 2020 having differing heights and shapes that cooperate to form the array of bodies 2014. As detailed below, each body 2020 of the array of bodies 2014 may be shaped and positioned to optimize air flow created by natural convection or free convection through the array of bodies 2014 to maintain a temperature within an interior of a container. In some embodiments, forced convection can be used to increase performance. The example of the array of bodies 2014 shown in FIG. 47 is shown to disclose the principles of this disclosure; therefore, the array of bodies 2014 should not been seen as limiting. For example, the array of bodies 2014 may include more or less bodies 2020. In some embodiments, the height difference between the midpoint and the side edges of the array of bodies 2014 may be greater or lesser than shown with respect to the array of bodies 2014.

As shown, the array of bodies 2014 includes eleven bodies 2020. In particular, there are five pairs of bodies 2020 on either side of a center body 2020. Each pair of bodies 2020 may have the same shape as one another mirrored about the midline of the array of bodies 2014 which passes through the center body 2020. Each pair of the bodies 2020 may have a constant profile such that a single die may be used to extrude a respective pair of the bodies 2020. In embodiments, the array of bodies 2014 may include a range of bodies 2020 from 2 bodies 2020 to 25 bodies 2020. In some embodiments, the array of bodies 2014 may include more than 25 bodies 2020.

The height of the bodies 2020 increases with each body 2020 from the side edge of the array of bodies 2014 to the midline of the array of bodies 2014. With particular reference to the second body 2020 in from the left side edge of the array of bodies 2014, the bodies 2020 have a shell which may include a base 2021, sidewalls 2023 extending upward from the ends of the base 2021, and a cap 2027 that define a cavity 2026 therein. The base 2021 may be planar with the bases 2021 of the adjacent bodies 2020 and may form a portion of the bottom of the array of bodies 2014. Each sidewall 2023 is spaced apart from the sidewall 2023 of adjacent bodies 2020 to form a gap 2046 therebetween. The sidewalls 2023 may include a section of increased surface area 2025 that extends from adjacent the base towards the cap 2027. The section of increased surface area 2025 is shown as undulating curves but may have a variety of shapes to increase the surface area of the sidewalls 2023 when compared to a straight sidewall and/or direct flow through the respective gap 2046. For example, the sidewalls 2023 may include a section of increased surface area 2025 having fins (e.g., fins 523, FIG. 20), waves (e.g., waves 823, FIG. 25), convoluted or zig-zag shape (e.g., convoluted shape 923, FIG. 27), or combinations thereof. The shapes of the section of increased surface area 2025 may be designed to maintain substantially laminar flow of air with minimal fluid eddies through the gap 2046 defined between adjacent bodies 2020. The shape of the section of increased surface area 2025 may be selected based on an application of the thermal protection module 2010. The application of the thermal protection module 2010 may include a variety of conditions including, but not limited to, a temperature delta, an anticipated temperature, or a size of a container.

The cap 2027 joins the top of the sidewalls 2023 such that the cavity 2026 is encapsulated or enclosed within the body 2020. Specifically, one of the sidewalls 2023 that terminates in a divider 2029. The divider 2029 is directed toward the side edge of the thermal protection module 2010 that is closest to the respective body 2020. The divider 2029 is positioned above the cap 2027 of the adjacent body 2020 closer to the side edge of the thermal protection module 2010 to which the divider 2029 is directed such that an entry to the gap 2046 is defined between the divider 2029 and the adjacent body 2020. The cap 2027 extends from the divider 2029 to the end of the other sidewall 2023. The cap 2027 may be arcuate between the divider 2029 and the end of the other sidewall 2023. The divider 2029 and the cap 2027 may be shaped to split air flowing over the thermal protection module 2010 into the gap 2046 on one side of the body 2020 to the gap 2046 on the other side of the body 2020 while maintaining laminar flow in each of the gaps 2046. As noted above, the bodies 2020 increase in height from the side edge of the array of bodies 2020 to the midpoint of the array of bodies 2014 such that the dividers 2029 of the bodies 2020 are positioned at increasing heights to direct air into the gaps 2046 between adjacent bodies 2020.

It is noted that the caps 2027 of the outermost bodies 2020, the bodies 2020 closest to the side edges of the array of bodies 2014, and the midpoint body 2020, the body 2020 disposed on the midpoint of the array of bodies 2014 may be shaped differently than the other bodies 2020. For example, the caps 2027 of the outermost bodies 2020 do not include a divider 2029 but are arcuate to direct a portion of air to flow downward on the side edge of the outermost body 2020 and a portion of air over the outermost body 2020 and into the gaps 2046 subsequent bodies 2020 towards the midpoint body 2020. The midpoint body 2020 may include a divider 2029 on each side of the cap 2027 such that the air reaching the midpoint body 2020 is guided down either side of the midpoint body 2020 and minimizing air passing over the midpoint body 2020. The dividers 2029 of the midpoint body 2020 may point slightly upward to prevent air from being trapped above the cap 2027 of the midpoint body 2020.

Figure 48:
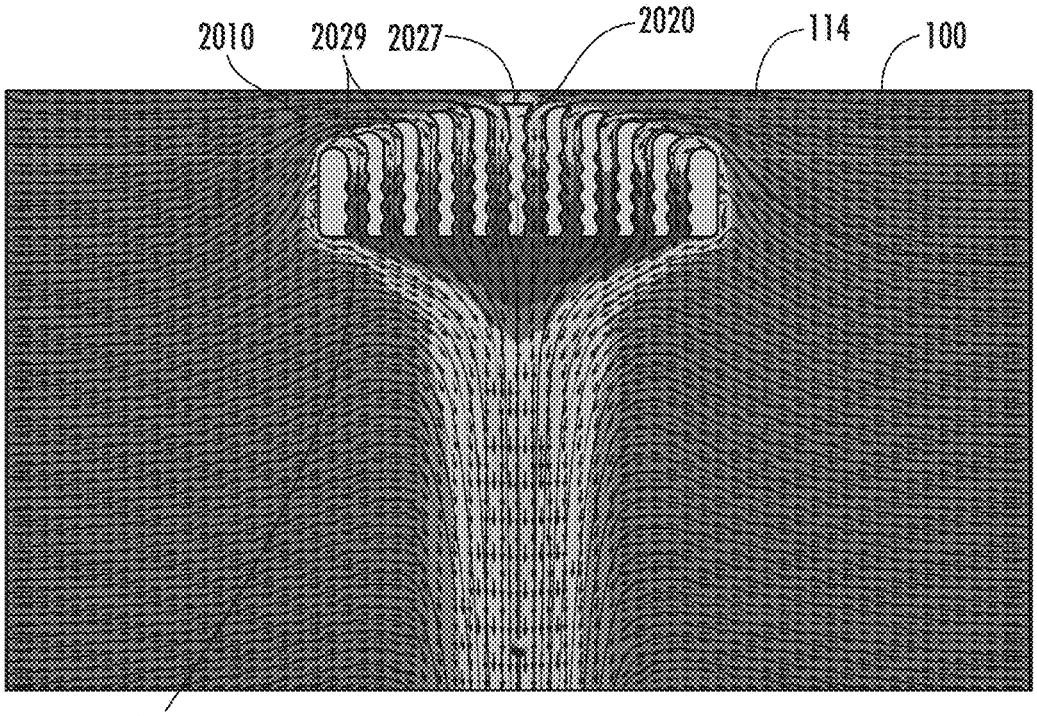
FIG. 48 is an example of a flow model of air flowing through the array of bodies of FIG. 47.
Figure 49:
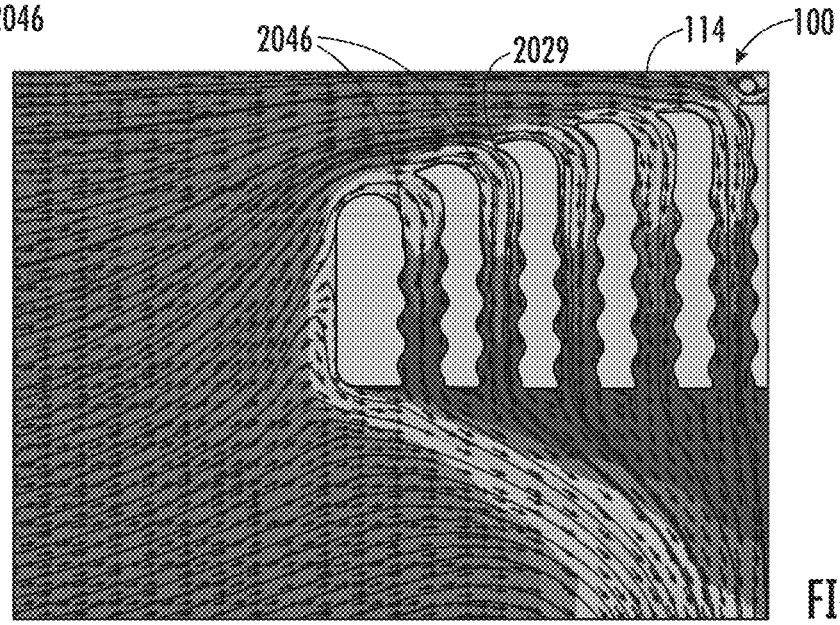
FIG. 49 is an enlarged view of a portion of the flow model of FIG. 48.

Referring now to FIGS. 48 and 49, airflow over the thermal protection module 2010 is described in accordance with embodiments of the present disclosure. The airflow over the thermal protection module 2010 may be driven by a difference in the temperature ("temperature delta") of the air surrounding the thermal protection module 2010. The thermal protection module 2010 may be configured to operate in a low temperature delta environment, e.g., in a temperature delta of 5 degrees Celsius or less. As shown in FIGS. 48 and 49, the temperature of the air in the container 100 is shown at gradients of a desired temperature, +0.8 degrees Celsius, +1.4 degrees Celsius, +1.9 degrees Celsius, +2.5 degrees Celsius, +3.1 degrees Celsius, +3.6 degrees Celsius, +4.2 degrees Celsius, and +5 degrees Celsius. The thermal protection module 2010 may be configured to operate in a passive airflow environment, e.g., without outside influences such as a fan or compressor. The passive airflow is driven by differences in density of air as a result of temperature differences. The thermal protection module 2010 may be configured to maintain air within the container 100 at a desired temperature without allowing large changes in the temperature of the air within the container 100, e.g., maintain the temperature within a ±5 degrees Celsius.

As shown, the thermal protection module 2010 is secured to the ceiling 114 of a container 100 with the cap 2027 of the midpoint body 2020 positioned adjacent the ceiling 114 of the container 100. The model shows that air is drawn towards and into the thermal protection module 2010. Specifically, air is drawn towards the side edges of the thermal protection module 2010 at the ambient temperature, e.g., a higher temperature, and is then split into airflow towards the ceiling 114 and airflow away from the ceiling 114. The airflow towards the ceiling 114 may start below or near a midline of the outermost body 2020 of the thermal protection module 2010. The airflow continues to flow towards the bodies 2020 of the thermal protection module 2010. As the approaches the bodies of the thermal protection module 2010, the air in the airflow may begin to be cooled by the thermal protection module 2010. The airflow is split and guided by the dividers 2029 of the bodies 2020 into each of the gaps 2046 between the bodies 2020 of the thermal protection module 2010. As the air flows through the gaps 2046, the air is cooled by the bodies 2020 of the thermal protection module 2010 such that the density of air increases, which causes the air to continue to flow downward through the gaps 2046. The bodies 2020 and the gaps 2046 between the bodies 2020 are sized and dimensioned such that as air flows through the gaps, the air reaches a desired temperature before exiting the respective gap 2046. The desired temperature may be the transition temperature of a PCM within the thermal protection module 2010. In some embodiments, the desired temperature may be slightly above or below the transition temperature of the PCM within the thermal protection module 2010, e.g., with 1 to 2 degrees Celsius of the transition temperature. As shown, the air reaches the desired temperature at different points, e.g., heights, in each of the gaps 2046. It will be appreciated that the temperature of the air may reach the desired temperature at different points based on the temperature that the air enters the respective gap 2046, the charge of the thermal protection module 2010, or a difference of the temperature of the air within the container and the desired temperature.

Figure 50:
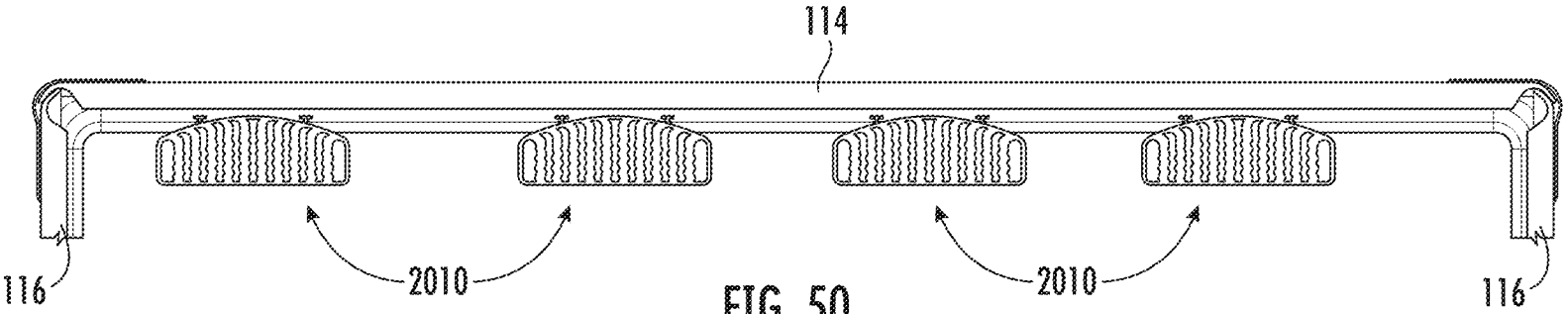
FIG. 50 is a view of a portion of a cargo container in accordance with the present disclosure with four thermal protection modules secured to the ceiling of the cargo container.

As the air exits the respective gaps 2046 at the desired temperature, the dense cold air moves downward and may mix with air within the container 100. As shown, the downward flow of air may begin to form a passive convective flow within the container 100 based on the temperature differences of the air within the container 100 which may increase the cooling rate within the container 100. The passive convective flow within the container 100 may mix the air within the container 100 to maintain a low temperature delta within the entire container 100. As shown, the thermal protection module 2010 is shown with space on either side. As shown in FIG. 50, the thermal protection modules 2010 may be secured to the ceiling 114 with the space on either side of the thermal protection module 2010 being in a range of 0.5 to 4 times a width of the thermal protection module 2010, e.g., 1 to 2 times the width. The width being defined as the distance between the side edges of the thermal protection module 2010. The space on either side of the thermal protection module 2010 may allow for air to flow upwards and into the top of the thermal protection modules 2010 such that air may flow through the gaps 2046 between the bodies 2020. The space on either side of the thermal protection modules 2010 may contribute to establishing a convective flow within the container 100.

While the airflow above is described for use with a cooling thermal protection module 2010, the airflow may be essentially reversed when the thermal protection module 2010 is used as a heating or warming thermal protection module 2010. Specifically, air may be drawn up through the gaps 2046 of the thermal protection module 2010 and be guided out by the dividers 2049 to establish the convective flow while warming the air as it passes through the thermal protection module 2010. The thermal protection module 2010 is a sealed or closed module 2010 with the PCM disposed within each body 2020. The thermal protection module 2010 may be recharged overnight in a cool room that has a temperature below the transition temperature of the thermal protection module 2010. For example, a 20 degree Celsius thermal protection module may be recharged, e.g., the PCM frozen, in an 18 degree Celsius cool room overnight, e.g., four to twelve hours.

Figure 51:
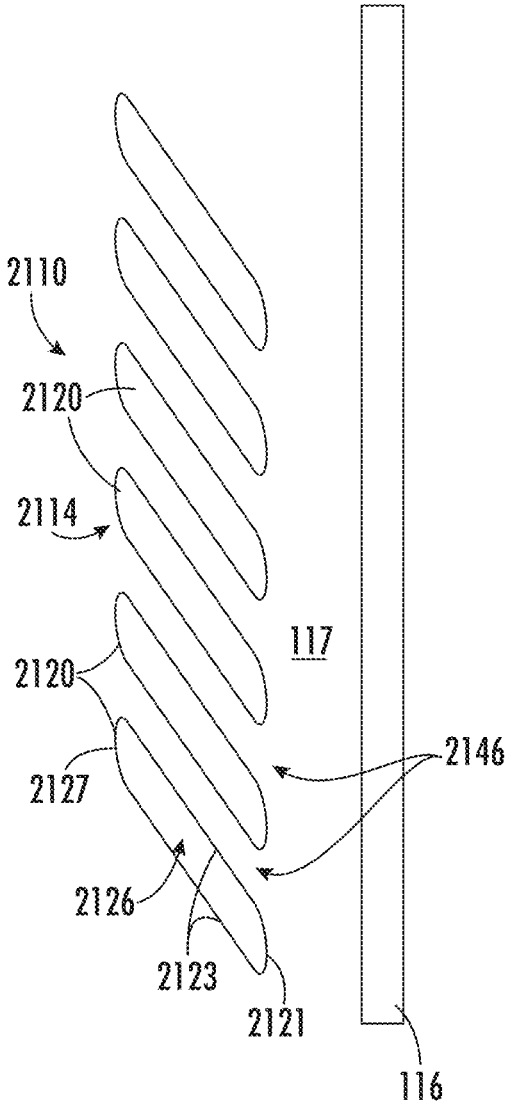
FIG. 51 is a profile view of another thermal protection module provided in accordance with the present disclosure secured to a wall of a container in a cooling configuration.
Figure 52:
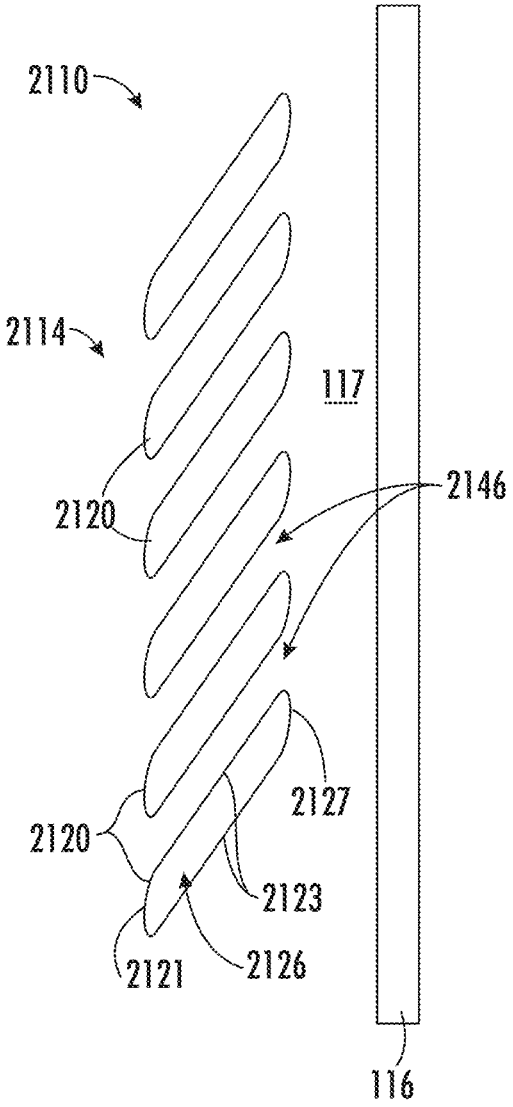
FIG. 52 is a profile view of the thermal protection module of FIG. 50 in a warming configuration.

With reference to FIGS. 51 and 52, a thermal protection module 2110 is provided in accordance with the present disclosure. The thermal protection module 2110 may be similar to the thermal protection module 2010 with similar elements represented with a leading "21" instead of the leading "20" and only the differences detailed herein for reasons brevity. The thermal protection module 2110 is configured to mount to a wall 116 of the container, e.g., a vertical wall 116. The thermal protection module 2110 may be mounted to a wall 116 to cool a container (FIG. 51) or to warm a container (FIG. 52). The construction of the thermal protection module 2110 for either application, cooling or warming, remains the same with only the mounting of the thermal protection module 2110 being changed between the cooling application and the warming application.

The thermal protection module 2110 includes a plurality of bodies 2120 arranged in an array of bodies 2114. The array of bodies 2114 are arranged in a parallel aligned arrangement such that the ends of each body 2120 are in a similar horizontal position relative to the other ends of each body 2120. Each body 2120 includes a base 2121, sidewalls 2123, and a cap 2127 that are interconnected to define a cavity 2126 within the body 2120. Each sidewall 2123 may be substantially linear or may include a section of increased surface area 2125 having a variety of shapes or features to increase a surface area of the sidewall 2123 while maintaining laminar flow in air flowing through a gap 2146 defined between adjacent bodies 2120. The array of bodies 2114 may include any number of bodies 2120. For example, the array of bodies 2114 may include between 4 and 12 bodies, e.g., 4, 5, 6, 7, 8, 9, 10, 11, or 12 bodies. In some embodiments, the array of bodies may include less than 4 bodies or more than 12 bodies.

The thermal protection module 2110 is mounted to the wall 116 with a channel 117 defined between respective the bases 2121 or caps 2127 and the wall 116 depending on the application. The channel 117 may have a width in a range of 1 inch to 4 inches to allow for air to flow between the thermal protection module 2110. The thermal protection modules 2110 may create a passive convective airflow in the container by drawing air in through the gaps 2146 of the thermal protection modules 2110 and allowing the air to flow between the thermal protection modules 2110 and the wall 116. In some embodiments, the thermal protection modules 2110 are mounted to the wall 116 with substantially no space between the thermal protection modules 2110 or may be mounted with a space between the thermal protection modules 2110 in a range of 0.5 times to 4 times the height of the thermal protection module 2110 between adjacent modules.

Figure 53:
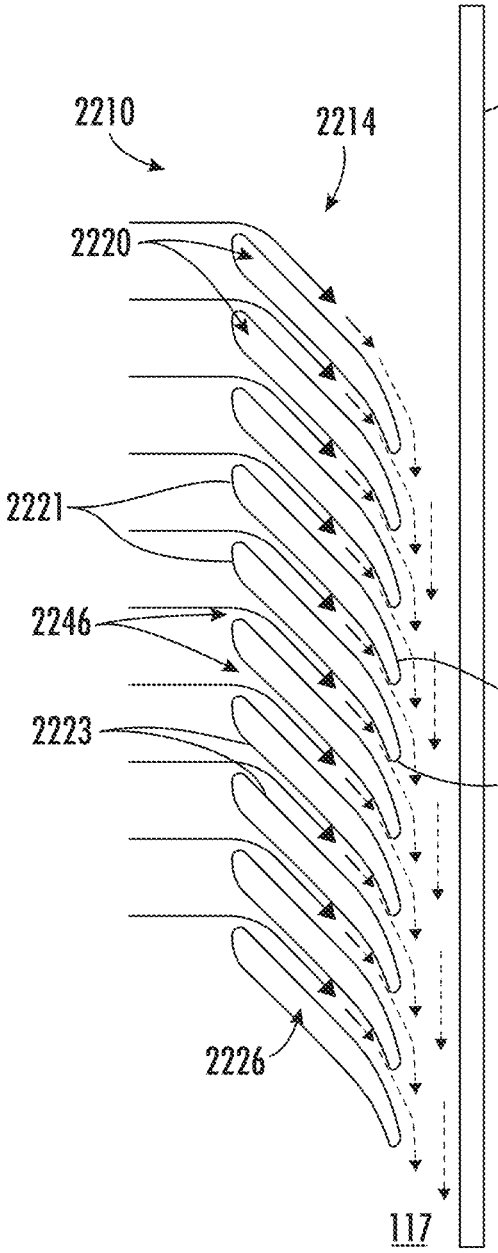
FIG. 53 is a profile view of another thermal protection module provided in accordance with the present disclosure secured to a wall of a container in a cooling configuration.
Figure 54:
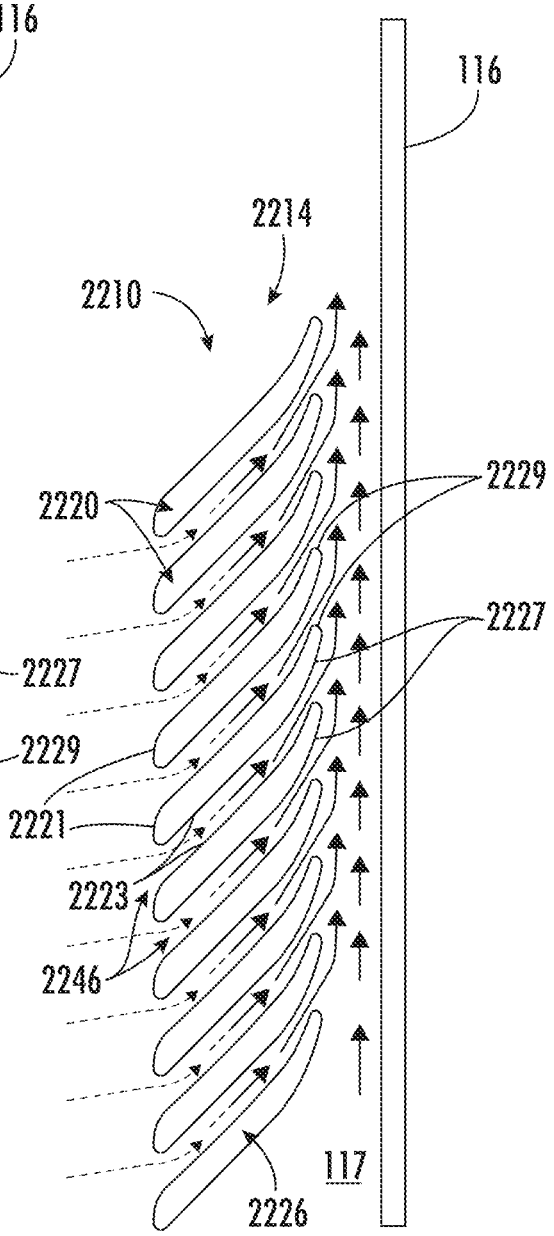
FIG. 54 is a profile view of the thermal protection module of FIG. 53 in a warming configuration.

With reference to FIGS. 53 and 54, a thermal protection module 2210 is provided in accordance with the present disclosure. The thermal protection module 2210 may be similar to the thermal protection module 2110 with similar elements represented with a leading "22" instead of the leading "21" and only the differences detailed herein for reasons brevity. The thermal protection module 2210 is configured to mount to a wall 116 of the container, e.g., a vertical wall 116. The thermal protection module 2210 may be mounted to a wall 116 to cool a container (FIG. 53) or to warm a container (FIG. 54). The construction of the thermal protection module 2210 for cither application, cooling or warming, remains the same with only the mounting of the thermal protection module 2210 being changed between the cooling application and the warming application.

The thermal protection module 2210 includes a plurality of bodies 2220 arranged in an array of bodies 2214. The array of bodies 2214 are arranged in a parallel aligned arrangement such that the ends of each body 2220 are in a similar horizontal position relative to the other ends of each body 2220. Each body 2220 includes a base 2221, sidewalls 2223, and a cap 2227 that are interconnected to define a cavity 2226 within the body 2220. Each sidewall 2223 may be substantially linear or may include a section of increased surface area 2225 having a variety of shapes or features to increase a surface area of the sidewall 2223 while maintaining laminar flow in air flowing through a gap 2246 defined between adjacent bodies 2220. The cap 2227 includes a divider or director 2229 that is configured to further direct flow of air from the gaps 2246 between the bodies 2220. The directors 2229 are configured to increase a flow of air adjacent the wall 116 of the container to improve passive convection within the container. The array of bodies 2214 may include any number of bodies 2220. For example, the array of bodies 2214 may include between 4 and 12 bodies, e.g., 4, 5, 6, 7, 8, 9, 10, 11, or 12 bodies. In some embodiments, the array of bodies may include less than 4 bodies or more than 12 bodies.

The thermal protection module 2210 is mounted to the wall 116 with a channel 117 defined between respective caps 2227 and the wall 116. The channel 117 may have a width in a range of 1 inch to 4 inches to allow for air to flow between the thermal protection module 2210. The thermal protection modules 2210 may create a passive convective airflow in the container by drawing air in through the gaps 2246 of the thermal protection modules 2210 and allowing the air to flow between the thermal protection modules 2210 and the wall 116. In some embodiments, the thermal protection modules 2210 are mounted to the wall 116 with substantially no space between the thermal protection modules 2210 or may be mounted with a space between the thermal protection modules 2210 in a range of 0.5 times to 4 times the height of the thermal protection module 2210 between adjacent modules. As shown, the orientation of the thermal protection module 2210 is reversed between the cooling configuration (FIG. 53) and the warming configuration (FIG. 54). The slope of the sidewalls 2223 draw air from the container and accelerate the air as the density of the air changes, as a result of a temperature change, such that the convective flow of air within the container is created to equalize a temperature within the container. Specifically, in a first or cooling configuration, the slope of the sidewalls 2223 are downward or negative from the interior of the container towards the wall 116 of the container and in a second or warming configuration, the slope of the sidewalls 2223 are upward or positive from the interior of the container towards the wall of the container. The gap 2226 and the director 2227 may decrease a size of the gap 2246 between adjacent elements 2220 of the thermal protection module 2210. Decreasing the size of the gap 2246 between adjacent elements 2220 may increase a velocity of air exiting the gap 2246.

The airflow and heat transfer of the thermal protection module 2010 was compared to the airflow and heat transfer of a traditional plastic bottle filled with a PCM, the thermal protection module 10, and the thermal protection module 910. The model was used to determine the number of bottles required to maintain a temperature of a cavity of a container less than 25 degrees Celsius when the container is exposed to a solar load equivalent to 68 degrees Celsius. The solar load equivalent may compensate for an ambient temperature of air and to the solar energy being absorbed by the container. The results of the model are shown in the tables below:

| Thermal Protection Module | Average Heat Transfer Coefficient ($W/M^{2*\circ}$ K) | Average Heat Flux ($W/M^2$) | Total Heat Transfer per Mass (W/Kg) | Weight per Module (Kg) | Weight at Same Heat Transfer (Kg) | Module Weight Percentage Difference (%) |
|---|---|---|---|---|---|---|
| PCM Bottle | 3.4670 | −17.700 | −0.6736 | 26.610 | 103.4 | 276.4 |
| 10 | 1.4462 | −7.231 | −0.7530 | 20.075 | 92.5 | 237.0 |
| 910 | 3.436 | −17.168 | −2.5949 | 22.735 | 27.5 | 0.0 |
| 2010 | 3.436 | −17.168 | −3.4396 | 22.769 | 20.9 | −23.8 |

| Thermal Protection Module | Latent Heat for 2176 mm Module (KJ) | Latent Heat at Same Heat Transfer (KJ) | Latent Heat Percentage Difference (%) | Modules Required at Peak Thermal and Solar Load | Total Weight (Kg) |
|---|---|---|---|---|---|
| PCM Bottle | 4878.6 | 49.800 | −76.9 | 32.4 | 765.2 |
| 10 | 3480.8 | 39.661 | −81.6 | 29.1 | 686.3 |
| 910 | 4697.1 | 215.860 | 0 | 7.2 | 197.7 |
| 2010 | 2374.7 | 109.131 | −49.4 | 7.2 | 150.7 |

From the tables above, it is shown that the thermal protection modules 910, 2010 have similar performance characteristics. However, the thermal protection module 2010 may decrease a mass of the overall module while maintaining similar performance. For example, in this application, only 7.2 thermal protection modules 910, 2010 are required to maintain the temperature in the container with the thermal protection modules having approximately 25 percent less mass. However, the overall latent heat of the thermal protection module 2010 may be about 50 percent less than that of the thermal protection module 910. As such, in some applications, the thermal protection module 910 may be used instead of the thermal protection module 2010.

The thermal protection module 2010 may be used in conjunction with or as an alternative to the other thermal protection modules detailed herein. Similarly, the thermal protection modules 2110, 2210 may be used alone or in conjunction with the other thermal protection modules detailed herein. The thermal protection modules 2010, 2110, 2210 may allow for a reduced mass or weight of the thermal protection modules to maintain a temperature within a container under a thermal and/or solar load. Reducing a mass or weight of the thermal protection modules may allow for increased mass of cargo within a container or reduce fuel or transportation costs for a given container.

As used in the tables and examples above, the PCM had a specific gravity of 0.85 grams per cubed centimeter. However, the PCM may be optimized or tuned for a specific application. For example, one 20 degree Celsius PCM may have a specific gravity of 0.85 grams per cubed centimeter and a latent heat of 210 Joules per gram and another 20 degree Celsius PCM may have a specific gravity of 1.2 grams per cubed centimeter and a latent heat of 260 Joules per gram. Thus, volumetrically the first PCM has an energy density of 0.85*210 for a first energy density of 178.5 Joules per cubed centimeter and the second PCM has an energy density of 1.2*260 for 312 Joules per cubed centimeter showing a 75 percent increase in energy density for only a 40 percent weight penalty. The increased energy density does not change the thermal heat transfer properties detailed above but would increase the length of time to melt all of a PCM within a thermal protection module. However, it would also increase the amount of time to charge the thermal protection module and increase the weight of the thermal protection module. As such, while the first formulation may be more desirable in some situations, where the exposed time of a cargo container may be desirable because of the lower weight and faster charge time, the second formulation may be more desirable if the anticipated exposed time to heat or solar energy may be longer such that the weight increase and longer charge time are acceptable for the increased amount of time to maintain a temperature in the thermal protection module. A method of manufacturing or installing the thermal protection module may include selecting a PCM based on an application of the thermal protection module. The method of manufacturing or installing the thermal protection module may include draining and replacing the PCM for another PCM based on the application of the thermal protection module.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A thermal protection module configured to operate in a low delta temperature environment, the thermal protection module comprising:

a first heat transfer element having a first shell, the first shell having a constant profile along a length thereof, the first shell defining a closed first cavity that is filled with a medium, the first shell having a base, a cap, and two sidewalls that each extend between the base and the cap, the first heat transfer element defining a side edge of the thermal protection module;

a second heat transfer element having a second shell, the second shell having a constant profile along a length thereof, the second shell defining a closed second cavity that is filled with a medium, the second shell having a base, a cap, and two sidewalls that each extend between the base and the cap, a first sidewall of the two sidewalls that is closer to the first heat transfer element meets the cap to form a divider, the divider positioned above the cap of the first shell when the base of the first shell and the base of the second shell are disposed within the same plane, the second heat transfer element adjacent to the first heat transfer element such that a gap is defined between the first heat transfer element and the second heat transfer element;

a first bracket receiving a first end portion of the first heat transfer element and a first end portion of the second heat transfer element; and a second bracket spaced apart from the first bracket and receiving a second end portion of the first heat transfer element and a second end portion of the second heat transfer element such that the gap is defined between the first heat transfer element and the second heat transfer element along the length thereof.

2. The thermal protection module according to claim 1, wherein the closed first cavity of the first heat transfer element is sealed separate from the closed second cavity of the second heat transfer element.

3. The thermal protection module according to claim 1, further comprising:

a third heat transfer element having a third shell, the third shell having a constant profile along a length thereof, the third shell defining a closed third cavity that is filled with the medium, the third shell having a base, a cap, and two sidewalls that each extend between the base and the cap, the third heat transfer element having a midline that is aligned with the midline of the thermal protection module, the second heat transfer element positioned between the first heat transfer element and the third heat transfer element;

a fourth heat transfer element that has the same profile of the first heat transfer element and is mirrored about the midline of the thermal protection module; and a fifth heat transfer element that has the same profile of the second heat transfer element and is mirrored about the midline of the thermal protection module, the fifth heat transfer element positioned between the third heat transfer element and the fourth heat transfer element.

4. The thermal protection module according to claim 3, wherein the fourth heat transfer element is spaced apart from the fifth heat transfer element such that a gap is defined therebetween.

5. The thermal protection module according to claim 4, wherein the third heat transfer element is spaced apart from the second and fifth heat transfer elements such that one or more gaps are defined therebetween.

6. The thermal protection module according to claim 1, wherein the first sidewall of the first heat transfer element includes a first section of increased surface area to increase a surface area or bending stiffness of the first sidewall of the first heat transfer element compared to a straight sidewall.

7. The thermal protection module according to claim 6, wherein the first sidewall of the second heat transfer element opposes the first sidewall of the first heat transfer element, the first sidewall of the second heat transfer element including a second section of increased surface area to increase a surface area or bending stiffness of the first sidewall of the second heat transfer element compared to a straight sidewall, the profile of the first section following the profile of the second section such that the gap has a constant width between the first heat transfer element and the second heat transfer element.

8. The thermal protection module according to claim 1, wherein the thermal protection module comprising eleven heat transfer elements including the first and second heat transfer elements, the eleven heat transfer elements having five pairs of heat transfer elements that have the same profile as one another and are mirrored about a midline of the thermal protection module from one another.

9. The thermal protection module according to claim 1, wherein the first bracket and the second bracket support the first heat transfer element and the second heat transfer element relative to one another in a substantially rectangular array with an arched top surface.

10. The thermal protection module according to claim 1, wherein the medium is tuned for an application of the thermal protection module.

11. A cargo container comprising:

a first sidewall;

a second sidewall opposite the first sidewall;

a back wall extending between the first sidewall and the second sidewall;

an opening defined between the first sidewall and the second sidewall opposite the back wall;

a closure configured to selectively close the opening;

a ceiling disposed above and supported by the first sidewall, the second sidewall, and the back wall, the first sidewall, the second sidewall, the back wall, and the closure defining an interior of the cargo container; and a first thermal protection module according to claim 1 secured to the ceiling, the heat transfer elements of the first thermal protection module forming a substantially rectangular array of elements with an arched top surface.

12. A thermal protection module comprising:

a plurality of heat transfer elements, each heat transfer element defining a respective element cavity of a plurality of element cavities, each heat transfer element of the plurality of heat transfer elements defining a gap with an adjacent heat transfer element; and a medium disposed within each element cavity such that the medium is sealed within each heat transfer element on either side of the gap, the thermal protection module having a domed top surface such that air is guided into the gaps between adjacent heat transfer elements.

13. The thermal protection module according to claim 12, wherein the element cavity of each heat transfer element is separately sealed.

14. The thermal protection module according to claim 12, wherein each heat transfer element is formed of a shell having a constant profile configured to maximize a surface area of the heat transfer element per unit of length thereof.

15. The thermal protection module according to claim 12, wherein the medium is a phase-change material, the thermal protection module configured to operate in a low delta temperature environment to maintain a temperature within a five degree Celsius range for a period of time.

16. A cargo container comprising:

a first sidewall;

a second sidewall opposite the first sidewall;

a back wall extending between the first sidewall and the second sidewall;

an opening defined between the first sidewall and the second sidewall opposite the back wall;

a closure configured to selectively close the opening;

a ceiling disposed above and supported by the first sidewall, the second sidewall, and the back wall, the first sidewall, the second sidewall, the back wall, and the closure defining an interior of the cargo container; and a first thermal protection module according to claim 12 secured to the ceiling, the plurality of heat transfer elements of the first thermal protection module forming a substantially rectangular array of elements with an arched top surface.

17. The cargo container according to claim 16, wherein the first thermal protection module is configured to maintain a temperature of the interior within a five degree Celsius range for a period of time when the cargo container is exposed to an ambient environment.

18. The cargo container according to claim 16, further comprising a second thermal protection module according to claim 12 secured to the ceiling, the second thermal protection module disposed in a parallel manner to the first thermal protection module and spaced apart laterally from the first thermal protection module such that a space in a range of 0.5 times to 4 times a width of each thermal protection module is defined between the first thermal protection module and the second thermal protection module.

* * * * *